United States Patent [19]

Piotroski et al.

[11] Patent Number: 4,547,856

[45] Date of Patent: Oct. 15, 1985

[54] UNIVERSAL MULTI-STATION DOCUMENT INSERTER

[75] Inventors: Peter N. Piotroski, New Canaan; John M. Gomes, Bridgeport, both of Conn.

[73] Assignee: Pitney Bowes Inc., Stamford, Conn.

[21] Appl. No.: 394,388

[22] Filed: Jul. 1, 1982

[51] Int. Cl.[4] ..... B65H 39/02; G08B 21/00

[52] U.S. Cl. ..... 364/478; 364/138; 364/188; 364/471; 270/56; 270/58; 271/3.1; 271/4; 271/259; 53/500; 53/540

[58] Field of Search ..... 364/471, 478, 479, 138, 364/146, 188; 270/53, 54, 55, 56, 58, 57; 271/258, 259, 3.1, 4; 53/495, 500, 540, 200, 900

[56] References Cited

U.S. PATENT DOCUMENTS

| | | | |
|---|---|---|---|
| 3,559,188 | 1/1971 | Proctor | 364/200 |
| 3,606,728 | 9/1971 | Sather et al. | 270/58 |
| 3,804,005 | 4/1974 | Burger et al. | 270/58 |
| 3,899,165 | 8/1975 | Abram et al. | 270/54 |
| 4,022,455 | 5/1977 | Newsome et al. | 270/54 |
| 4,034,973 | 7/1977 | Hams | 270/58 |
| 4,121,818 | 10/1978 | Riley et al. | 364/478 |
| 4,168,828 | 9/1979 | McLear | 270/54 |
| 4,194,685 | 3/1980 | Hill et al. | 270/58 |
| 4,253,651 | 3/1981 | McInerny et al. | 270/58 |
| 4,310,235 | 1/1982 | Lorenzo et al. | 355/14 R |
| 4,317,203 | 2/1982 | Botte et al. | 364/478 |
| 4,338,671 | 7/1982 | Korytkowski et al. | 364/478 |
| 4,351,025 | 9/1982 | Hall, Jr. | 364/200 |
| 4,365,297 | 12/1982 | Grisham, Jr. | 364/200 |
| 4,388,994 | 6/1983 | Suda et al. | 270/58 |
| 4,395,031 | 7/1983 | Gruber et al. | 270/54 |
| 4,424,559 | 1/1984 | Lorincz et al. | 364/172 |

FOREIGN PATENT DOCUMENTS

| | | | |
|---|---|---|---|
| 0069375 | 1/1983 | | 65/160 |

*Primary Examiner*—Jerry Smith
*Assistant Examiner*—John R. Lastova
*Attorney, Agent, or Firm*—Michael J. DeSha; William D. Soltow, Jr.; Albert W. Scribner

[57] ABSTRACT

A method and associated apparatus for providing a universal multi-station document inserter, including the steps of providing a plurality of feeder stations for feeding documents in response to signals from a central processor, providing each feeder station with a unique address, storing feeder programs in distributed processors associated with the feeder stations which provide instructions to each feeder station for feeding documents, storing a supervisory program in the central processor which is capable of providing address and command signals to the distributed processors of the feeder stations, and interconnecting the central processor and the distributed processors for the transmission of signals so that upon receipt of the proper address and command signals at the feeder stations, the feeder stations will provide certain document feeding functions under control of the central processor in accordance with instructions programmed into the distributed processors associated therewith.

34 Claims, 68 Drawing Figures

Microfiche Appendix Included
(6 Microfiche, 292 Pages)

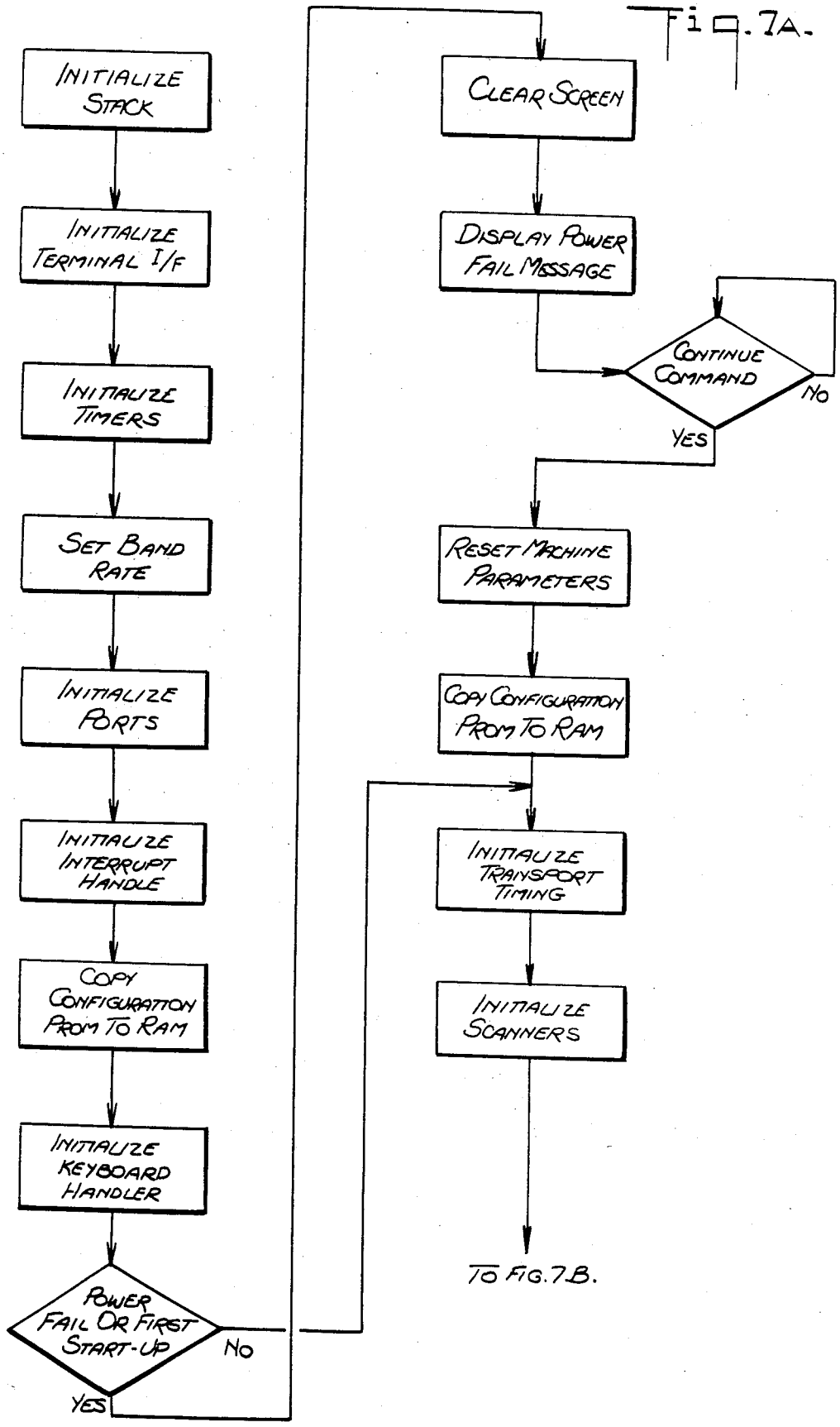
Fig. 7A.
INITIALIZE STACK
INITIALIZE TERMINAL I/F
INITIALIZE TIMERS
SET BAND RATE
INITIALIZE PORTS
INITIALIZE INTERRUPT HANDLE
COPY CONFIGURATION PROM TO RAM
INITIALIZE KEYBOARD HANDLER
POWER FAIL OR FIRST START-UP
NO
YES
CLEAR SCREEN
DISPLAY POWER FAIL MESSAGE
CONTINUE COMMAND
NO
YES
RESET MACHINE PARAMETERS
COPY CONFIGURATION PROM TO RAM
INITIALIZE TRANSPORT TIMING
INITIALIZE SCANNERS
TO FIG. 7B.

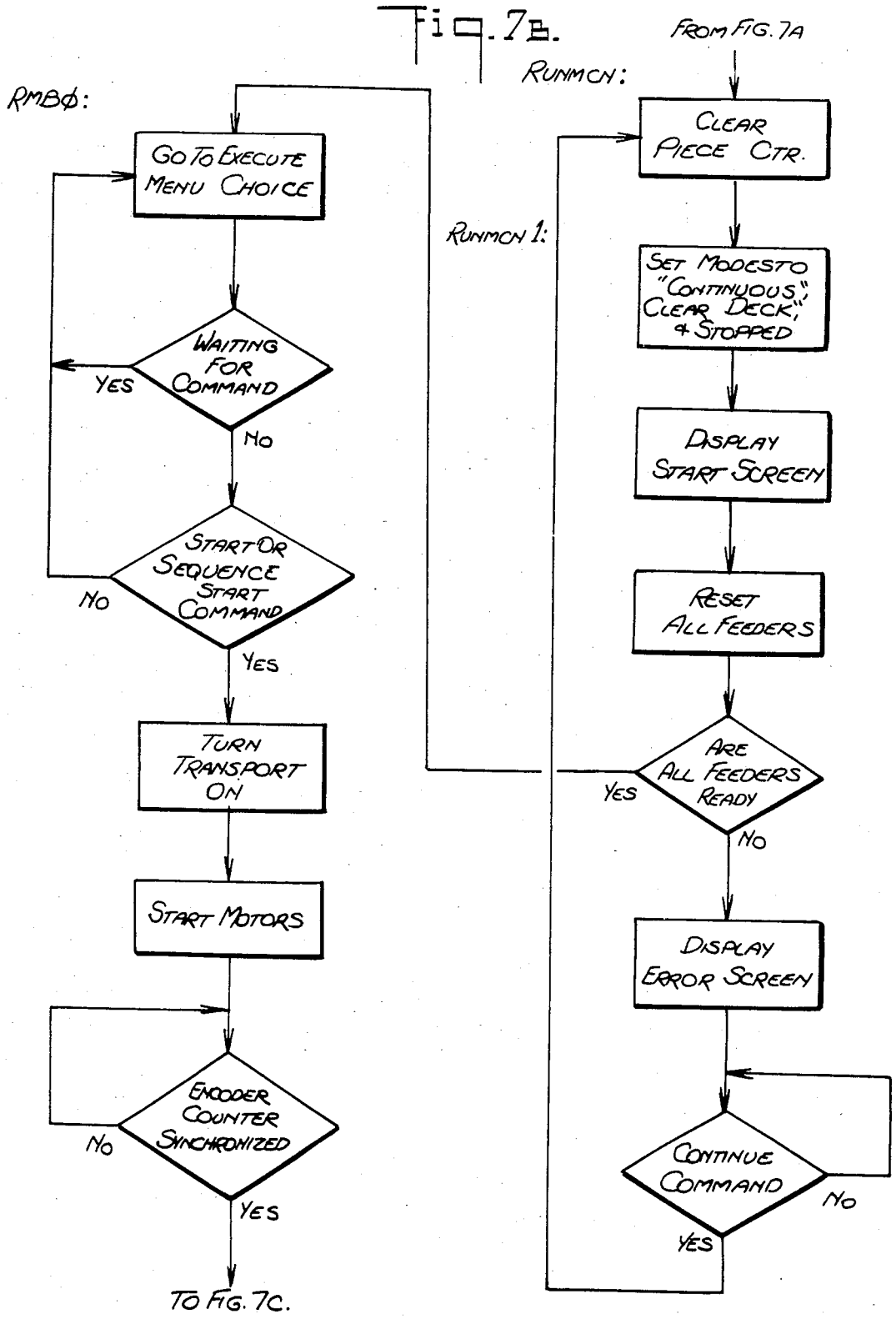
Fig. 7B.
RMBØ:
GO TO EXECUTE MENU CHOICE
WAITING FOR COMMAND
YES
NO
START OR SEQUENCE START COMMAND
NO
YES
TURN TRANSPORT ON
START MOTORS
ENCODER COUNTER SYNCHRONIZED
NO
YES
TO FIG. 7C.
RUNMCN:
FROM FIG. 7A
CLEAR PIECE CTR.
RUNMCN 1:
SET MODESTO "CONTINUOUS", CLEAR DECK, & STOPPED
DISPLAY START SCREEN
RESET ALL FEEDERS
ARE ALL FEEDERS READY
YES
NO
DISPLAY ERROR SCREEN
CONTINUE COMMAND
NO
YES FROM FIG. 7C.
GO TO EXECUTE MAIN MENU
CONTINUE
YES
ANY MORE ERRORS
YES
GO TO RMCØ
NO
NO
LAST CYCLE
NO
START TRANSPORT
YES
RUN 2 MORE CYCLES TO MOVE ENVELOPE TO ACCESSORIES
SHUT DOWN MACHINE
GO TO RUNMCN 1:
ARE ALL FEEDERS "READY"
YES
NO
RMDØ:
PUT TRANSPORT INTO DELAY
TO FIG. 7E.

FROM FIG. 7D.
ANY SCANNER DATA READY
YES
GET DATA
NO
FEEDER COMMAND TIME
YES
SEND COMMAND
NO
ANY HALTING ERRORS
YES
NO
FEEDERS READY
NO
YES
RESTART TRANSPORT
LOAD CONTROL DOC SCAN DATA TO PIECE RECORD
TO FIG. 7F.
ONE-CYCLE HALT
YES
NO
OPERATOR REQUESTED STOP
YES
NO
STOP TRANSPORT
DISPLAY OFFENDING CONDITION
OPERATOR RESET COMMAND
NO
YES
ERROR CLEARED
NO
YES
GOTO RMDØ:

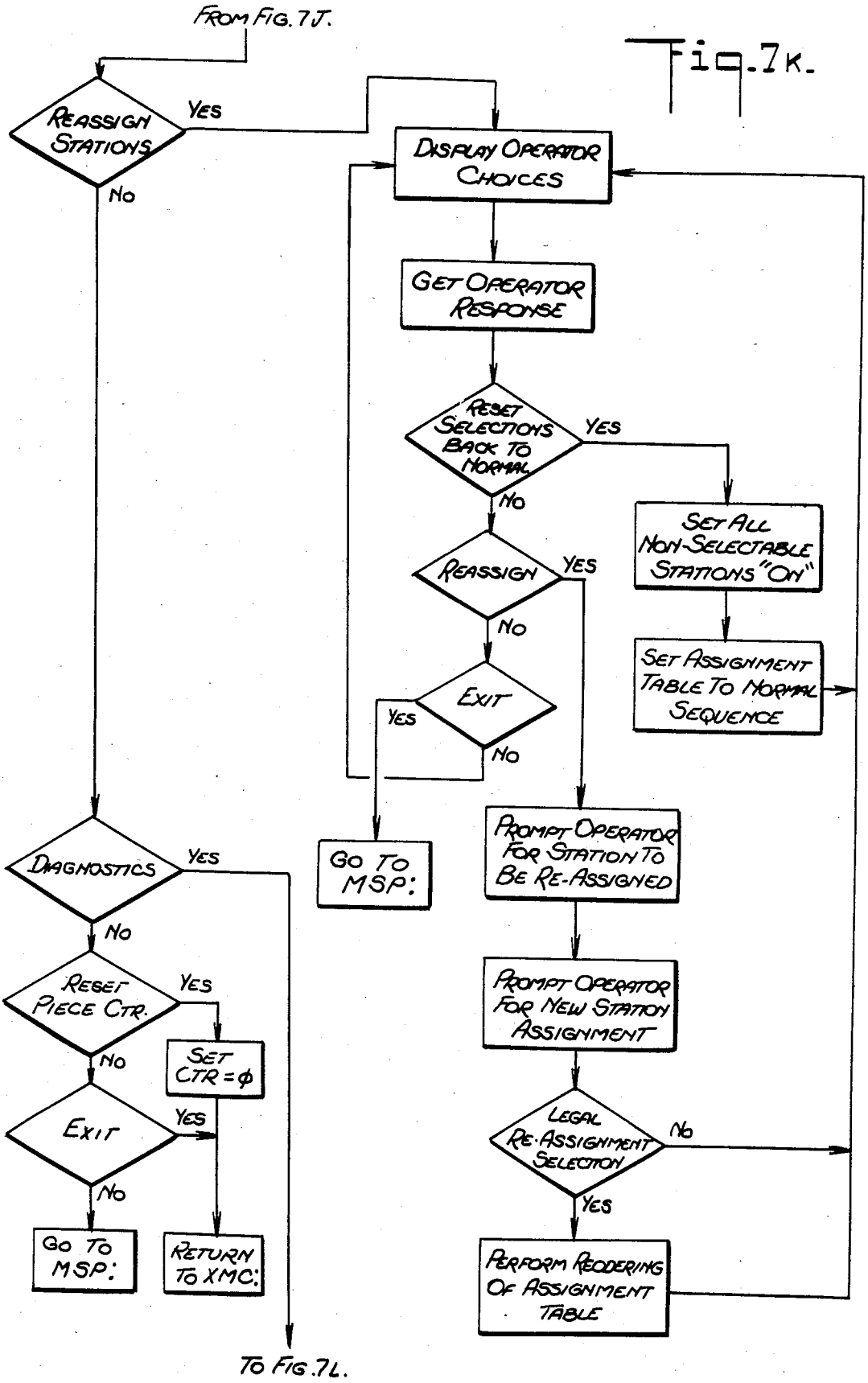
FROM FIG. 7J.
Fig. 7K.
REASSIGN STATIONS
YES
NO
DISPLAY OPERATOR CHOICES
GET OPERATOR RESPONSE
RESET SELECTIONS BACK TO NORMAL
YES
NO
SET ALL NON-SELECTABLE STATIONS "ON"
SET ASSIGNMENT TABLE TO NORMAL SEQUENCE
REASSIGN
YES
NO
EXIT
YES
NO
GO TO MSP:
PROMPT OPERATOR FOR STATION TO BE RE-ASSIGNED
PROMPT OPERATOR FOR NEW STATION ASSIGNMENT
LEGAL RE-ASSIGNMENT SELECTION
NO
YES
PERFORM REORDERING OF ASSIGNMENT TABLE
DIAGNOSTICS
YES
NO
RESET PIECE CTR.
YES
NO
SET CTR = ϕ
EXIT
YES
NO
GO TO MSP:
RETURN TO XMC:
TO FIG. 7L.

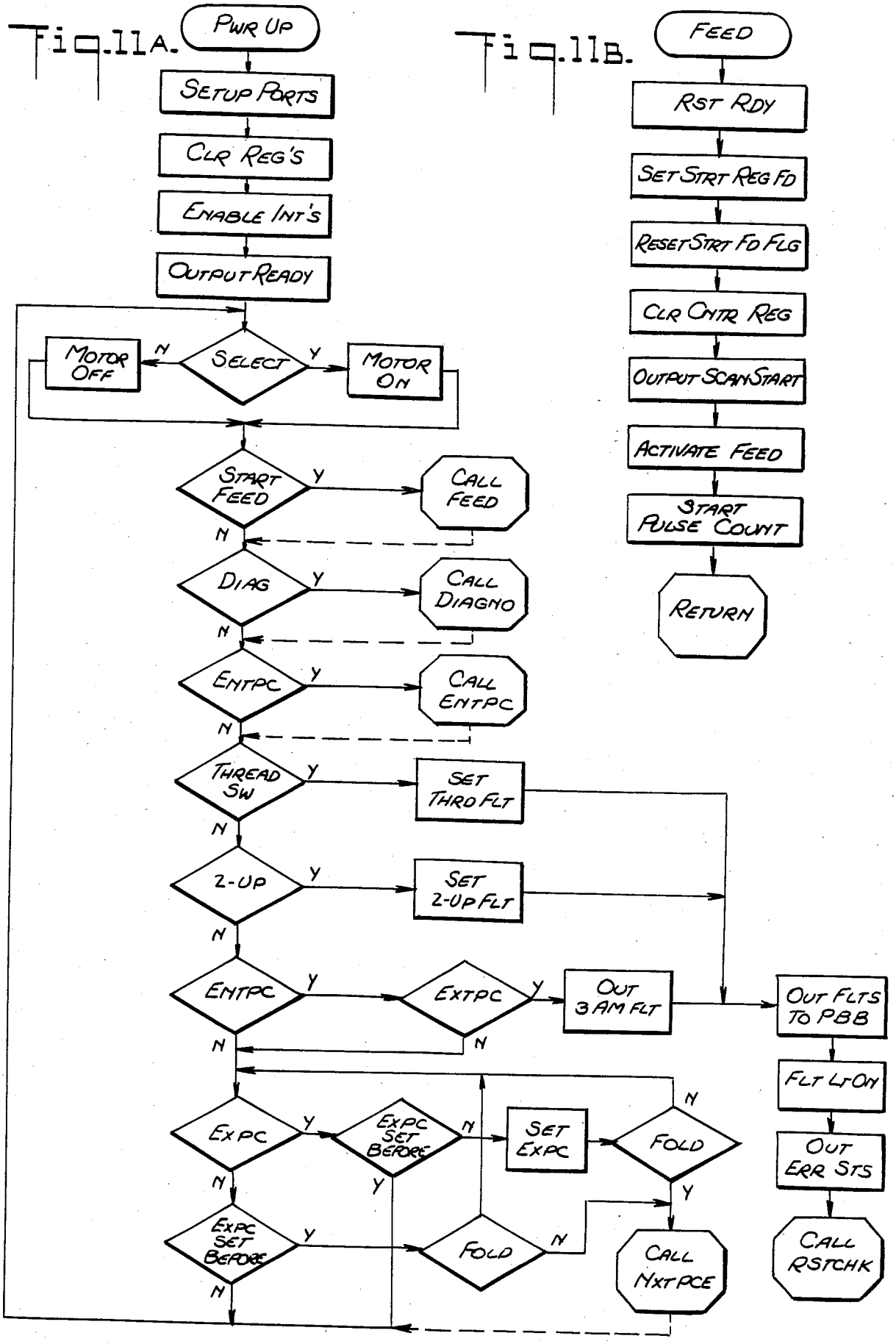
Fig.11A.
PWR UP
SETUP PORTS
CLR REG'S
ENABLE INT'S
OUTPUT READY
SELECT
N
MOTOR OFF
Y
MOTOR ON
START FEED
CALL FEED
DIAG
CALL DIAGNO
ENTPC
CALL ENTPC
THREAD SW
SET THRD FLT
2-UP
SET 2-UP FLT
ENTPC
EXTPC
OUT 3 AM FLT
OUT FLTS TO PBB
FLT LT ON
OUT ERR STS
CALL RSTCHK
EXPC
EXPC SET BEFORE
SET EXPC
FOLD
CALL NXT PCE
Fig.11B.
FEED
RST RDY
SET STRT REG FD
RESET STRT FD FLG
CLR CNTR REG
OUTPUT SCAN START
ACTIVATE FEED
START PULSE COUNT
RETURN 150
PWR.-UP INITIALIZATION
DSCAN:
COMMAND
NO
YES
RUN:
SCAN
NEWDIY
CKENCO
SINIT
RESET BLC/204 I/F (INPUT WORD INTERRUPT)
IBFINT:
COMMAND
SET COMMAND REGISTER
DATA
CONVERT & STORE IN TABLE
RETURN :RINIT
INITIALIZE POINTERS
CLEAR REGISTERS
SET STATUS = SETUP 1
INIT PORT 4+5
ENABLE INTERRUPT
GO TO RUN

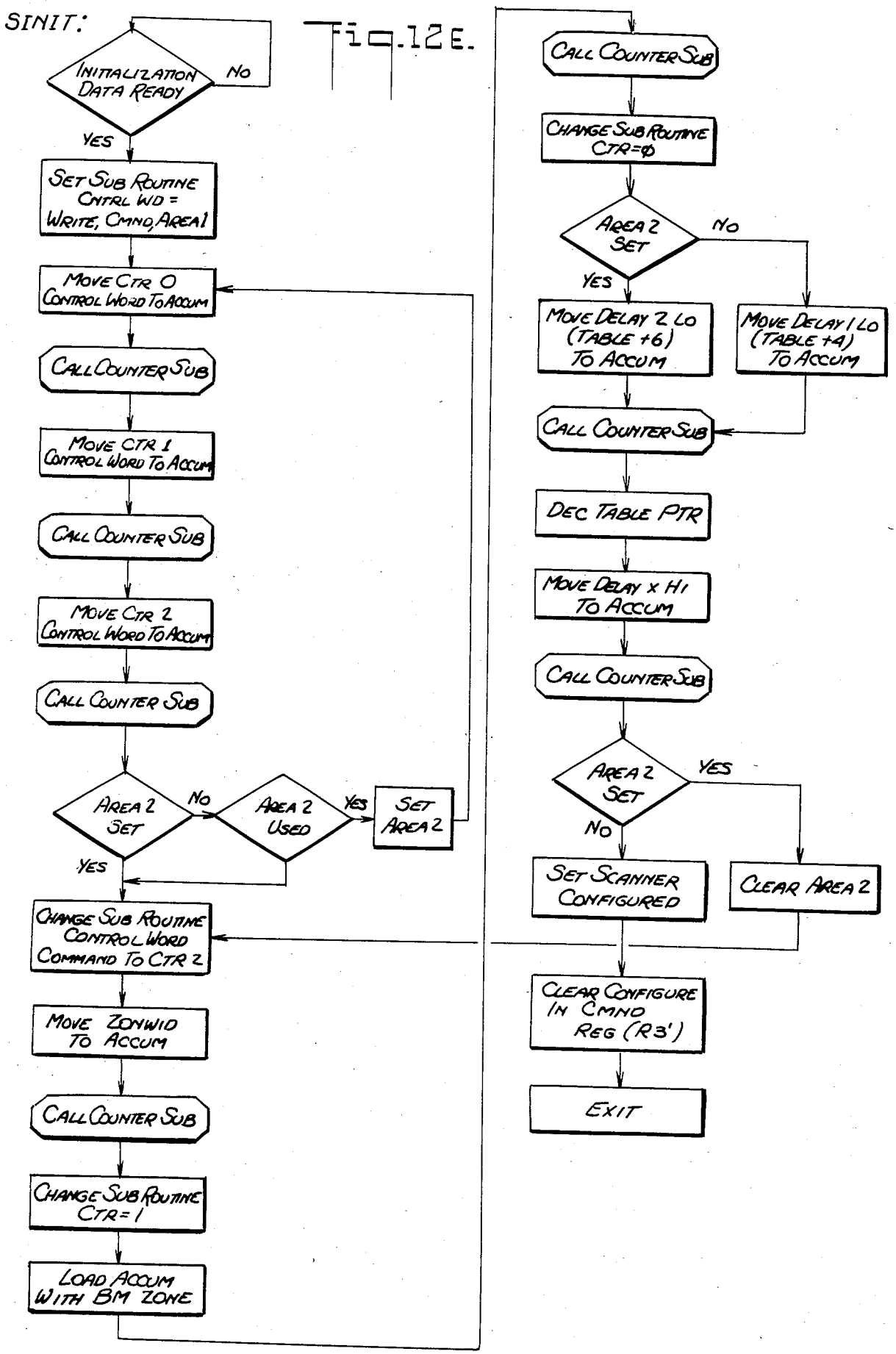
SINIT:
Fig. 12E.
INITIALIZATION DATA READY
NO
YES
SET SUB ROUTINE CNTRL WD = WRITE, CMND, AREA1
MOVE CTR 0 CONTROL WORD TO ACCUM
CALL COUNTER SUB
MOVE CTR 1 CONTROL WORD TO ACCUM
CALL COUNTER SUB
MOVE CTR 2 CONTROL WORD TO ACCUM
CALL COUNTER SUB
AREA 2 SET
NO
AREA 2 USED
YES
SET AREA 2
YES
CHANGE SUB ROUTINE CONTROL WORD COMMAND TO CTR 2
MOVE ZONWID TO ACCUM
CALL COUNTER SUB
CHANGE SUB ROUTINE CTR=1
LOAD ACCUM WITH BM ZONE
CALL COUNTER SUB
CHANGE SUB ROUTINE CTR=Φ
AREA 2 SET
NO
YES
MOVE DELAY 2 LO (TABLE +6) TO ACCUM
MOVE DELAY 1 LO (TABLE +4) TO ACCUM
CALL COUNTER SUB
DEC TABLE PTR
MOVE DELAY x HI TO ACCUM
CALL COUNTER SUB
AREA 2 SET
YES
NO
SET SCANNER CONFIGURED
CLEAR AREA 2
CLEAR CONFIGURE IN CMND REG (R3')
EXIT

SETUP 1:

SETUP 2:

UNIVERSAL MULTI-STATION DOCUMENT INSERTER

MICROFICHE APPENDIX

The supervisory program for the central processor is set forth in the accompanying Microfiche Appendix including 3 microfiche having a total of 173 frames.

The program for configuring the configuration PROM of the central processor is set forth in the accompanying Microfiche Appendix in PASCAL language including 1 microfiche having a total of 56 frames.

The programs for a high ratio feeder, high speed feeder, envelope feeder, and burster-folder are set forth in the accompanying Microfiche Appendix including 1 microfiche having a total of 36 frames.

The program for the scanner interface circuits is set forth in the accompanying Microfiche Appendix including 1 microfiche having a total of 27 frames.

BACKGROUND OF THE INVENTION

The present invention relates to document inserters, and more particularly to multi-station document inserters.

Known multi-station document inserters generally employ discrete elements and are manufactured and wired for each specific customer application. Each such document inserter is manufactured as virtually a one of a kind machine with the attendant costs associated therewith. Such apparatus typically require many weeks to design and manufacture, require substantial operator training time to operate, and are difficult and time consuming to service. One such multi-station document inserter is disclosed in U.S. Pat. No. 3,606,728 issued on Sept. 21, 1971, to Sather et al., and assigned to Bell and Howell Company, Phillipsburg, New Jersey.

SUMMARY OF THE INVENTION

It is an object of the present invention to provide a universal multi-station document inserter.

It is a further object of the present invention to provide a universal multi-station document inserter which may be readily adapted to a particular customer application without reprogramming.

It is a further object of the present invention to provide a modularly expandable multi-station document inserter.

It is a still further object of the present invention to provide a multi-station document inserter having automatic start up and shut down sequences to ensure proper document collation.

It is a still further object of the present invention to provide a multi-station document inserter with a diagnostic mode for access by a service technician.

It is a still further object of the present invention to provide a multi-station document inserter having a centralized control and display.

It is a still further object of the present invention to provide a multi-station document inserter which is user friendly.

It is a still further object of the present invention to provide a multi-station document inserter which is less dependant upon operator skill than known document inserters.

It is a still further object of the present invention to provide a multi-station document inserter which facilitates servicing.

It is a still further object of the present invention to provide a multi-station document inserter having a central control display which visually displays and describes inserter faults in human readable form.

It is a still further object of the present invention to provide a multi-station document inserter which permits reconfiguration by the operator.

It is a still further object of the present invention to provide a multi-station document inserter whose configuration and functions may be readily changed in the field.

It is a still further object of the present invention to provide a standardized reconfigurable multi-station document inserter which facilitates manufacture.

Briefly, in accordance with the present invention, a method and associated apparatus is disclosed for providing a universal multi-station document inserter, including the steps of providing a plurality of feeder stations for feeding documents in response to signals from a central processor, providing each feeder station with a unique address, storing feeder programs in distributed processors associated with the feeder stations which provide instructions to each feeder station for feeding documents storing a supervisory program in the central processor which is capable of providing address and command signals to the distributed processors of the feeder stations, and interconnecting the central processor and the distributed processors for the transmission of signals so that upon receipt of the proper address and command signals at the feeder stations, the feeder stations will undergo certain document feeding functions under control of the central processor in accordance with instructions programmed into the distributed processors associated therewith.

Other objects, aspects and advantages of the present invention will be apparent from the detailed description considered in conjunction with the preferred embodiment of the invention illustrated in the drawings, as follows:

BRIEF DESCRIPTION OF THE DRAWINGS

FIGS. 11*a*–11*f* are flow charts of the feeder program for use in a burster-folder; and FIGS. 12*a*–12*h*, 12*j*–12*n*, 12*p*–12*r* are flow charts of the scanner program for use in the scanner interface circuits.

DETAILED DESCRIPTION

Figure 1:
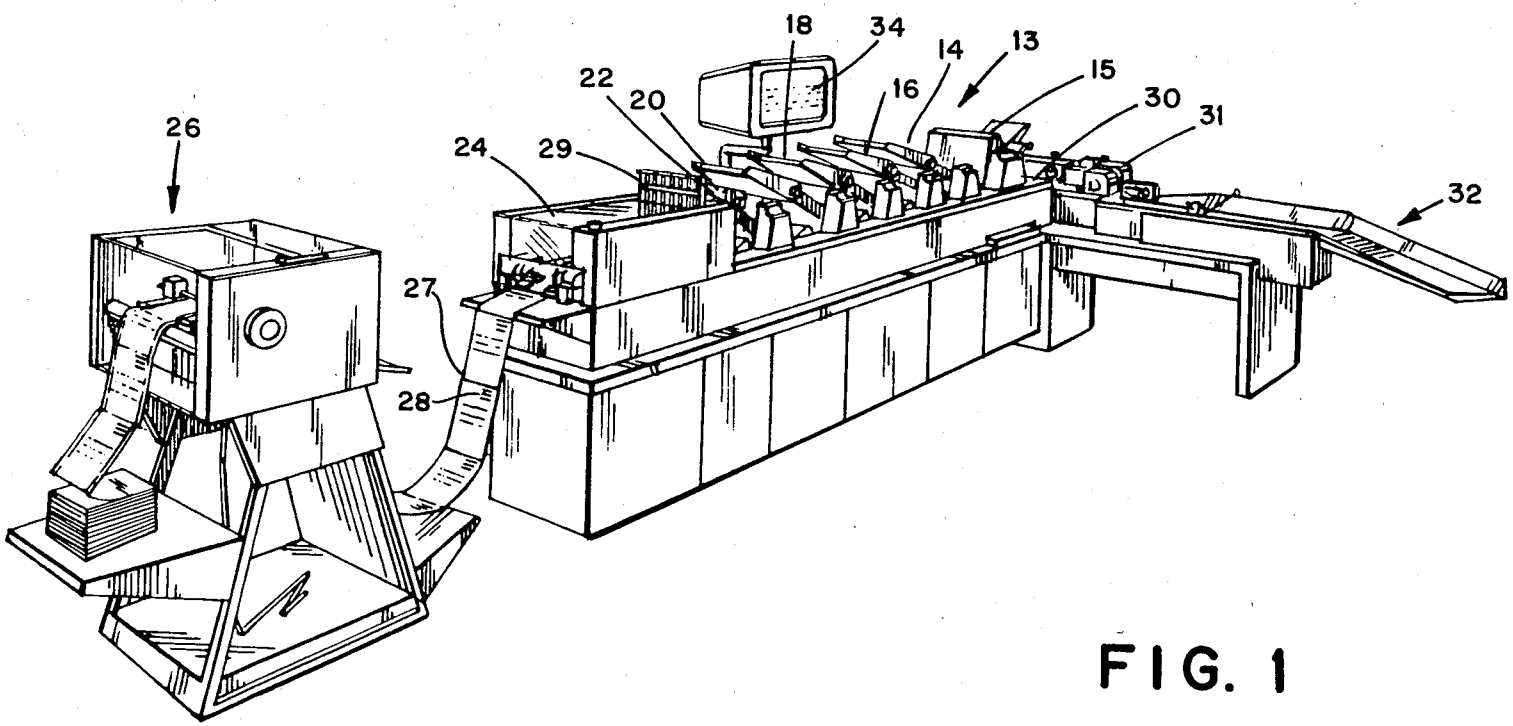
FIG. 1 is a perspective view of a multi-station document inserter in accordance with the present invention.

Referring to FIG. 1, a document inserter in accordance with the present invention is generally illustrated at 13. The document inserter 13 includes a plurality of serially arranged modules including an envelope feeder station or module 15 and six document feeder station or modules, including five feeder modules designated 14, 16, 18, 20, 22, and burster-folder station or module 24. A computer generated forms feeder 26 feeds continuous form control documents 27 having coded marks 28 thereon to the burster-folder 24 for separating and folding. The coded marks 28 on the control documents 27 are sensed by a control scanner 29. Thereafter, the serially arranged feeder stations 22, 20, 18, 16 and 14 sequentially feed the necessary documents onto the transport deck 30 at each station as the control document 27 arrives at the respective station to form a precisely collated stack of documents which is transported to the envelope feeder 15. Preferably, the transport deck 30 includes a ramp feed so that the control document always remains on the top of the stack of advancing documents. Such a transport deck is used in the INSERTAMAX III Mail Inserter available from Pitney Bowes, Inc. of Stamford, Conn. However, it should be understood that the transport deck may be of other types, such as that used in the INSERTAMAX II Mail Inserter available from Pitney Bowes, Inc., of Stamford, Conn. or the transport deck disclosed in U.S. Pat. No. 3,934,867, issued on Jan. 27, 1976, to Frank A. Oeschger, Jr. and assigned to Pitney Bowes, Inc.

The collated stack of documents is inserted in a envelope at the envelope station 15. The necessary postage is provided and the envelope is sealed by a postage meter 31, such as Pitney Bowes, Inc. Model 4255 Postage Meter. As desired, the completed envelopes may then be transported to a single or multi-level stacker 32. Details regarding the components of the feeder modules including the arrangement of the clutches, brakes, motors, and encoder therein may be obtained from U.S. Pat. No. 3,935,429, issued on Jan. 27, 1976, to George N. Braneky et al., entitled, PROCESS AND APPARATUS FOR CONTROLLING DOCUMENT FEEDING MACHINES FROM INDICIA CONTAINED ON A DOCUMENT FED THEREFROM and assigned to Pitney Bowes, Inc. of Stamford, Connecticut, the disclosure of which is incorporated herein by reference, and from the INSERTAMAX III Mail Inserter previously referenced.

The inserter 13 includes a central control display 34 which displays status messages and fault signals in human readable form and further enables the operator to control and change the configuration of the inserter 13 via finger touch switches, as will be described in more detail in copending patent application Ser. No. 394,386 filed on July 1, 1982 in the names of Peter N. Piotroski and John M. Gomes, entitled, USER FRIENDLY CENTRAL CONTROL DISPLAY FOR A MULTI-STATION DOCUMENT INSERTER.

Figures 2, 2A:
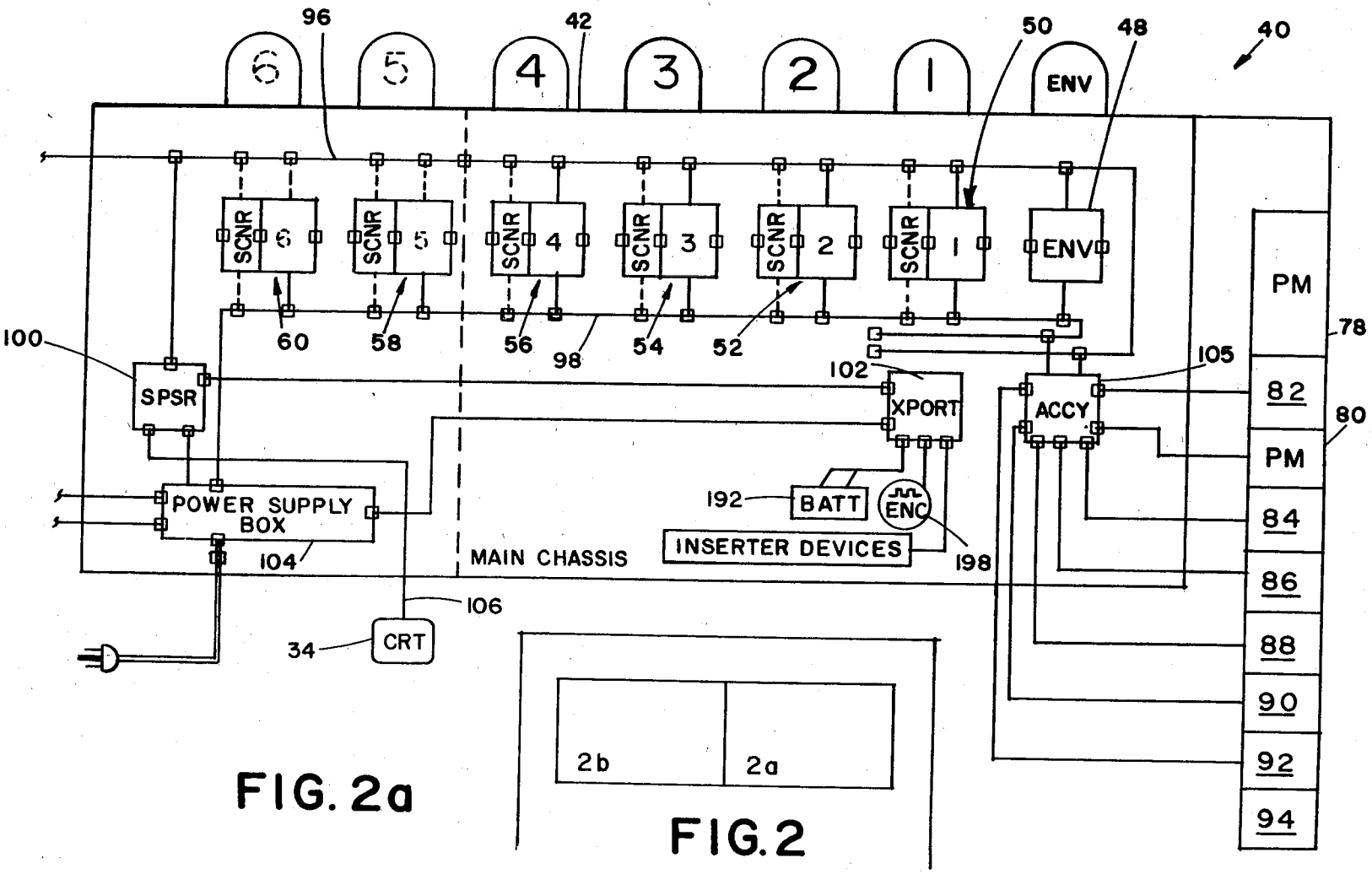
FIGS. 2, 2*a*–2*b* are schematic diagrams of the layout of the feeder modules and circuits of the multi-station document inserter.
Figure 2B:
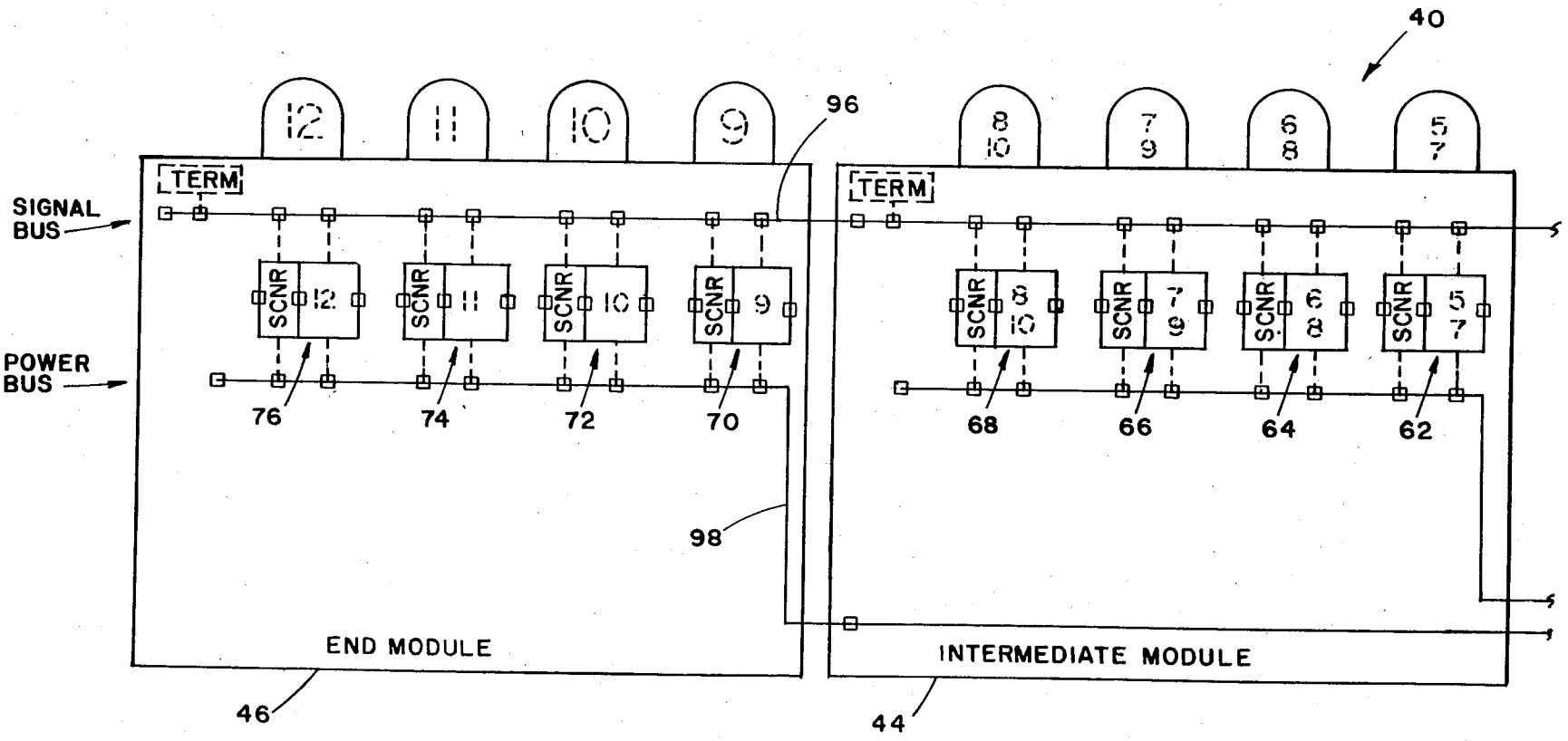

Referring to FIG. 2, the layout of the feeder modules and circuits of the document inserter 13 is illustrated. This document inserter is designated 40. It is a similar to the document inserter shown in FIG. 1, but shows the modular arrangement of feeder modules having a varying number of feeder modules between 4 and 12, as desired. A main chassis 42 includes 4 or 6 document feeder stations, excluding the envelope feeder 48. An intermediate module 44 includes 4 document feeder stations and an end module 46 also includes 4 feeder stations.

The electronic circuits of the multi-station document inserter 40 are arranged such that the intermediate module 44 may be readily electrically coupled to the main chassis 42 which includes 4 or 6 feeder stations as desired. The end module 46 may also be readily electrically coupled to the intermediate module 44 as desired. Thus, it is apparent from FIG. 2, that the inserter 40 may include 4,6,8,10, or 12 document feeder stations, excluding the envelope feeder station 48, in accordance with customer requirements. The feeder stations 1–12 are designated 50–76 beginning with the feeder station 50 closest to the envelope feeder 48 and ending with the most remote feeder station 76, which is the control document feeder station.

All the document feeder stations 50, 52, 54, 56, 58, 60, 62, 64, 66, 68, 70, 74, and 76 are arranged in line to serially feed documents therefrom to form collated stacks with the coded documents 27 (see FIG. 1) for insertion into envelopes at envelope station 48. After being placed in an envelope and transported to an accessory station, the envelope is imprinted with the proper postage and sealed by a postage meter 78. A second postage meter 80 may be provided and used for a Postage Break if the documents in the envelope exceed a predetermined number indicating additional postage is necessary. Additional accessories such as multi-level power stackers for rejection of incomplete collations and for sorting various completed collation may be provided, e.g., by levels 82, 84, 86, 88, 90, 92, and 94.

The feeder stations 48 through 76 are arranged in parallel between a signal bus 96 and a power bus 98 so that each of the feeder stations 48 through 76 has a unique address code in the signal bus 96. Further, the feeder station 76 most remote from the envelope feeder station 48, which is normally but not necessarily a burster/folder, includes a control scanner interface circuit which will be described in more detail with reference to FIG. 5. Advantageously, any scanning multi-document feeder may be used in this position to feed a control document. The other feeder stations will also typically include a scanner interface circuit to provide additional control. Further, each feeder module 48–76 will include a feeder interface circuit which will be described in more detail with reference to FIG. 4. Advantageously, the scanner and feeder interface circuits for each feeder module are physically the same. This is highly advantageous in providing a universal multi-station document inserter with intelligence present at each feeder/scanner module capable of carrying out certain feeding/scanning operations in response to a central control command.

Further, as seen in FIG. 2, a supervisory control circuit 100 is electrically coupled to the signal bus 96 and to a transport interface circuit 102. A power supply 104 is coupled to the power bus 98, the supervisory control circuit 100 and to the transport interface circuit 102. The feeder interface circuits and scanner interface circuits in the feeder modules 50–76 are arranged in parallel between the signal bus 96 and the power bus 98. Also coupled to the signal bus 96 and power bus 98 is an accessory interface circuit 105. In response to signals from the supervisory control circuit 100, the accessory interface circuit 105 provides output signals to various accessories such as postage meters 78 and 80, and the multi-level power stackers 82, 84–94. Coupled to the supervisory control circuit 100 is the central control display 34, see also FIG. 1.

The supervisory control circuit or central microprocessor 100 includes a single board computer, such as National BLC 20-4 available from National Semiconductor Corporation, or other similar single board computer available from Intel Corporation, and an auxiliary memory board such as National BLC 104 available from National Semiconductor Corporation, or other similar auxiliary memory board. The single board microcomputer and auxiliary memory board include plug in sockets for receiving PROMS. A supervisory program capable of running all the devices of the inserter 40 and performing all defined control functions is stored in the plug-in PROMS, which are plugged into the single board microcomputer and the auxiliary memory board. The program listing for the supervisory program is set forth in the accompanying Microficher Appendix. An additional PROM, a configuration PROM, includes a data table which specifies a particular inserter configuration and the functions to be performed for that configuration by the executable routines in the supervisory program. Suitable PROMS are Type 2716, available from National Semiconductor Corporation. The details of generating a configuration PROM for use in the universal multi-station document inserter of the present invention are found in copending patent application Ser. No. 394,385, filed on July 1, 1982 in the name of Peter N. Piotroski and John M. Gomes entitled, METHOD AND APPARATUS FOR CUSTOMIZING A MULTI-STATION DOCUMENT INSERTER.

By using the foregoing format for the supervisory control circuit or central microprocessor 100, there is no need to change any of the executable programs. Thus, the same supervisory program may be incorporated into the supervisory control circuit 100 of each multi-station document inserter. The configuration PROM contains no executable programs, but only a table of data which specifies the particular routines to be executed to provide the desired functions for a particular document inserter. The tables of data in the configuration PROM are provided from customer responses to a series of questions regarding the inserter configuration and the functions to be performed thereby. The program for the configuration PROM is set forth in the accompanying Microfiche Appendix in PASCAL language. During operation, the software of the supervisory program will access the data tables in the configuration PROM to determine which routines of the supervisory program are to be executed.

To facilitate understanding of the operation of the software in the central microprocessor 100, as set forth in the flow chart 101 in FIG. 7 and the supervisory program and configuration PROM program set forth in the accompanying Microfiche Appendix, the movement of a control document from a burster/folder to the power stacker will be described. However, we will confine our description to a four feeder station document inserter 50,52,54 and 56 with envelope feeder 48, see the main chassis in FIG. 2., and with feeder station 56 being a burster/folder, such as in FIG. 1. Further it is assumed that feeder stations 50 and 52 are high speed feeders and feeder station 54 is a standard feeder. During power up of the document inserter 40, the data table in the configuration PROM is copied into the RAM of the central processor 100. The software in the central microprocessor 100 initially ascertains from the RAM what types of document codes to expect and what their values will be. In this respect, the configuration PROM includes a data table subdivided into blocks of data or space allocated therefore for the maximum number of feeder station or module locations. Thus, the blocks of data in the data table will map the feeder module locations to their position along the document transport path. The software of the supervisory program first starts at the beginning of the block of data associated with feeder station 1, and reads through the data block to see what type of feeder is being used and what type of functions it is to perform. It then proceeds to the next data block associated with feeder station 2 and reads through the data block to see what type of feeder is being used and what type of functions it is to perform. The software continues on in this fashion until it reaches a special End of Table Code for the particular inserter configuration.

For example, the configuration PROM will include a yes/no flag for each feature, such as selective feeding, match verification, selective metering, etc. Associated with each of these features will be a set of data values corresponding to the information necessary to implement the task. In this case, only the count verification and selective feeding flags are on, and all others are off. The address codes are predetermined. The selective feeding flag will include these data values as well as the data values of the bar codes which control the selective feeding feature. There are four possible values: 1. No Feed. 2. Feed from feeder one only. 3. Feed from feeder two only. 4. Feed from both feeders.

At the end of the cycle which moved the control document through the burster/folder 56 the codes on the document will have been read by the scanner interface circuit and made available to the central microprocessor 100. The codes will be stored by the central microprocessor 100 to be used in a later cycle to select the appropriate feeder (s) as described by the code. Along with the selective feeding code is the value of the count of the number of documents to be fed by the selected feeder.

During the next inserter cycle, the control document is moved along the transport deck to the next station of the inserter, and the internal document table in the RAM is updated to reflect that the control document is in the next position. The RAM is then checked to see what feeder module is in that position. Since it is a standard feeder 54, the only Command from the supervisory control circuit 100 is feed. The standard feeder 54 then feeds a single document. At the end of this feed cycle, the feeder status is checked for paper jams or other faults. If there are no faults, another cycle begins and the control document is moved to the high speed feeder 52.

When the document moves on to the next position, the RAM indicates that it is a high speed feeder 52, and provides its address code. The central microprocessor 100 then checks the document table to see what code was read from the control document feeder scanner and checks it against the code definitions in the RAM. Assuming that the code was only feed feeder one, a feed Command is not issued from the central microprocessor 100 to feeder two 52. Another cycle takes place moving the document to the next high speed feeder 50. The code stored in the central processor 100 now issues a feed command along with the desired number of documents to be fed from feeder 50. When finished, the central microprocessor 100 issues a Send Count Command to the feeder 50. The feeder 50 will return a count of the documents it has fed to the central microprocessor 100. The central microprocessor 100 will then check this count against the count for the document stored in the document data table. If they match, no action is taken but if there is a fault it will be recorded in the document data table in the RAM. The configuration PROM and RAM also contain fault handling codes which the microprocessor 100 will use to determine what to do with the document.

During the next cycle the transport deck moves the stack of collated documents, including the coded document, to the envelope feeder 48 and the stack of collated documents is inserted into an envelope. During the next cycle the transport deck moves the envelope to the postage meter 78 where the necessary postage is applied and the envelope is sealed. During the final cycle the sealed envelope is feed to the stackers 82, 86, 88, 90, 92, or 94.

The aforementioned actions occur for the control document at each feeder module every cycle. For example, in a twelve station inserter, references to the RAM, a decision based upon those references, and an update of the document table in the RAM is made for each of the twelve stations every cycle. Specifically, as the supervisory program progresses from feeder station to feeder station, it reads the data table in the RAM, which is a reflection of the configuration PROM, except insofar as the inserter configuration may have been reconfigured by the operator as described more fully below and in the aforementioned patent application Ser. No. 394,385 of Peter N. Piotroski et al.

The supervisory program resident in the central microprocessor 100 describes a maximum inserter configuration. The actual configuration of the inserter 40 is a subset of the maximum configuration. In implementing the supervisory program, the maximum inserter configuration is translated into software routines, each of which implements a small portion of the maximum inserter configuration.

Interactive communication is maintained between the central microprocessor 100 and the central control display 34 through an RS232C standard communication line 106. During normal inserter operation, or in response to operator actuation of the central control display 34, the central microprocessor 100 accesses all of the feeder modules or stations, including high ratio document feeders, high speed document feeders, standard document feeders, inserters, burster-folders, folder-feeders, divider page extractors, envelope deflectors, envelope markers, and the accessory interface circuit 105 for postage meters and/or single of multi-level stackers. Illustratively, the programs for a high ratio feeder and a high speed feeder are set forth in the accompanying Microfiche Appendix.

Initially, the central microprocessor 100 communicates with the control scanner interface circuit of the burster-folder 24 to supply the proper dash codes to the scanner interface circuit to program the same in accordance with the program for the scanner interface circuit set forth in the accompanying Microfiche Appendix. Thereafter, the scanner interface circuits associated with the feeder stations or modules scan the documents being fed thereby.

Figure 3:
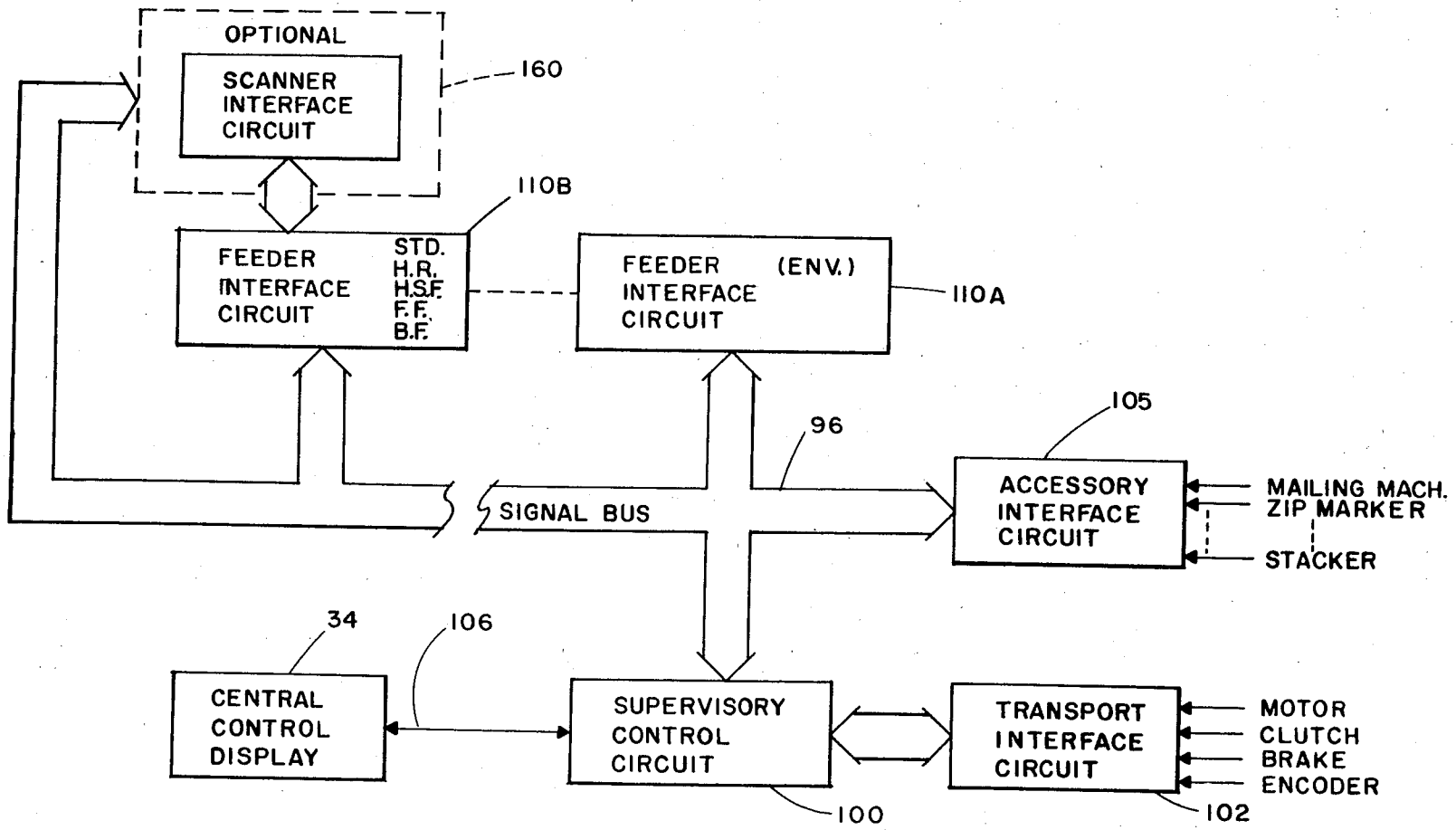
FIG. 3 is a block diagram of the electronic circuits used in the multi-station document inserter.

Referring to FIG. 3 a block diagram of the interconnection of the interface circuits for the multi-station document inserter 40 is illustrated. The supervisory control circuit or central microprocessor 100 interacts directly with transport interface circuit 102 to activate the transport motor, clutch and brake, as well as receive pulses from the encoder 198 see FIG. 2, for control of the transport deck 30, see FIG. 1. Interactive communication between the supervisory control circuit 100 and the central control display 34 is provided over the standard communication line 106. Advantageously, the central control display 34 may be a finger touch display switch, such as Fluke Model 1780A InfoTouch Display. Communication between the supervisory control circuit 100 and the feeder interface circuit 110B (documents) and envelope interface circuit 110A (envelopes) and accessory interface circuit 105 is maintained over the signal bus 96. Additionally, the supervisory control circuit 100 communicates with the scanner interface circuits 160 through the signal bus 96. The scanner interface circuit 160 also communicates with the feeder interface circuit 110B. The scanner interface circuit 160 will be described in more detail with reference to FIG. 5.

Figure 4:
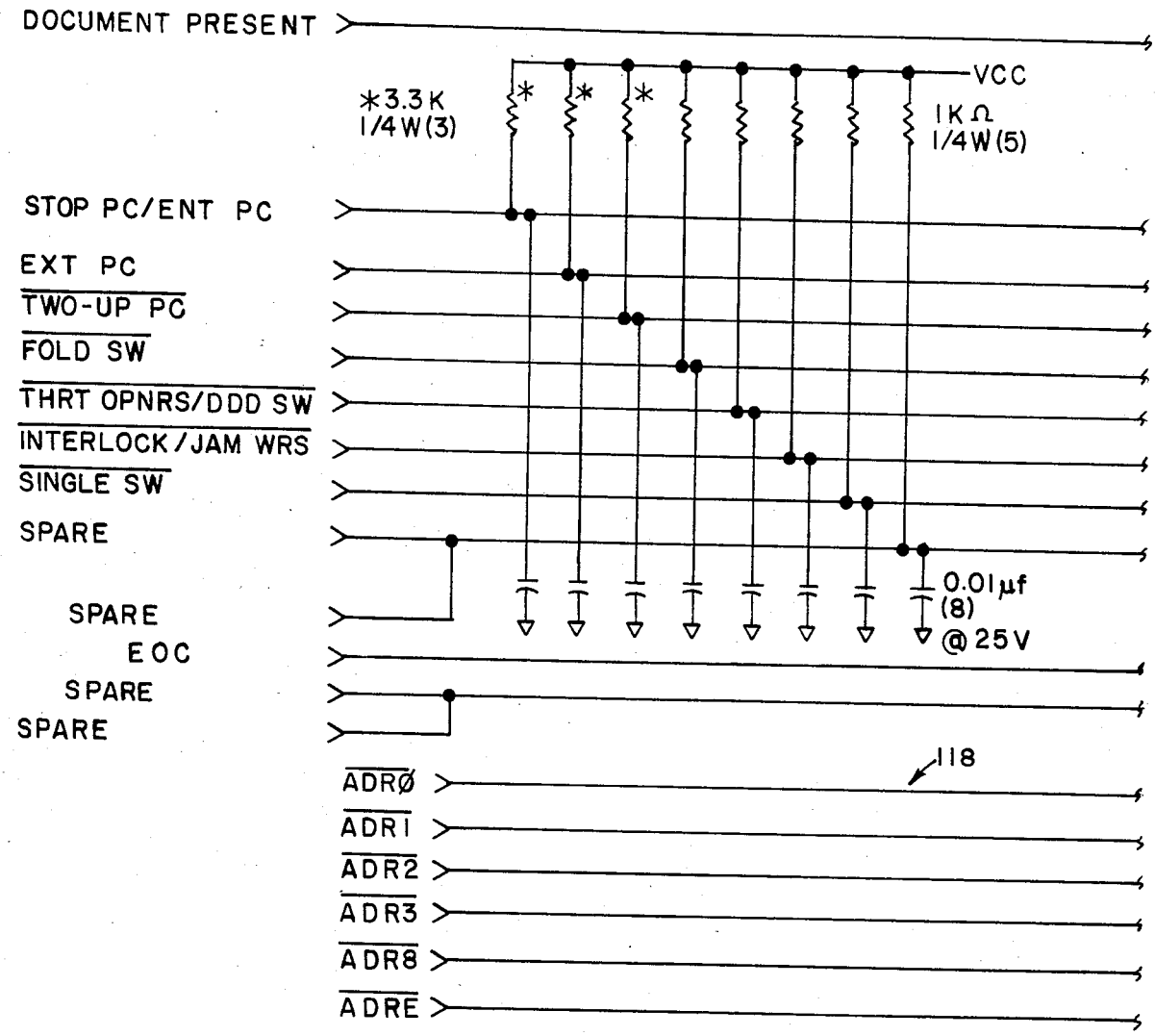
FIGS. 4, 4*a*–4*c* are schematic diagrams of the feeder interface circuit.
Figure 4:
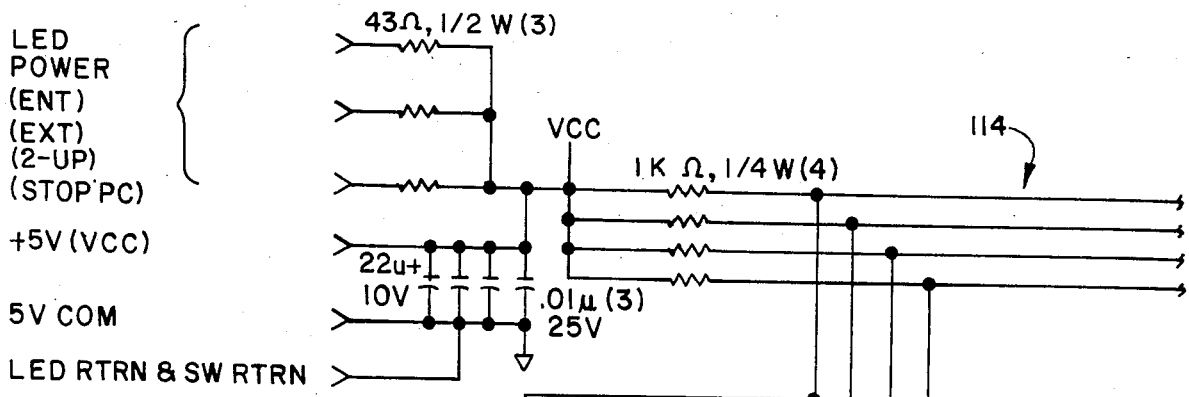
Figure 4:
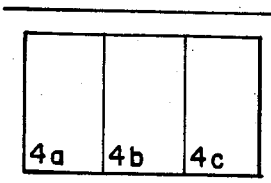
Figure 4A:
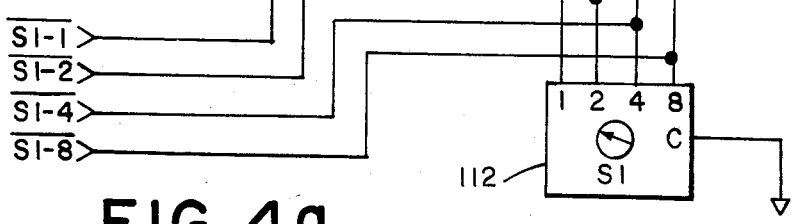
Figure 4B:
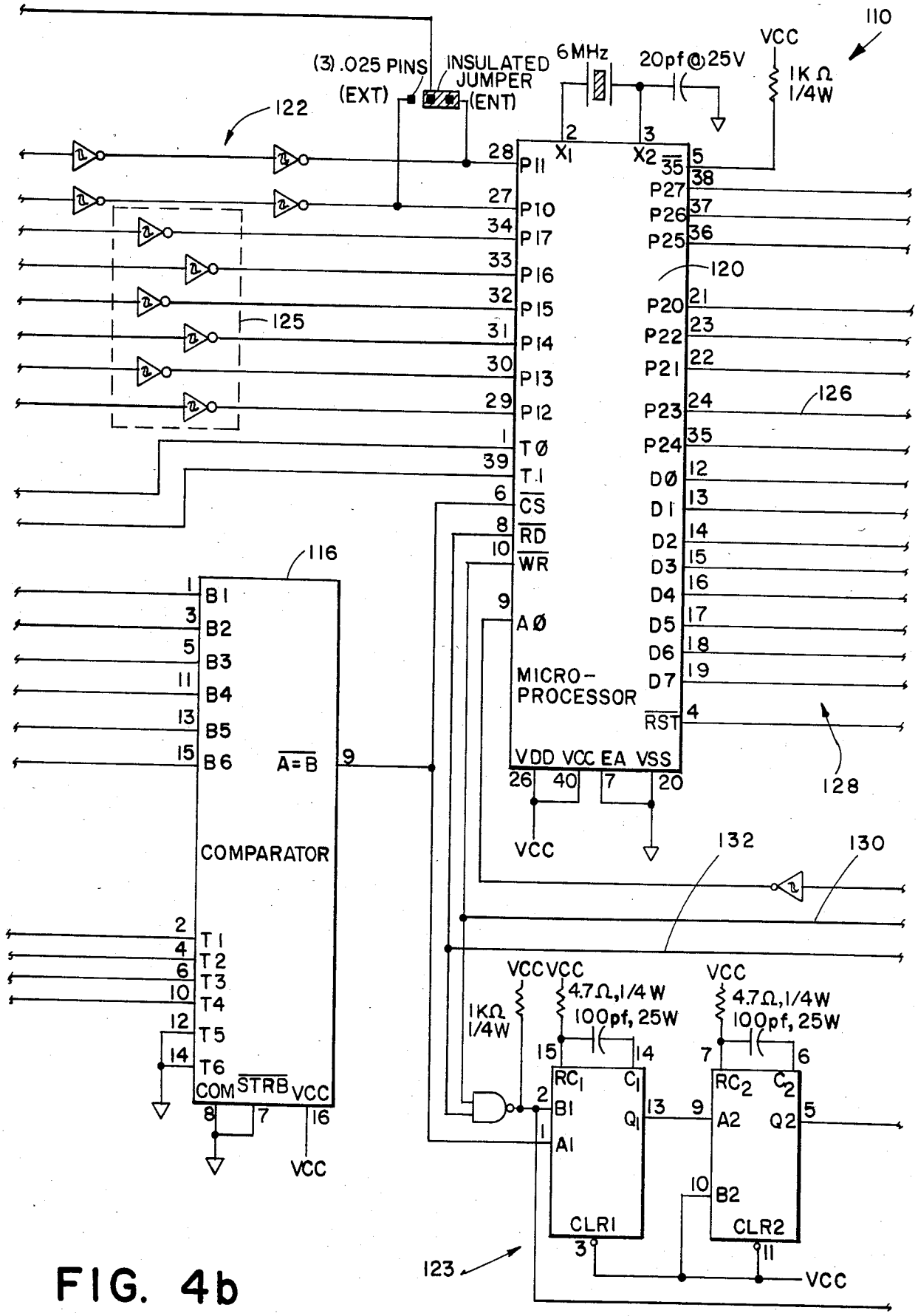
Figure 4C:
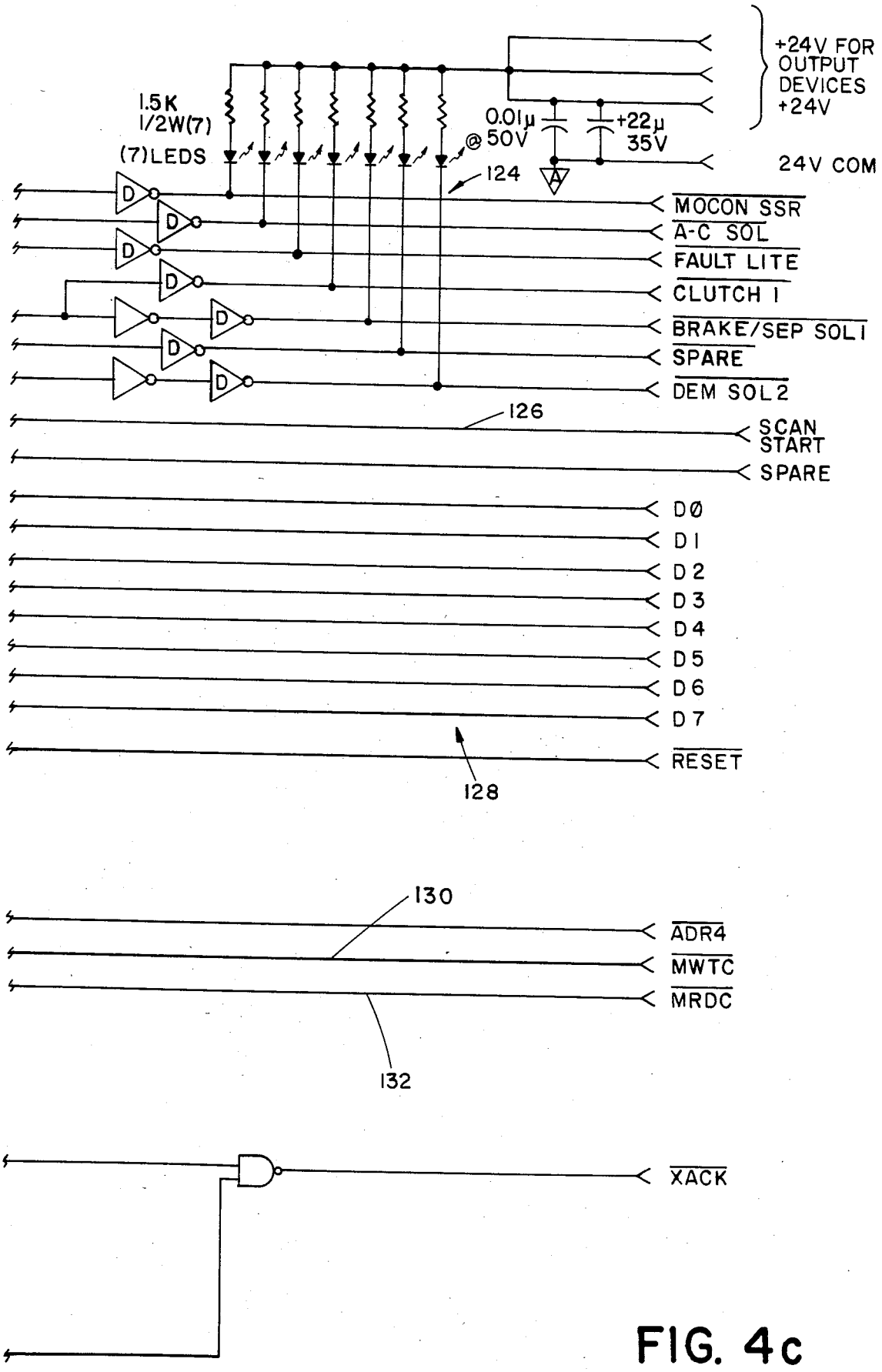
Figures 11C, 11D, 11E:
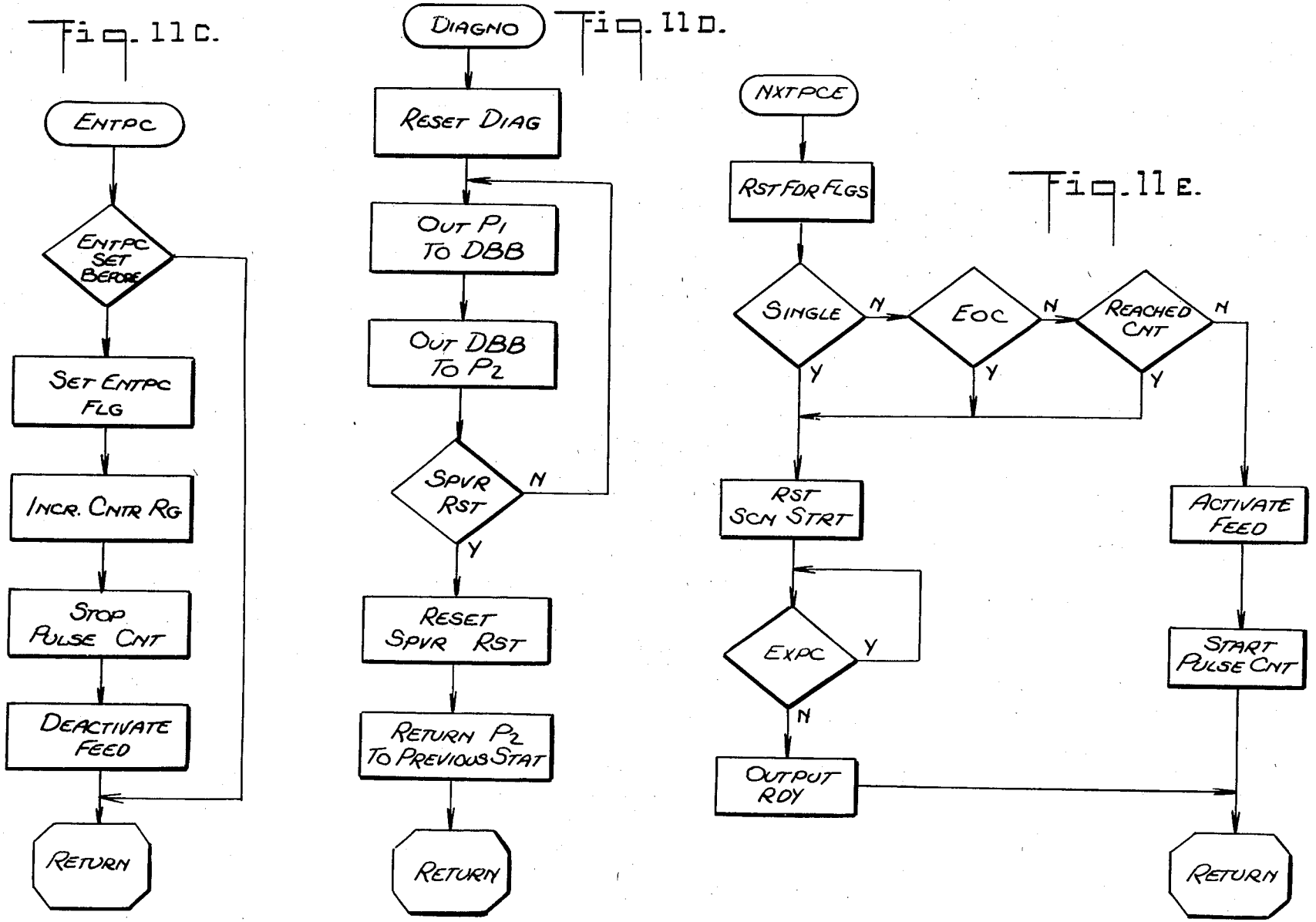
Figure 11F:
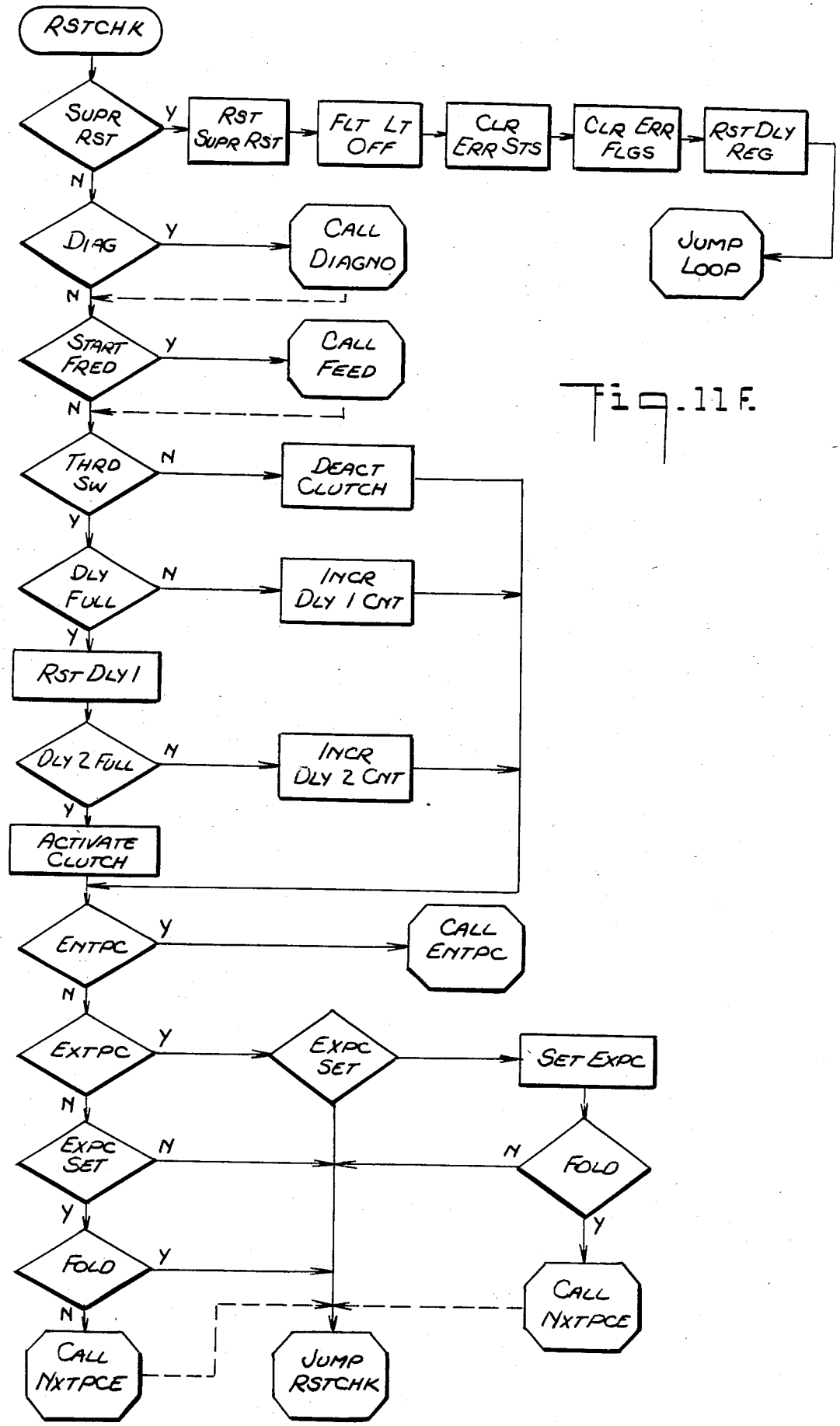
Figures 12A, 12B, 12C:
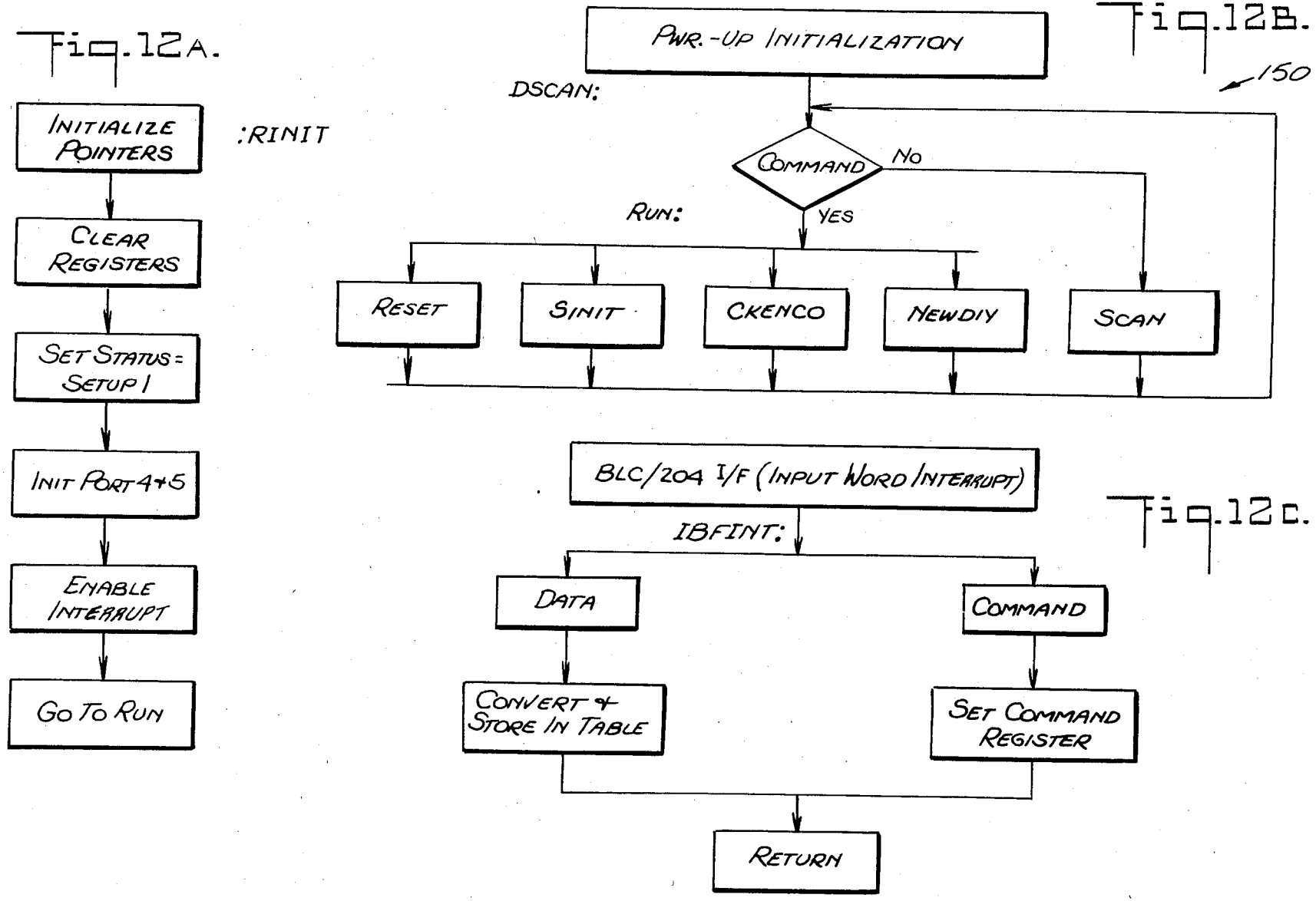
Figure 12D:
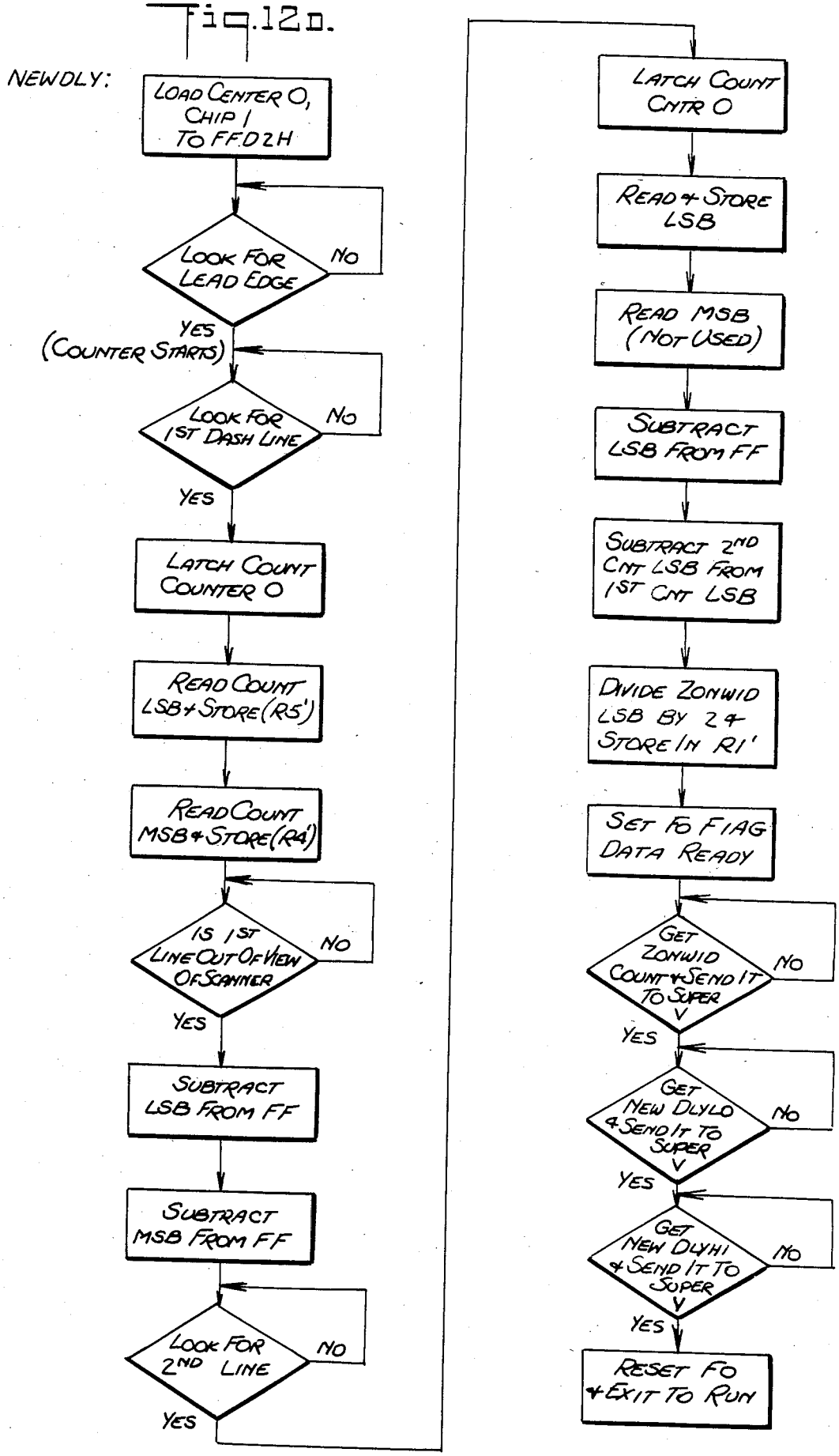
Figures 12F, 12G, 12H:
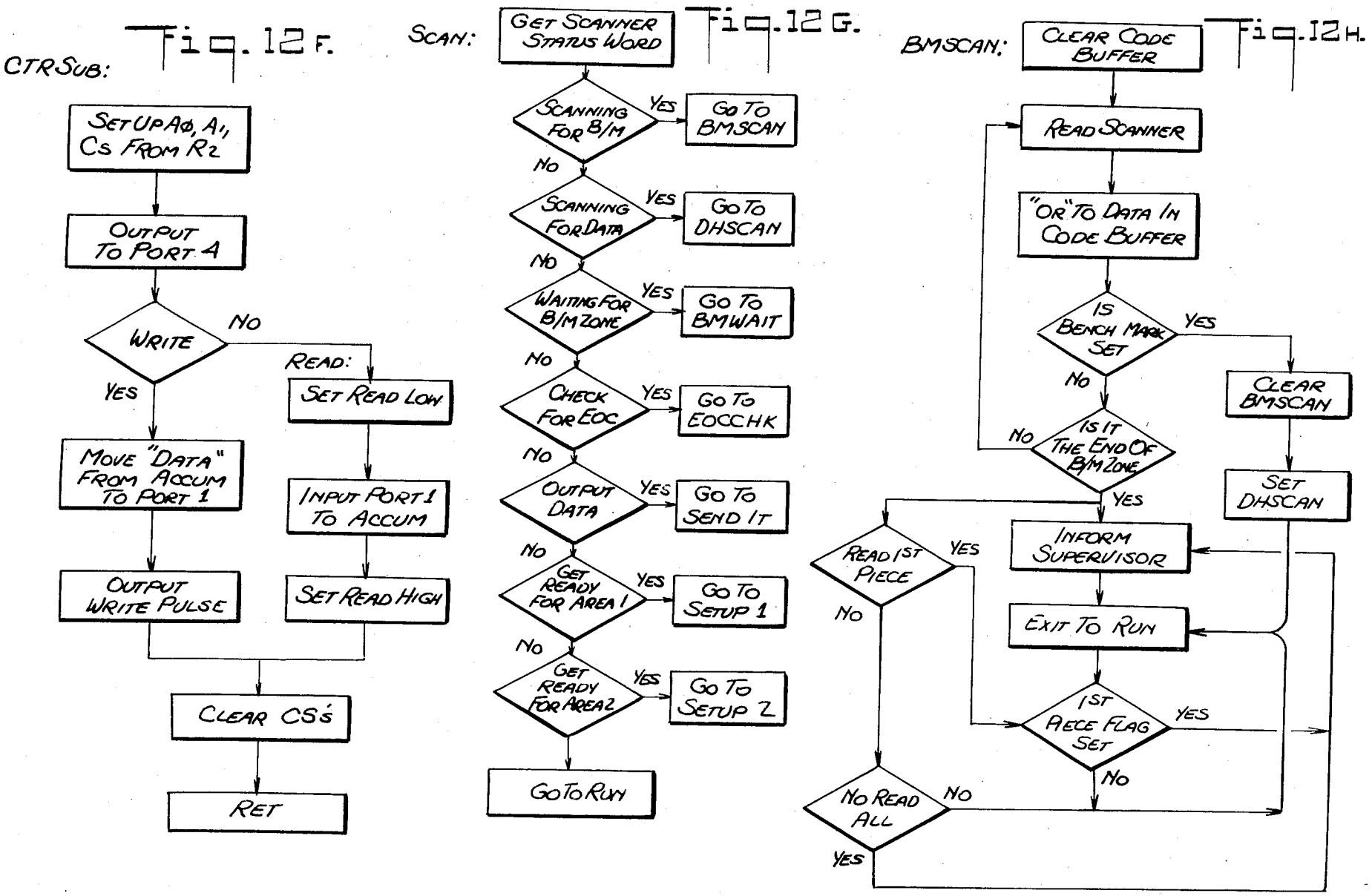
Figure 12J:
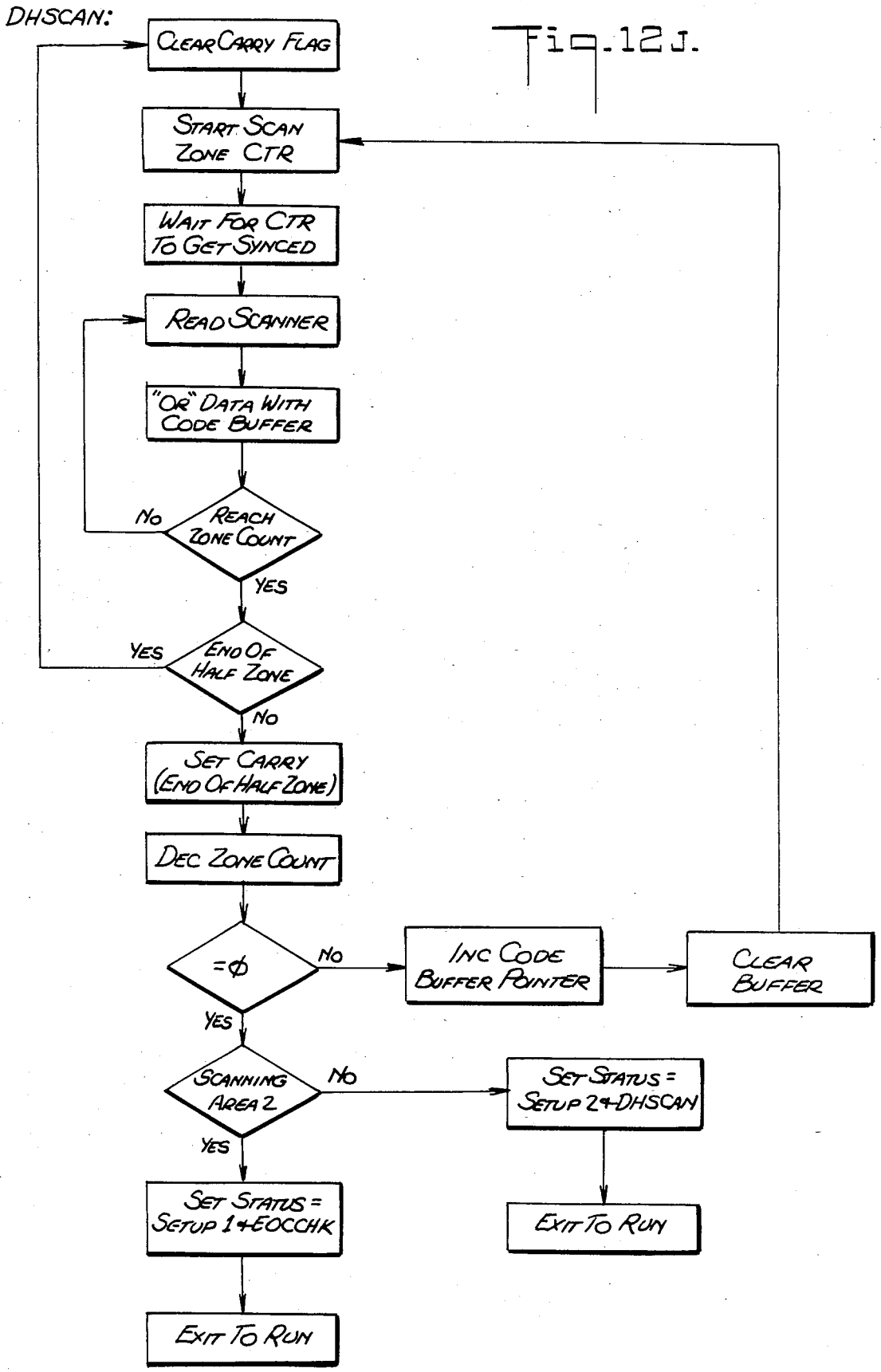
Figure 12L:
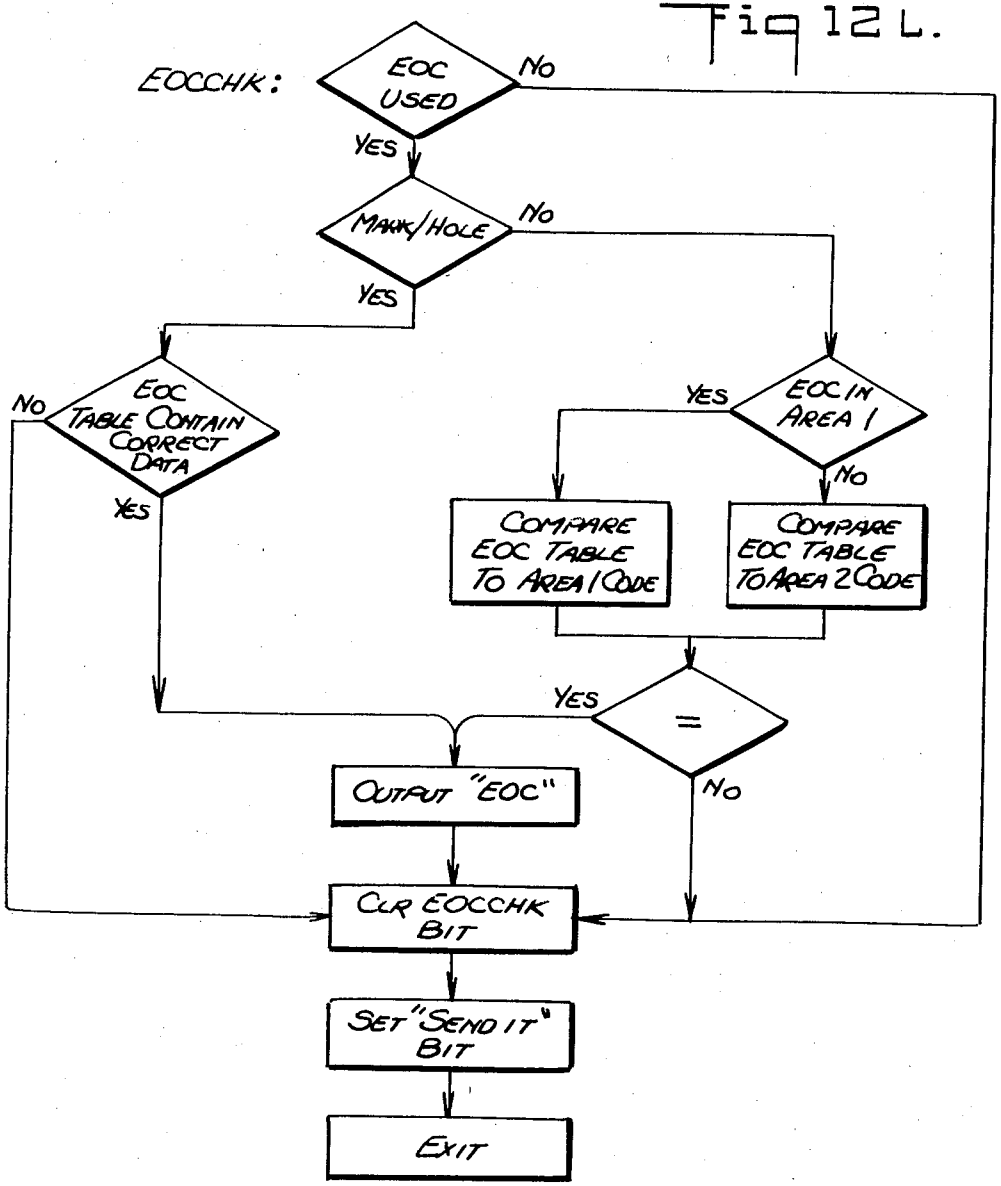
Figure 12K:
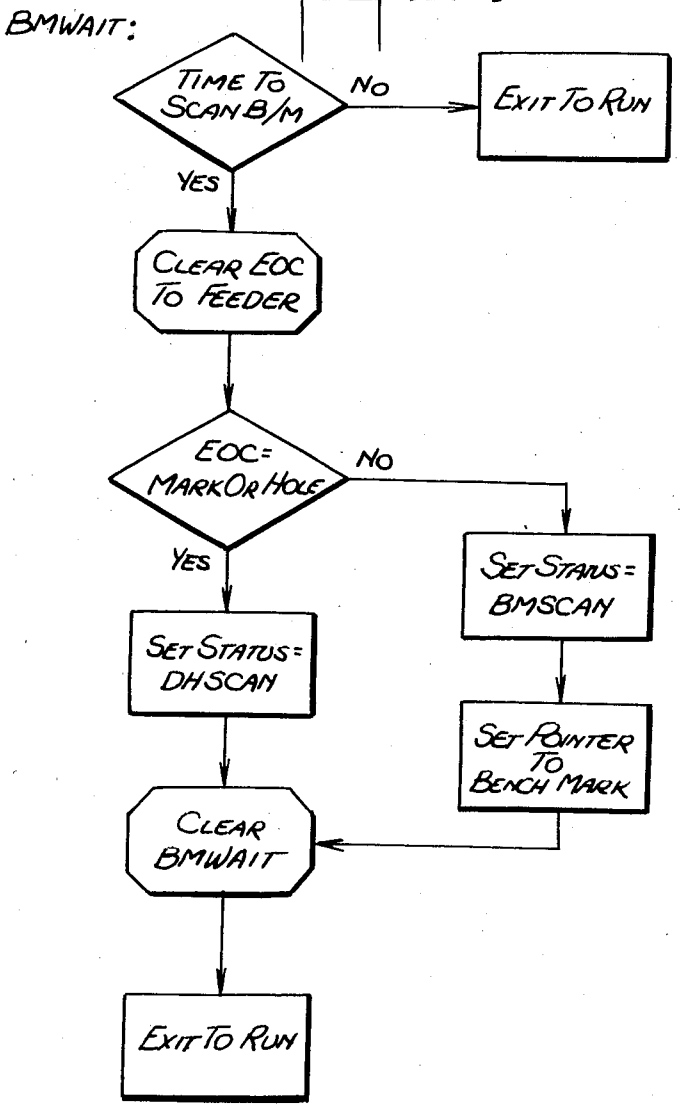
Figure 12M:
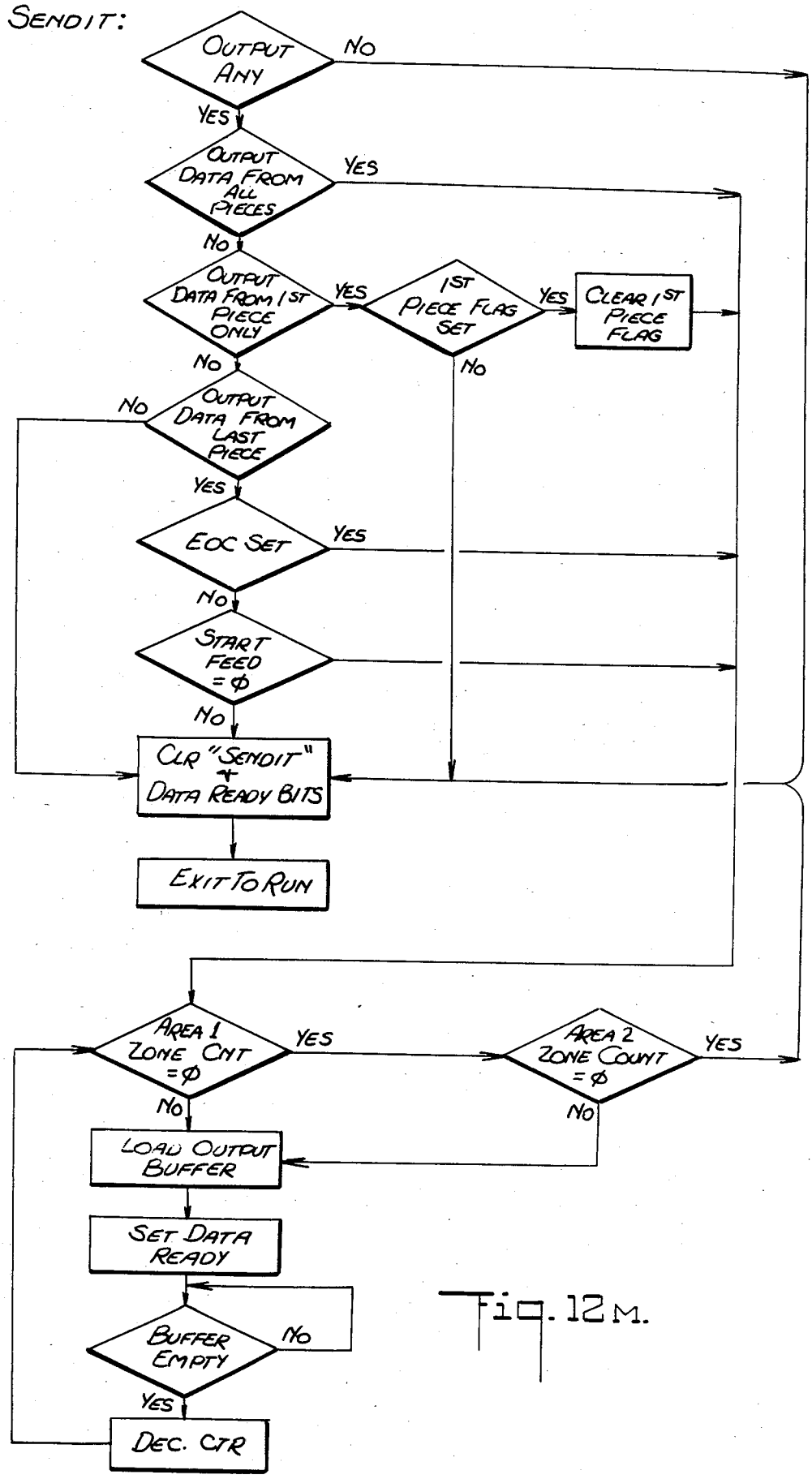
Figure 12N:
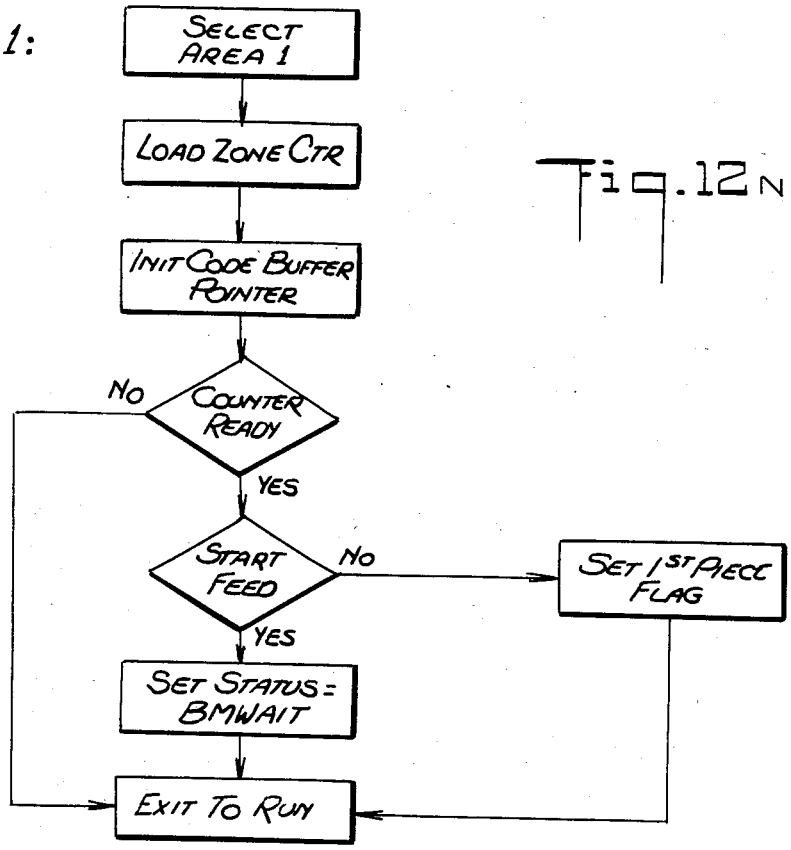
Figure 12N:
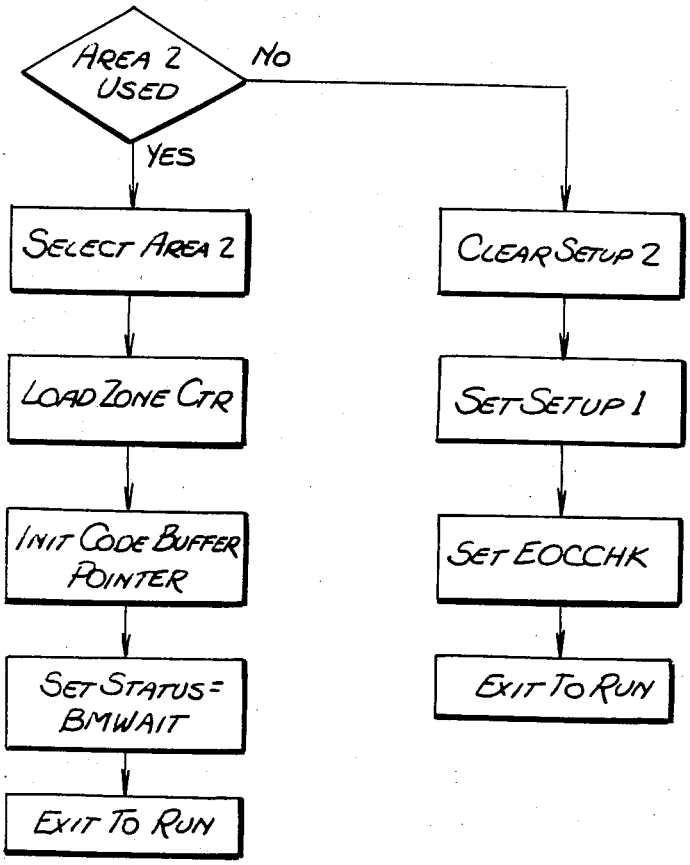
Figure 12P:
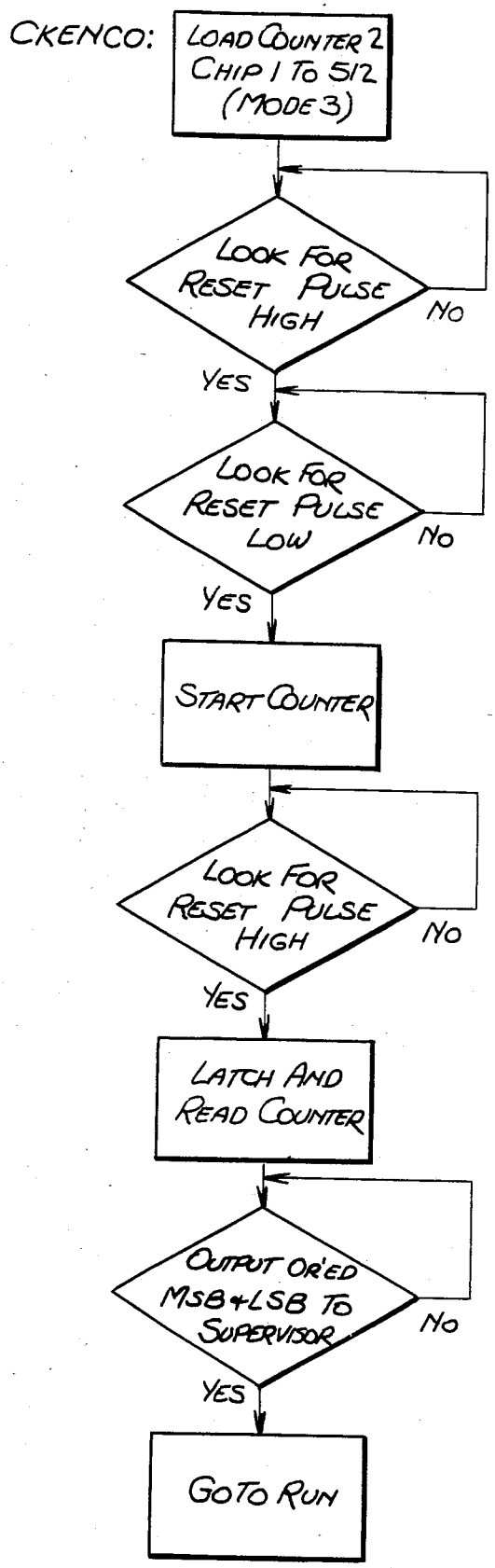
Figure 12Q:
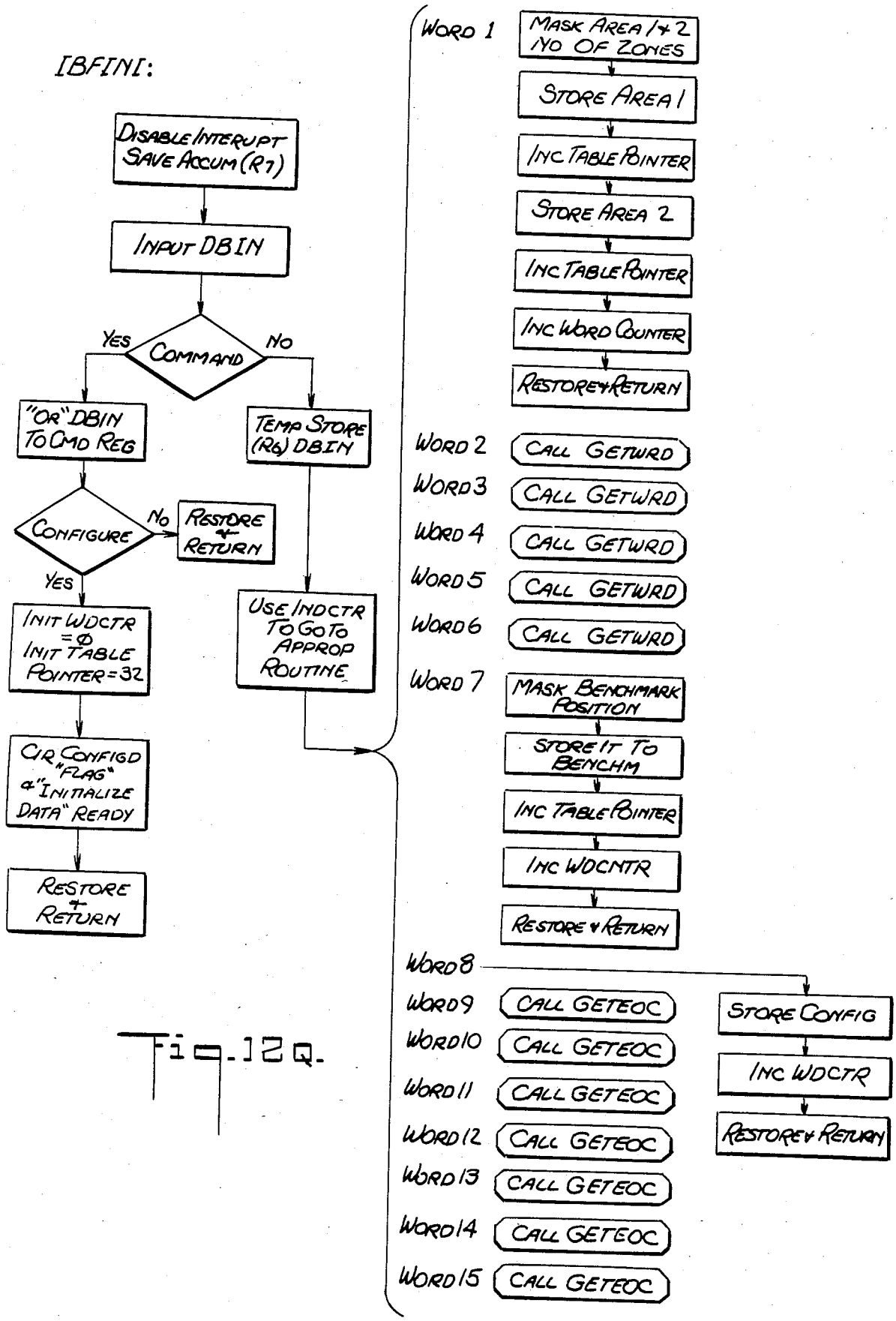
Figure 12R:
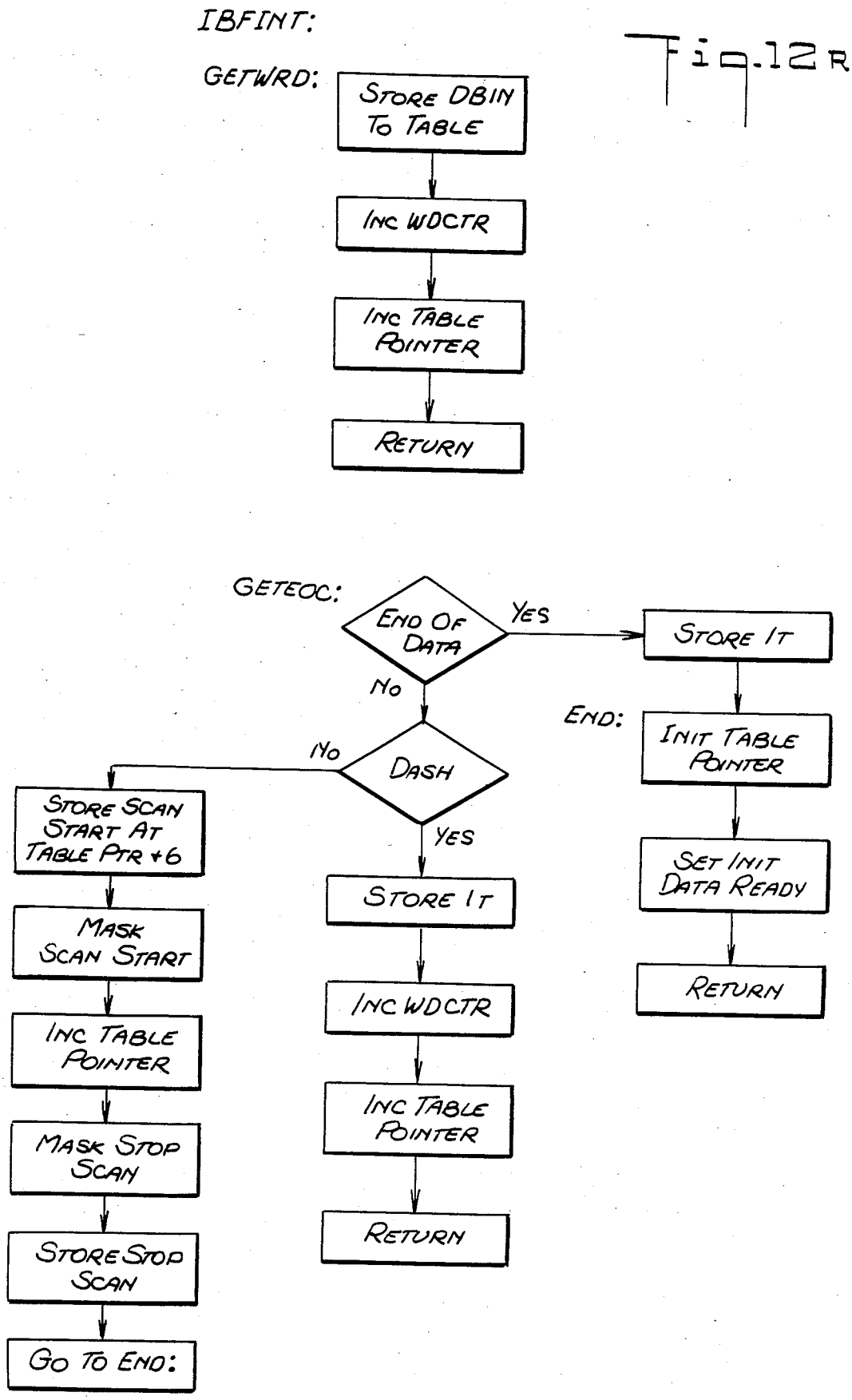

Referring to FIG. 4 a universal feeder circuit for use with all the feeder interface circuits 110A and B shown in FIG. 3 is illustrated generally as 110. The flow chart of the program for a high ratio feeder is illustrated in FIG. 8 as 103; the flow chart of the program for a high speed feeder is illustrated in FIG. 9 as 105; the flow chart of the program for the envelope feeder is illustrated in FIG. 10 as 107; and the flow chart of the program for a burster-folder is illustrated in FIG. 11 as 109. The program listings for the aforementioned feeders are set forth in the accompanying Microfiche Appendix. The feeder interface circuit 110 is the same for each feeder station 48–76, except that the address code of each feeder station is unique. This is accomplished via a thumbwheel switch 112 which is preset with a unique address code for each feeder station. This unique address code is supplied to a first set of inputs 114 to a comparator 116. The comparator 116 receives address data on a second set of inputs 118 from the central microprocessor 100 over signal bus 96. If there is a coincidence between the unique address and address data, the comparator 116 will provide an output signal to microprocessor 120 and one-shot circuit 123. When the one-shot circuit 123 receives a signal from the comparator 116, the one-shot circuit 123 provides an internal transfer acknowledge timing signal to the central microprocess 100 which indicates that the feeder module has received data therefrom. The output signal from comparator 116 activates the CS (Chip Select) input of the microprocessor 120 which activates the microprocessor 120. The microprocessor 120 also receives inputs on input lines 122 from photocells and/or switches (not shown) and in response thereto transmits output signals to output lines 124 for performing certain functions at the feeder station in accordance with the program stored therein. As seen in FIG. 4, this includes actuation of motors, clutches, brakes, fault lights, and solenoids associated with that feeder station. The microprocessor 120 also transmits a start scan signal 126 to its associated scanner interface circuit which will be described in more detail with reference to FIG. 5.

The microprocessor 120 transmits output data on data lines 128 to the central microprocessor 100 over signal bus 96 to advise the central processor 100 of the functions implemented by the feeder module being accessed and to store the data for the document in the document table in the RAM of the central processor 100. Additionally, the microprocessor 120 also receives its feed function data from the central microprocessor 100 over the same data lines 128. Specifically, the data from the central processor 100 is read and written into the microprocessor 120 over memory write and memory read lines 130 and 132, respectively.

As apparent from FIGS. 8–11 and the accompanying program listing in the Microfiche Appendix, each different type of feeder will have a different program which is implemented by a resident or distributed processor 120. Advantageously, with such an arrangement there is intelligence present at each feeder module so that the Commands from the supervisory program are essentially a Feed Command with the individual feeder modules being responsive thereto to perform their feeding functions. This facilitates a standard supervisory program format which is usable with individually programmed feeder modules to readily provide a customized inserter without requiring any reprogramming. Additional details regarding the feeder interface circuit may be obtained from copending patent application Ser. No. 394,383 filed on July 1, 1982 in the names of Peter N. Piotroski and John M. Gomes, entitled, FEEDER INTERFACE CIRCUIT FOR UNIVERSAL MULTI-STATION DOCUMENT INSERTER.

Figures 5, 5A:
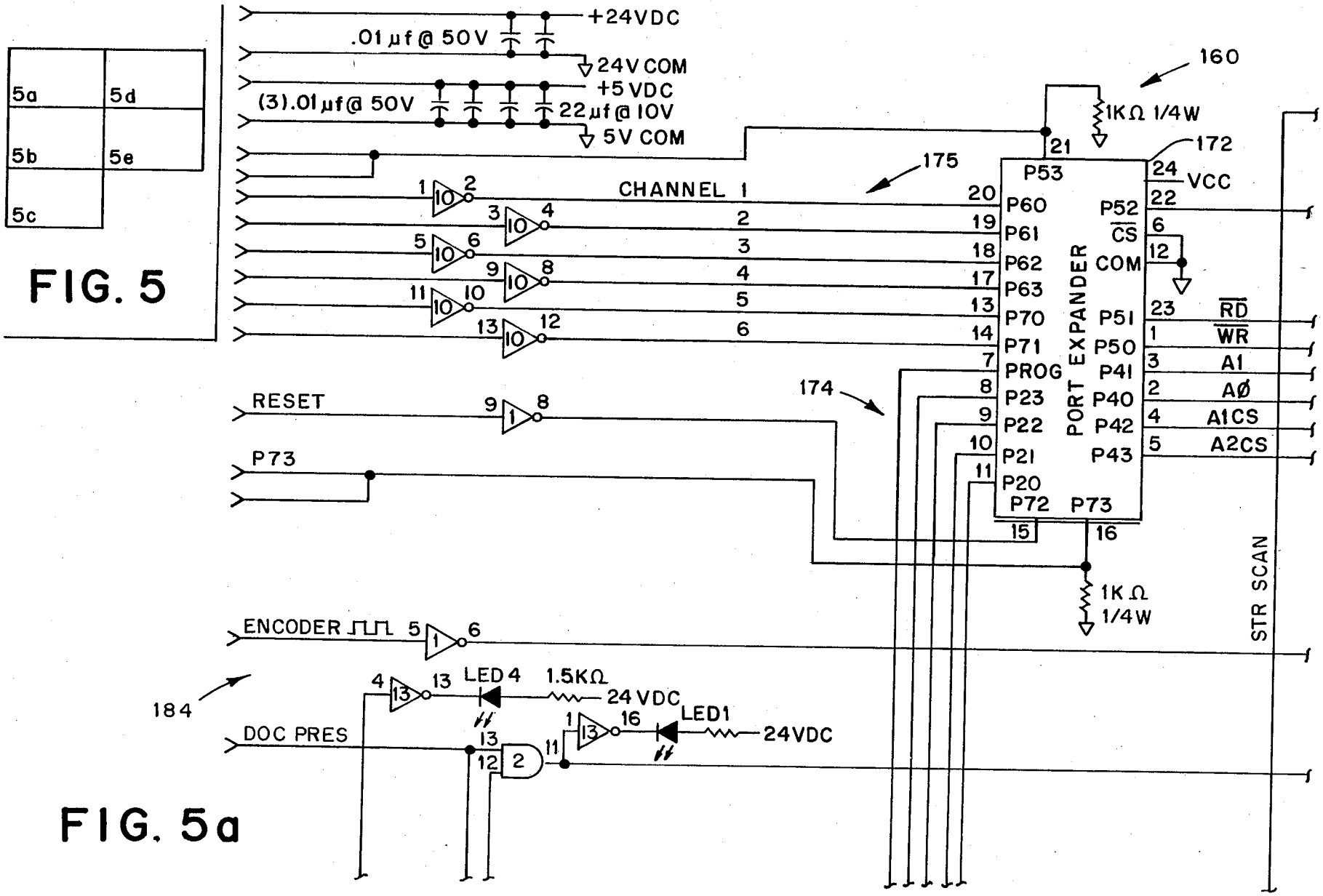
FIGS. 5, 5*a*–5*c* are schematic diagrams of the scanner interface circuit.
Figure 5B:
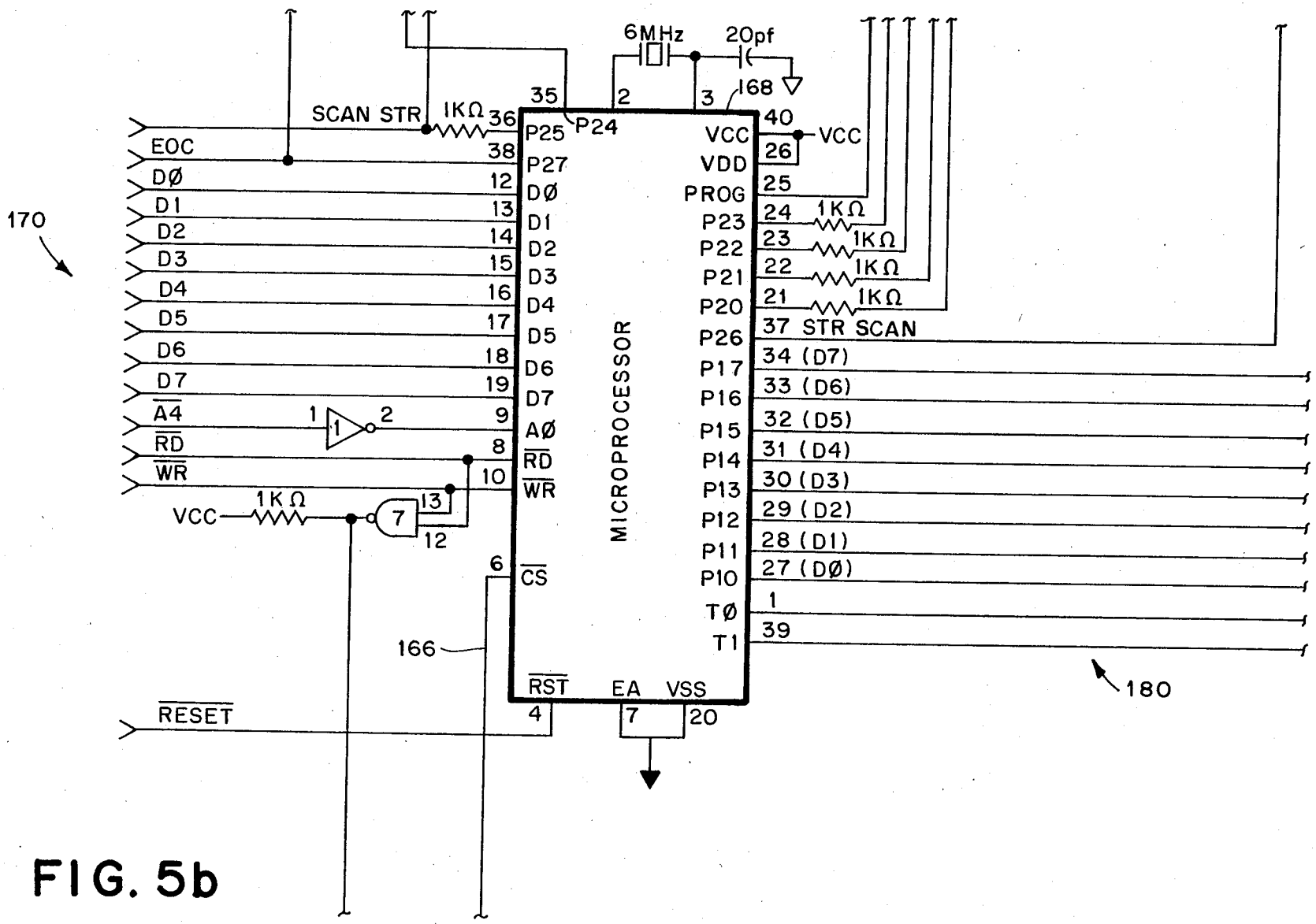
Figure 5C:
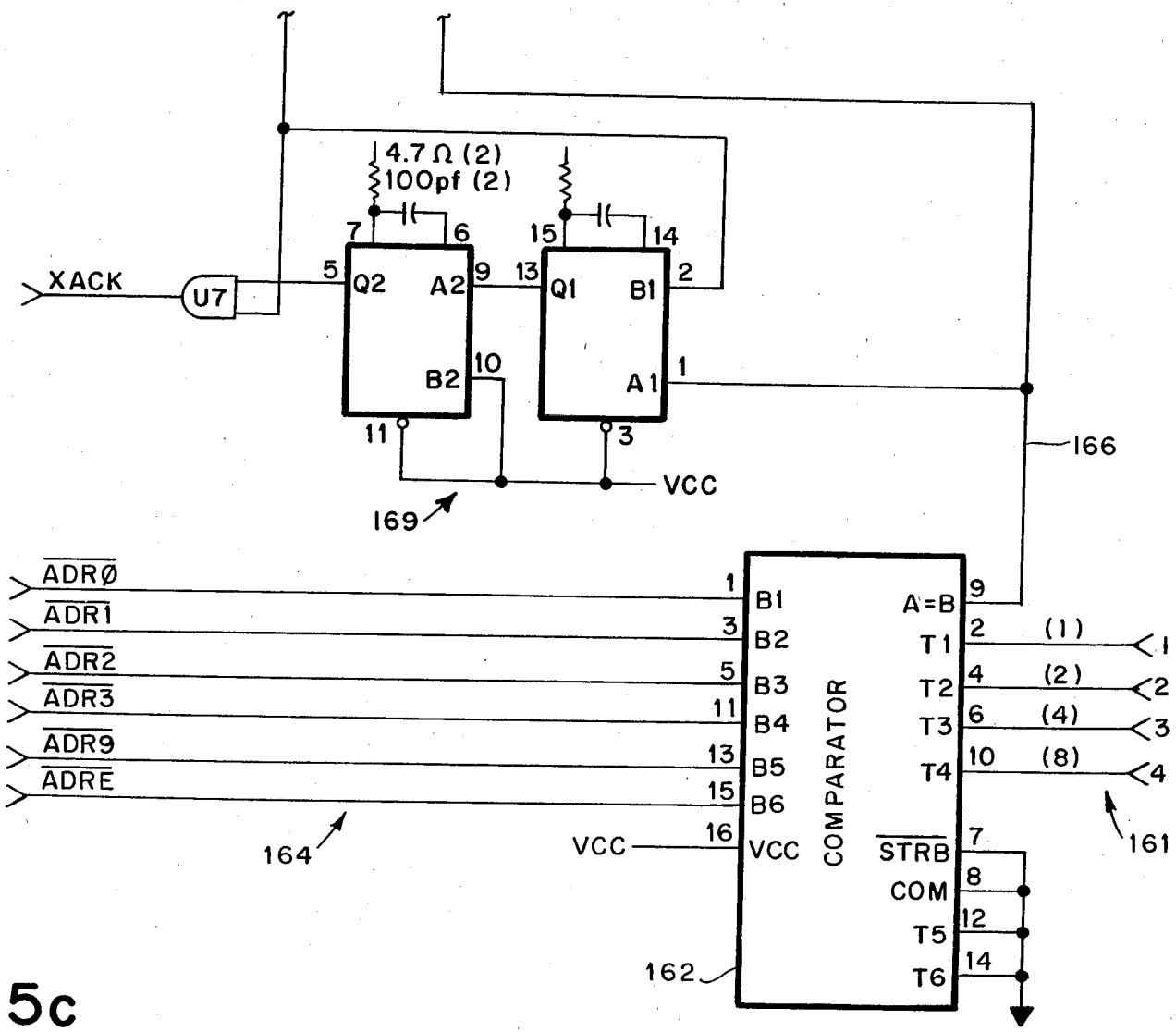
Figure 5D:
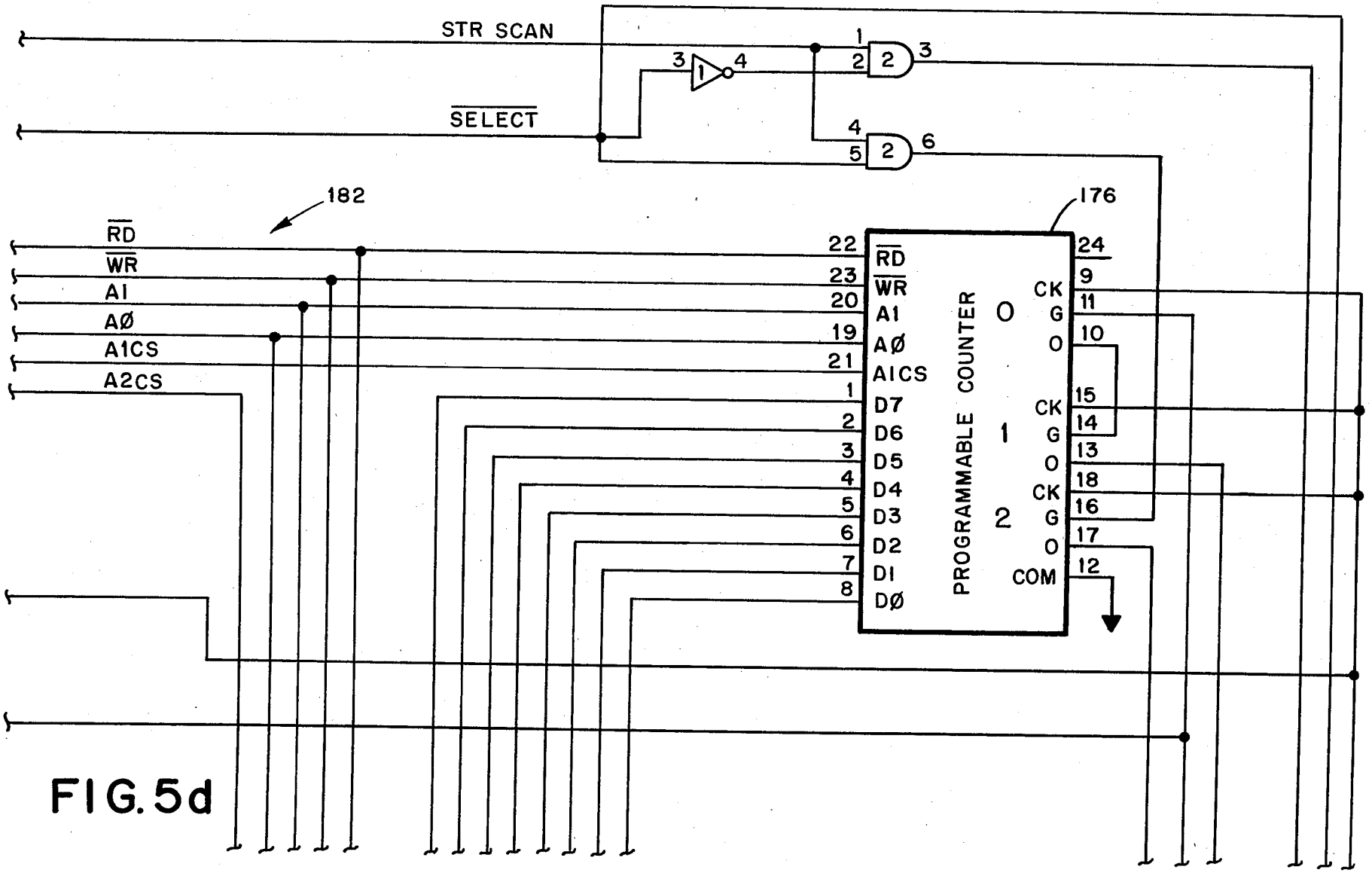
Figure 5E:
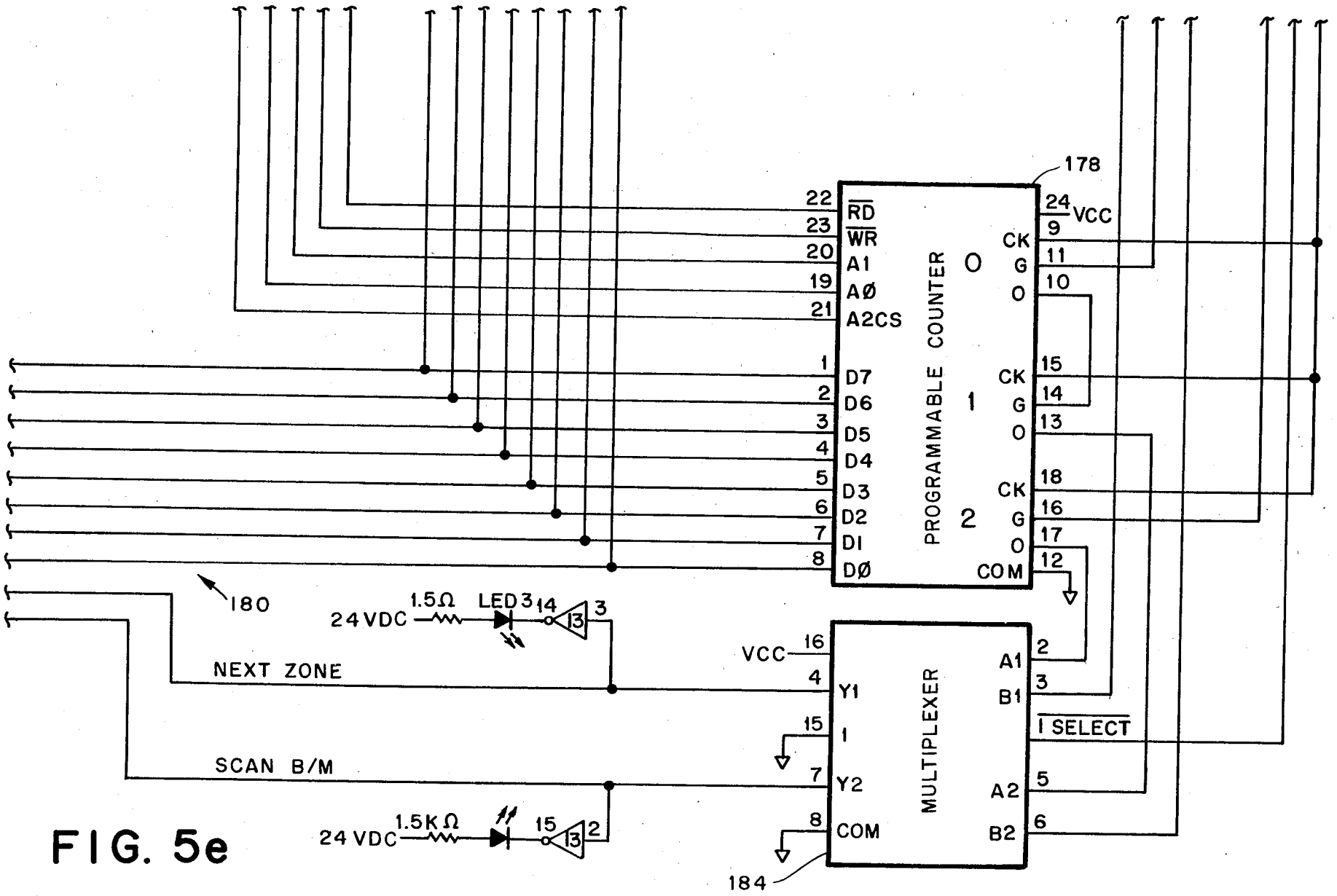

Referring to FIG. 5, the scanner interface circuit 160 for the optional scanner interface circuit illustrated in FIG. 2 and the scanners for the feeder modules shown in FIG. 1, is illustrated. The flow chart of the program for the scanner interface circuit 160 is illustrated in FIG. 12 as 150. The program listing therefore is set forth in the accompanying Microfiche Appendix. The scanner interface circuit 160 employs a portion of the address code of its associated feeder interface circuit 110 and receives this unique address code over address leads 161 coupled to the thumbwheel switch 112 of its associated feeder interface circuit 110. A comparator 162 receives the remaining address from the central processor 100 over the signal bus 96 comprising a first set of inputs 164 and the address leads 161 comprising a second set of inputs 161 and provides an output signal on lead 166 when there is a coincidence therebetween. The presence of a signal on lead 166 causes a signal to be applied to port CS (Chip Select) which activates the distributed microprocessor 168. Further, the presence of a signal on lead 166 also activates one-shot circuit 169 to provide internal transfer acknowledge signal to the central processor 100 which indicates that the distributed microprocessor 168 has received data from the central processor 100. The central processor 100 transfers data through data leads 170 to program the microprocessor 168. A port expander 172, such as Type 8243 available from Intel Corp., is coupled to the microprocessor 168 over leads 174. The input leads 175 of the port expander 172 are coupled to photocells (not shown) for reading the dash codes present on the coded documents. The programmed microprocessor 168 and port expander 172 program a first programmable counter 176 and a second programmable counter 178 in accordance with the data read over data lines 170 from the central processor 100, to provide timing signals to the microprocessor 168 and port expander 172 for reading the dash codes through input leads 175. Output data from the microprocessor 168 is applied over leads 180 to corresponding input ports of the programmable counters 176 and 178. Further, input signals are also provided to the programmable counters 176 and 178 from output ports of the port expander 172 and scanner encoder (not shown) on leads 182 and 184, respectively, to the programmable counters 176 and 178 to monitor how far the coded document has traveled per each preset increment of paper travel. In addition to providing output signals 180 to the programmable counters 176 and 178, the feeder microprocessor 120 (see FIG. 4) provides a start scan signal thereto. The programmable counters 176 and 178 are provided so that different discrete areas on a document may be selectively scanned skipping intermediate areas, as desired. Each programmable counter 176 and 178 includes port groupings, 0, 1, and 2. Port grouping 0 provides information for setting the photocells to begin scanning at a predetermined distance from the edge (top or bottom) of a document. Port grouping 1 provides a predetermined distance for scanning after reaching the point where scanning commences. That is, the port 1 grouping opens up a "window" where the photocells begin scanning for the first dash of the dash code to set up timing for the subsequent dashes. Port grouping 2 specifies a predetermined distance by which the individual dashes of the dash codes on the documents may be separated. For example, the programmable counter 176 may be set to begin counting 4 four inches from the bottom of the document and the programmable counter 178 may be set to begin counting 8 inches from the bottom of the document, thereby scanning separate and discrete areas of the coded documents.

The output signals from the programmable counters 176 and 178 and Select signal from port expander 172 are transmitted to a multiplexer 184 which supplies input signals to the microprocessor 168 for selecting the next scanning zone and the next scanning sequence for the microprocessor 168. Encoder signals are provided to the programmable counters 176 and 178. Additional details regarding the scanner interface circuit may be obtained from copending patent application Ser. No. 394,390, filed on July 1, 1982 in the names of Peter N. Piotroski and Robert K. Gottlieb, entitled SCANNER INTERFACE CIRCUIT FOR UNIVERSAL MULTI-STATION DOCUMENT INSERTER.

Figure 6:
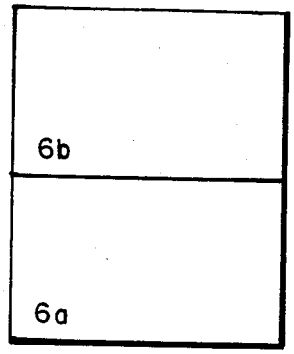
FIGS. 6, 6*a*–6*b* are schematic diagrams of the transport interface circuit.
Figure 6A:
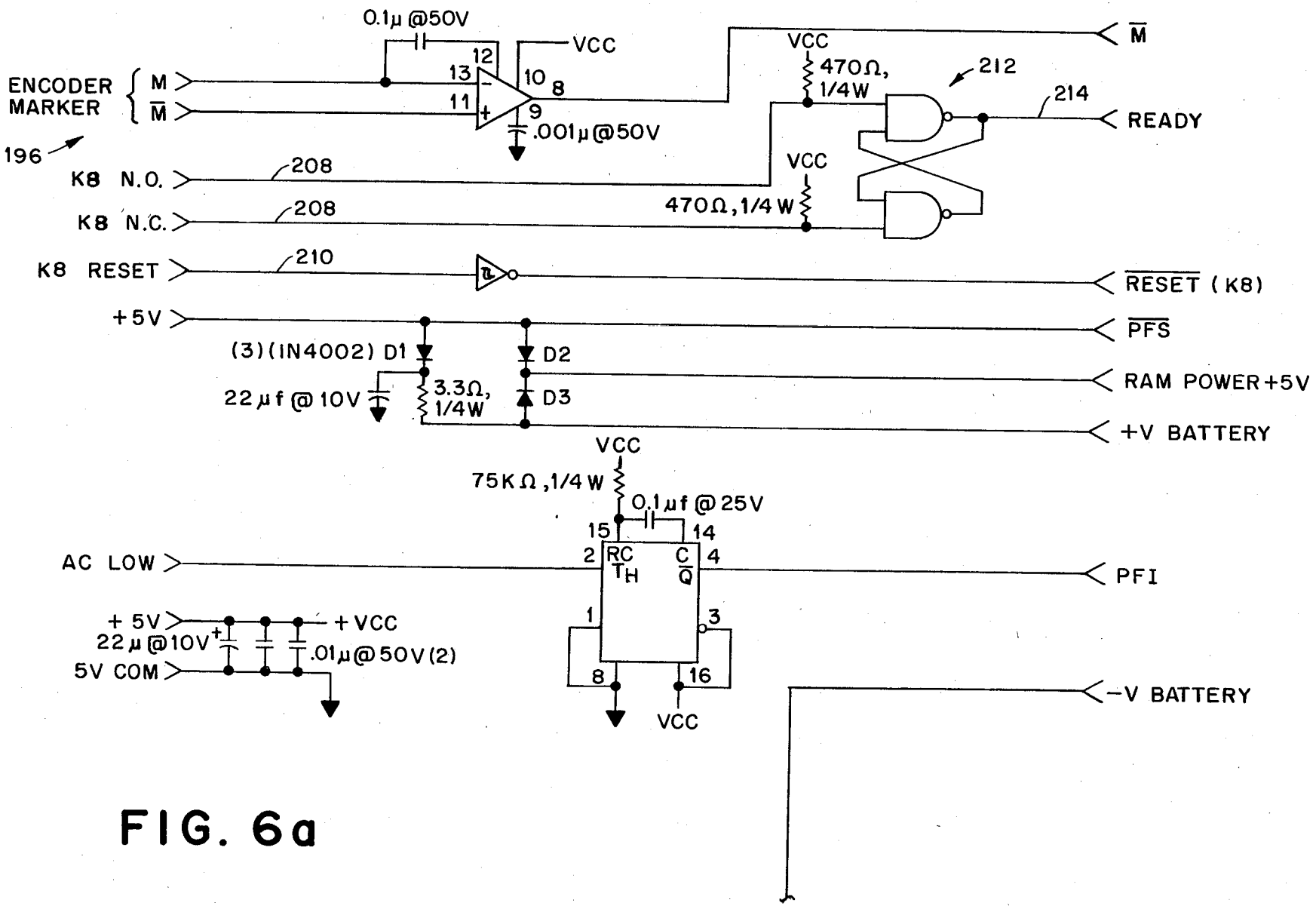
Figure 6B:
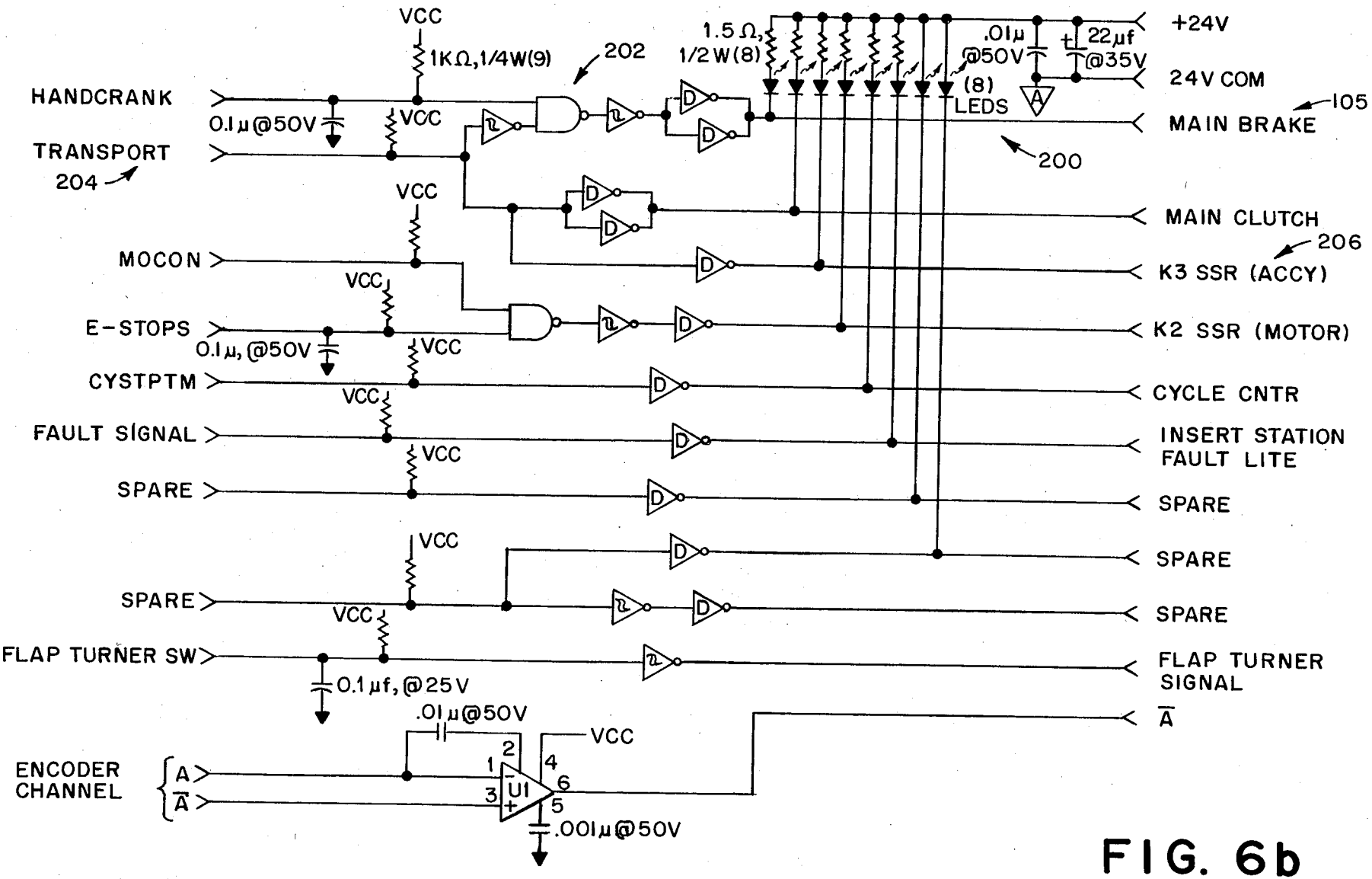
Figure 7C:
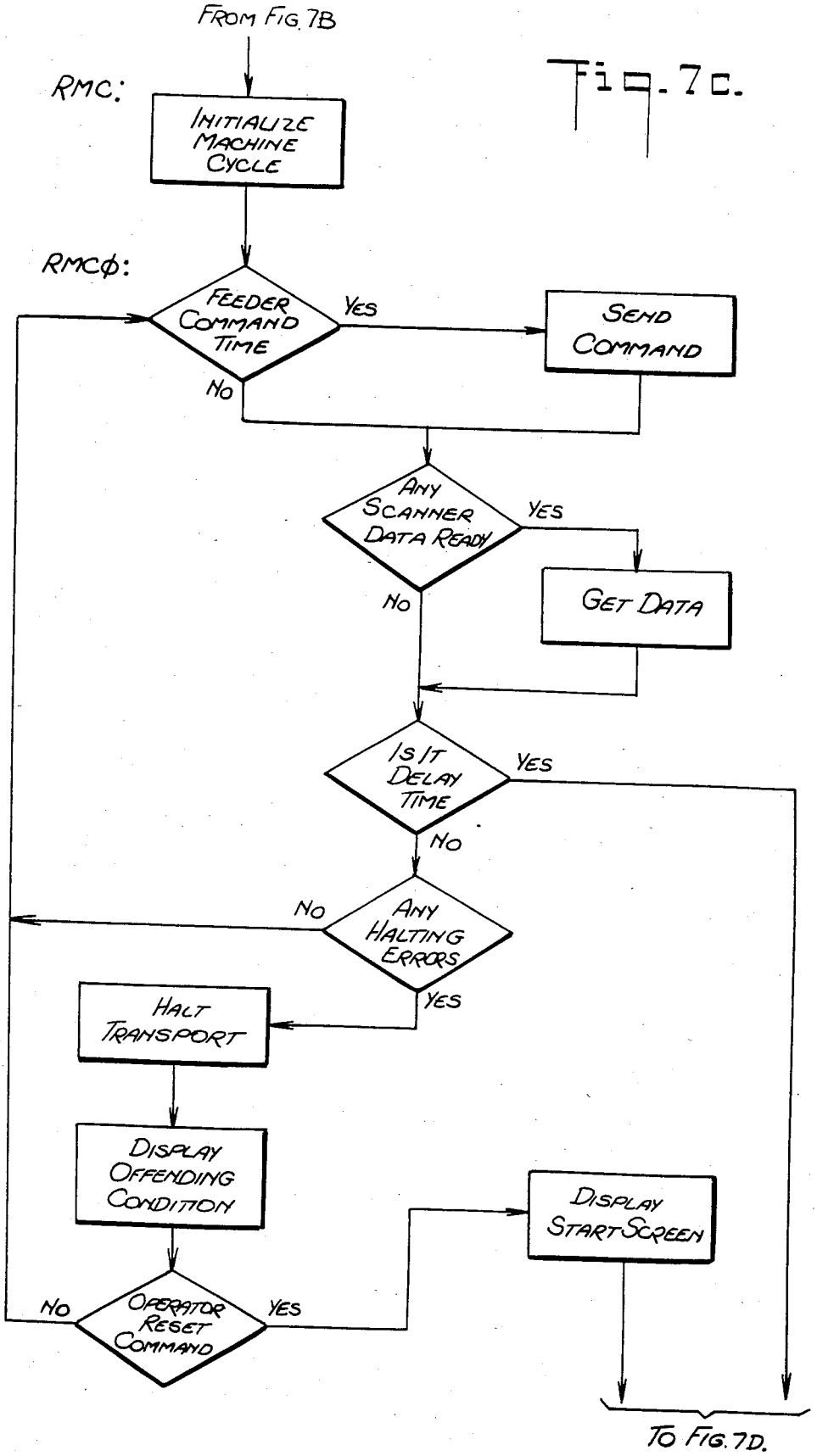
FIGS. 7*a*–7*h*, 7*j*–7*h* are flow charts of the supervisory program for use in the supervisory control circuit.
Figure 7D:
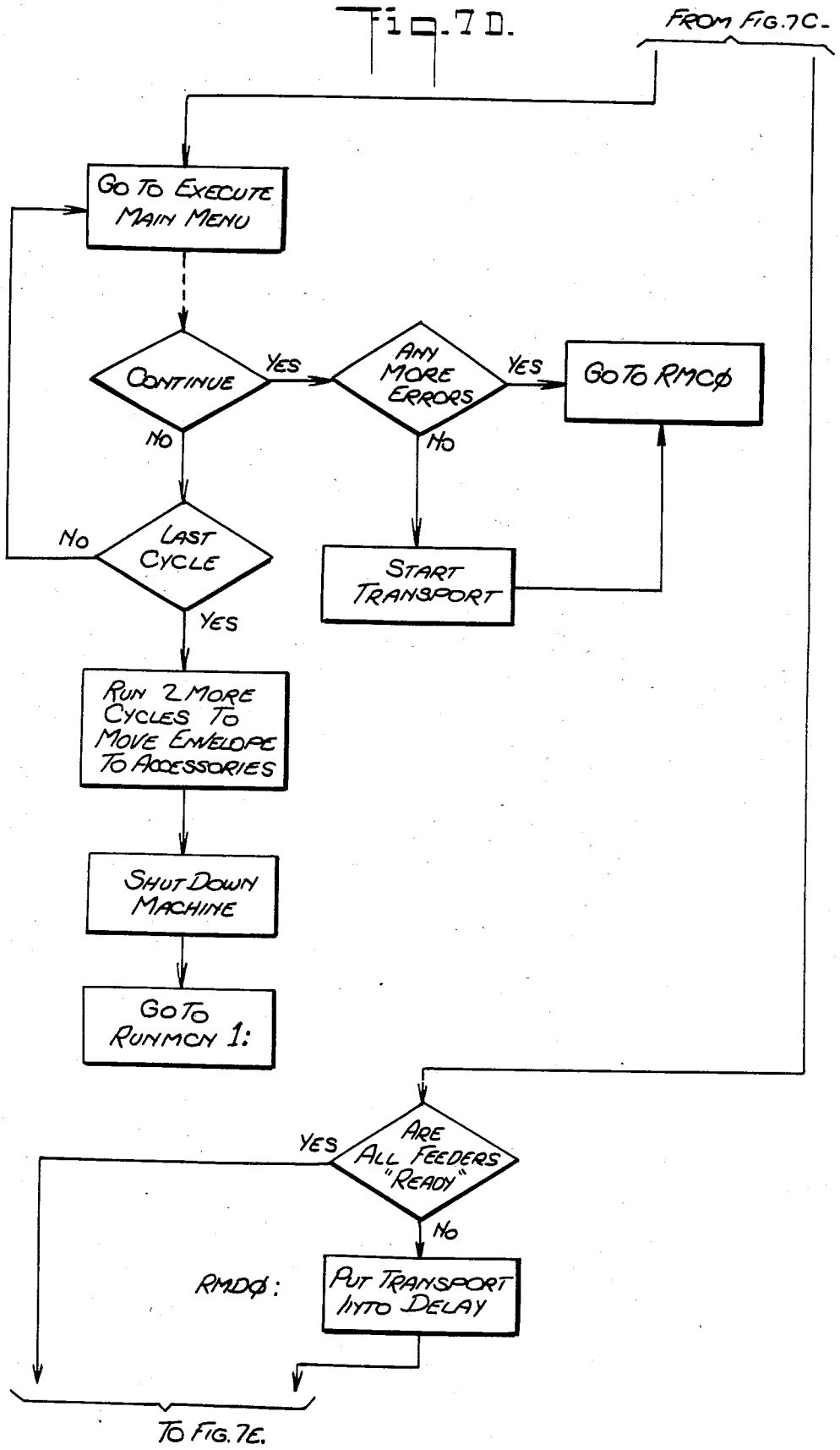
Figure 7E:
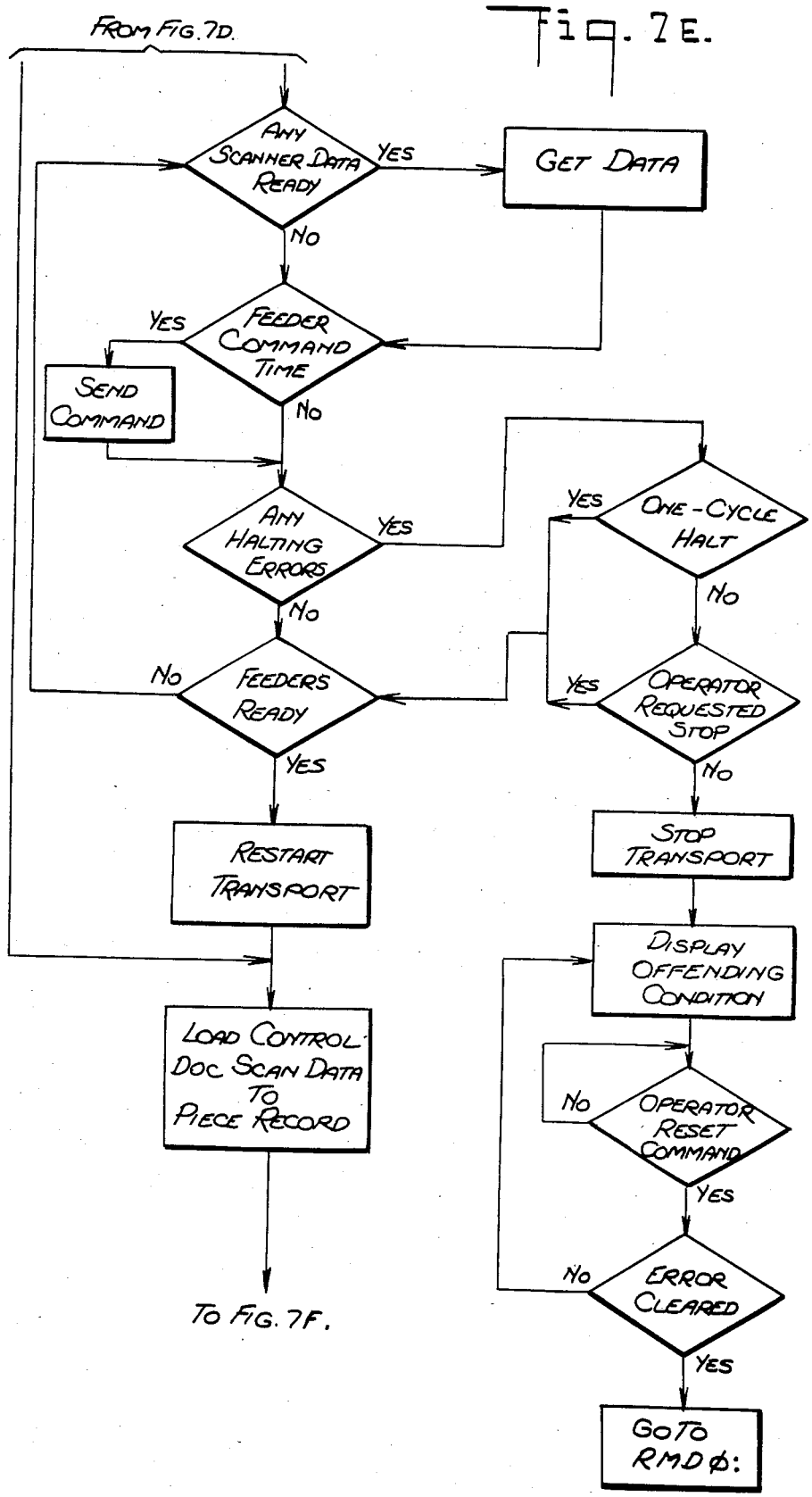
Figure 7F:
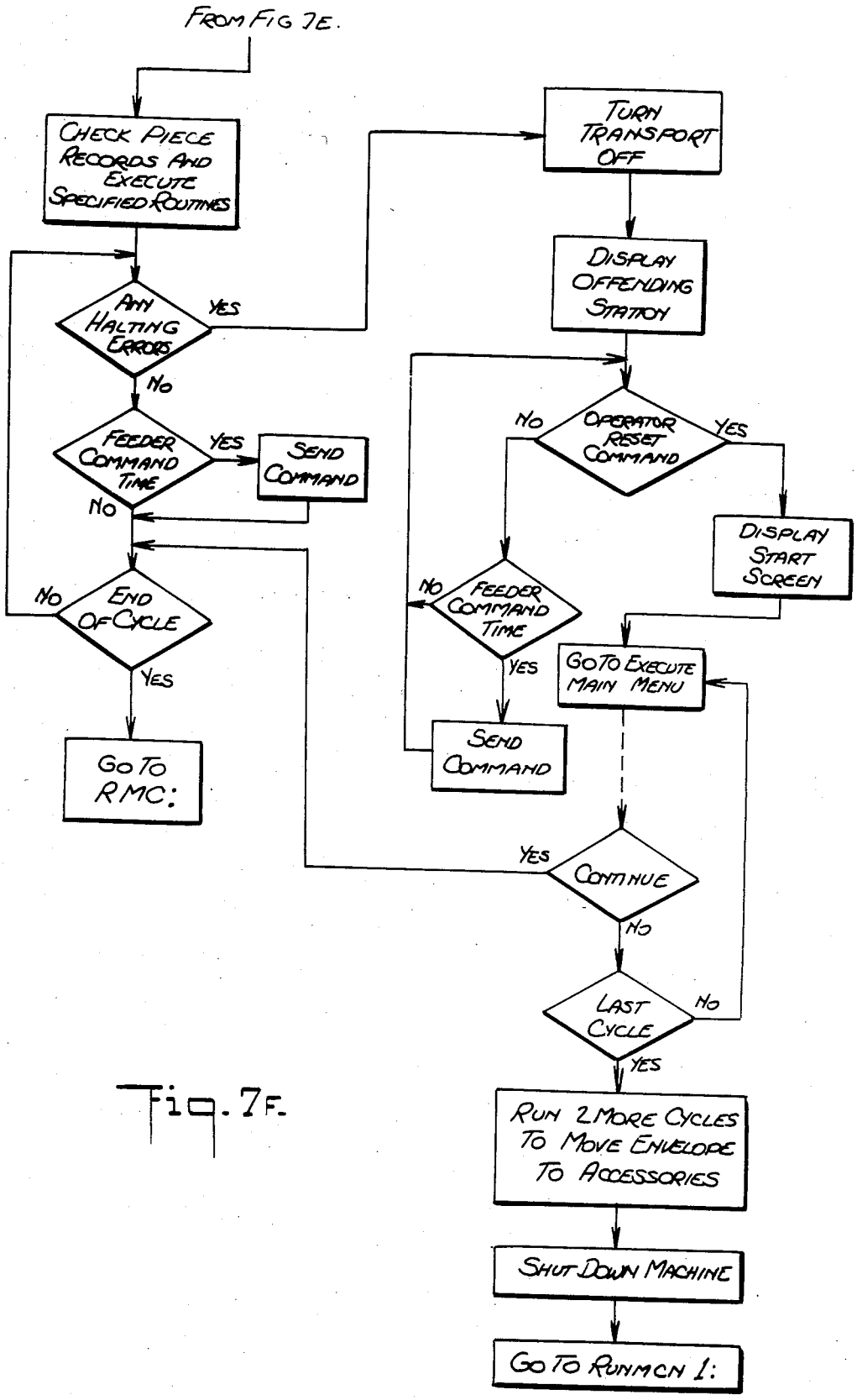
Figure 7G:
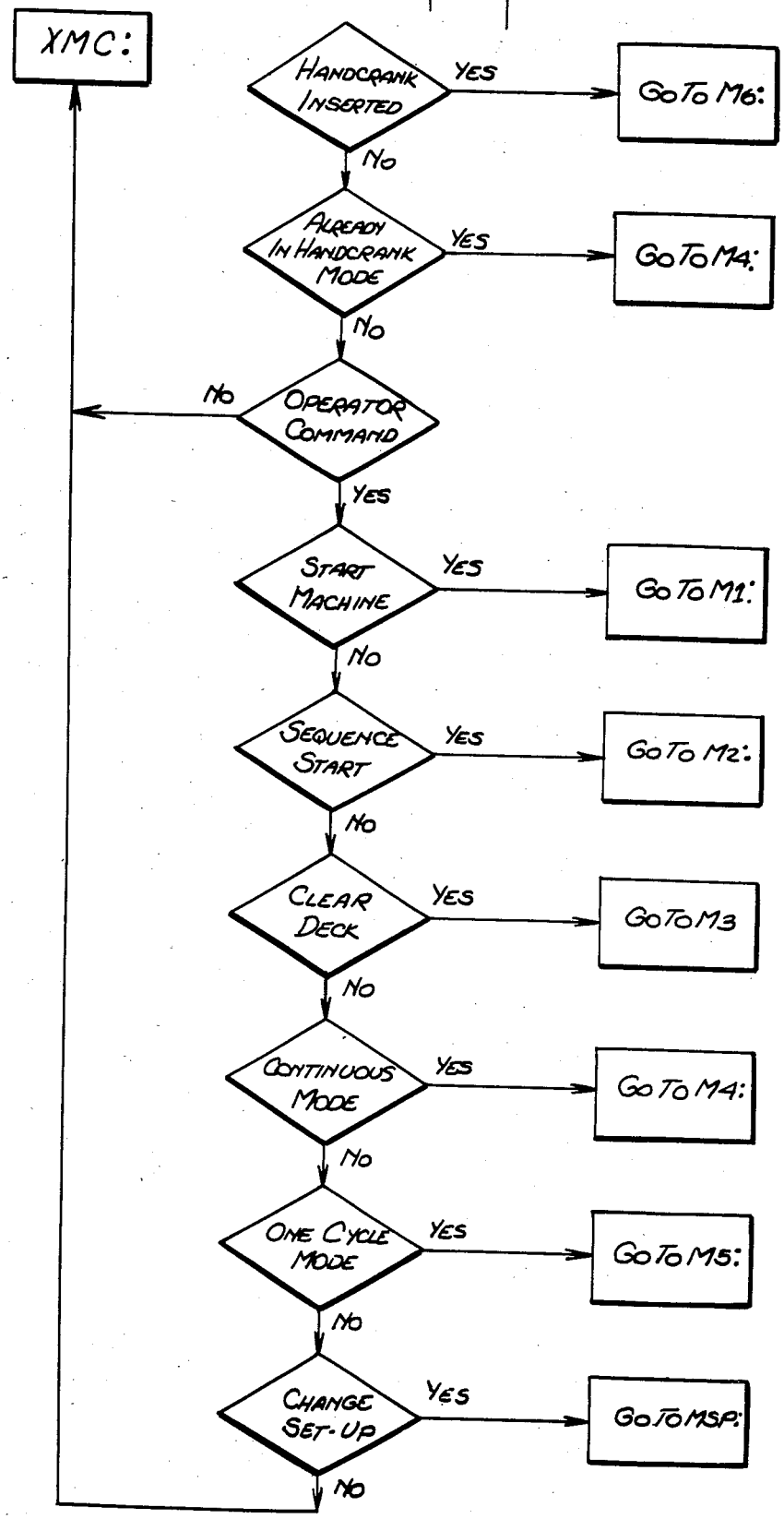
Figure 7H:
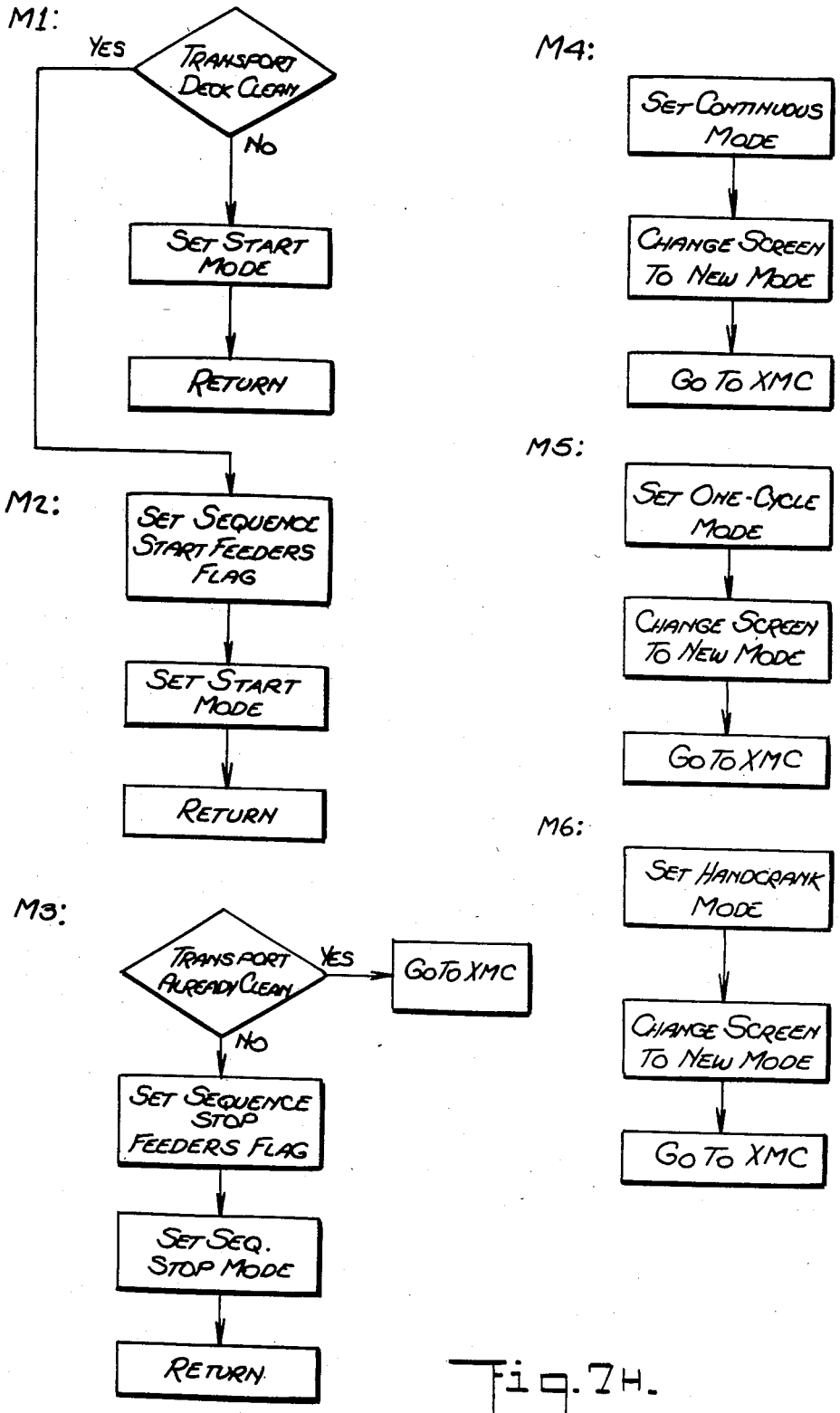
Figure 7J:
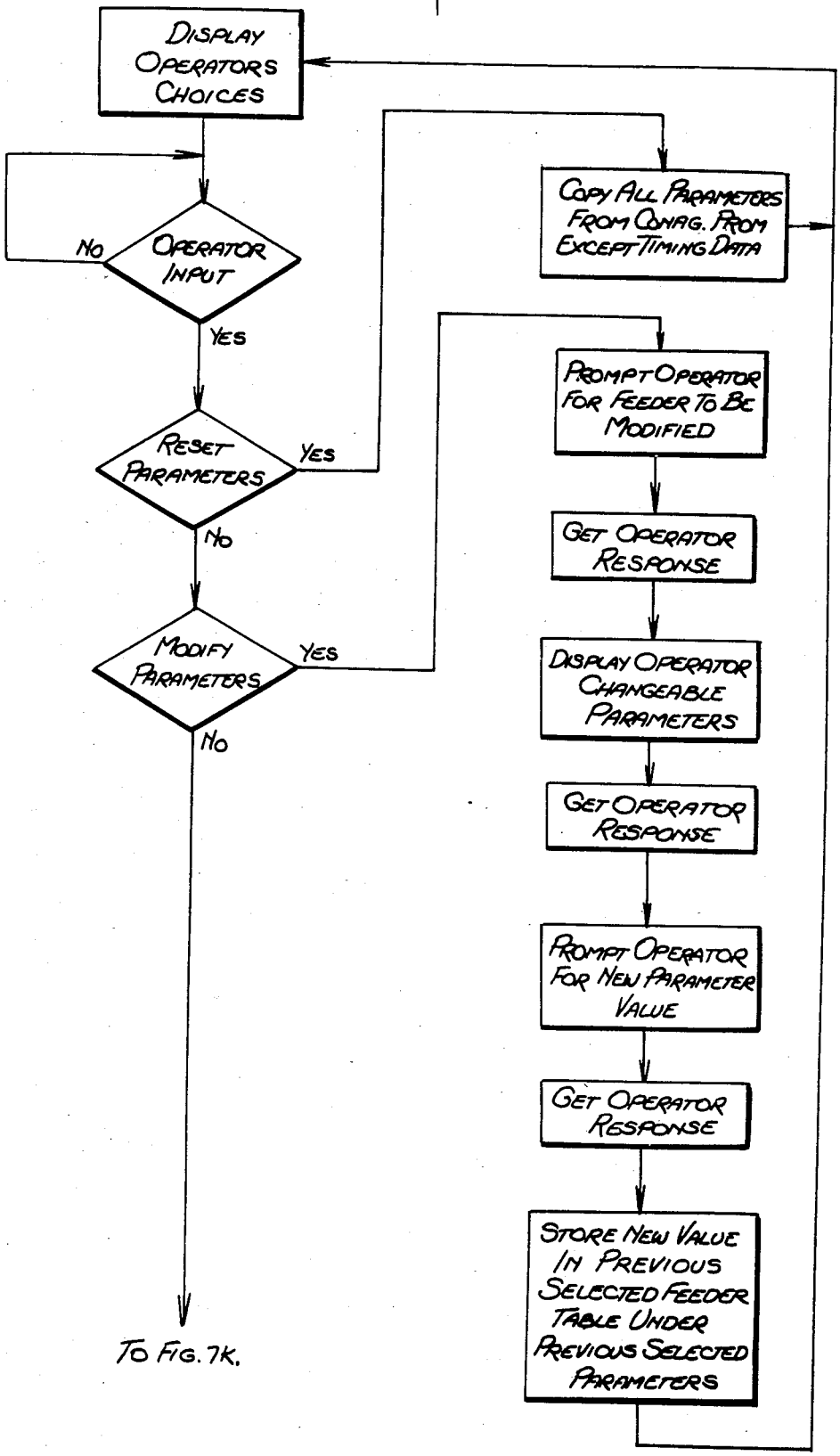
Figure 7L:
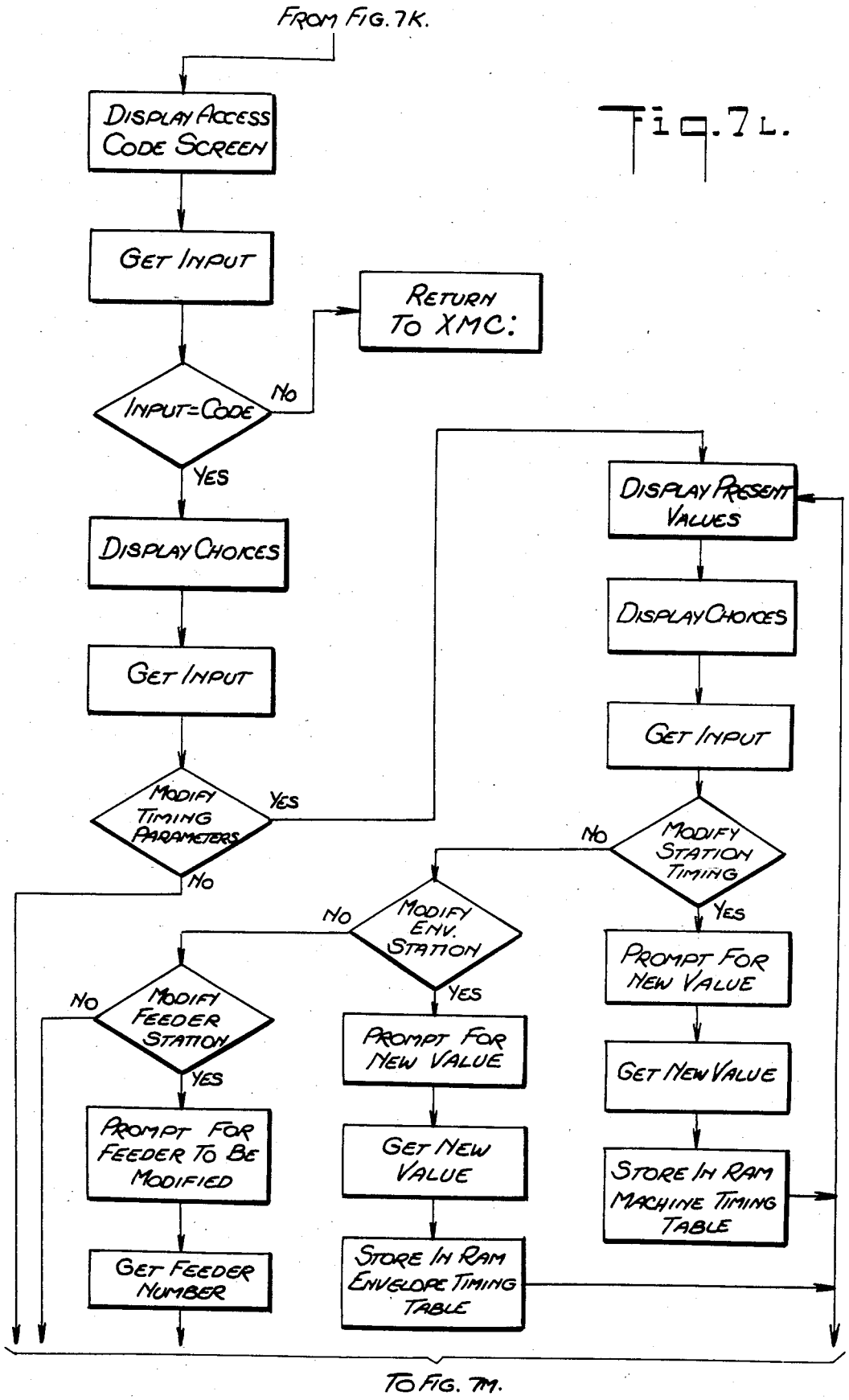
Figure 7M:
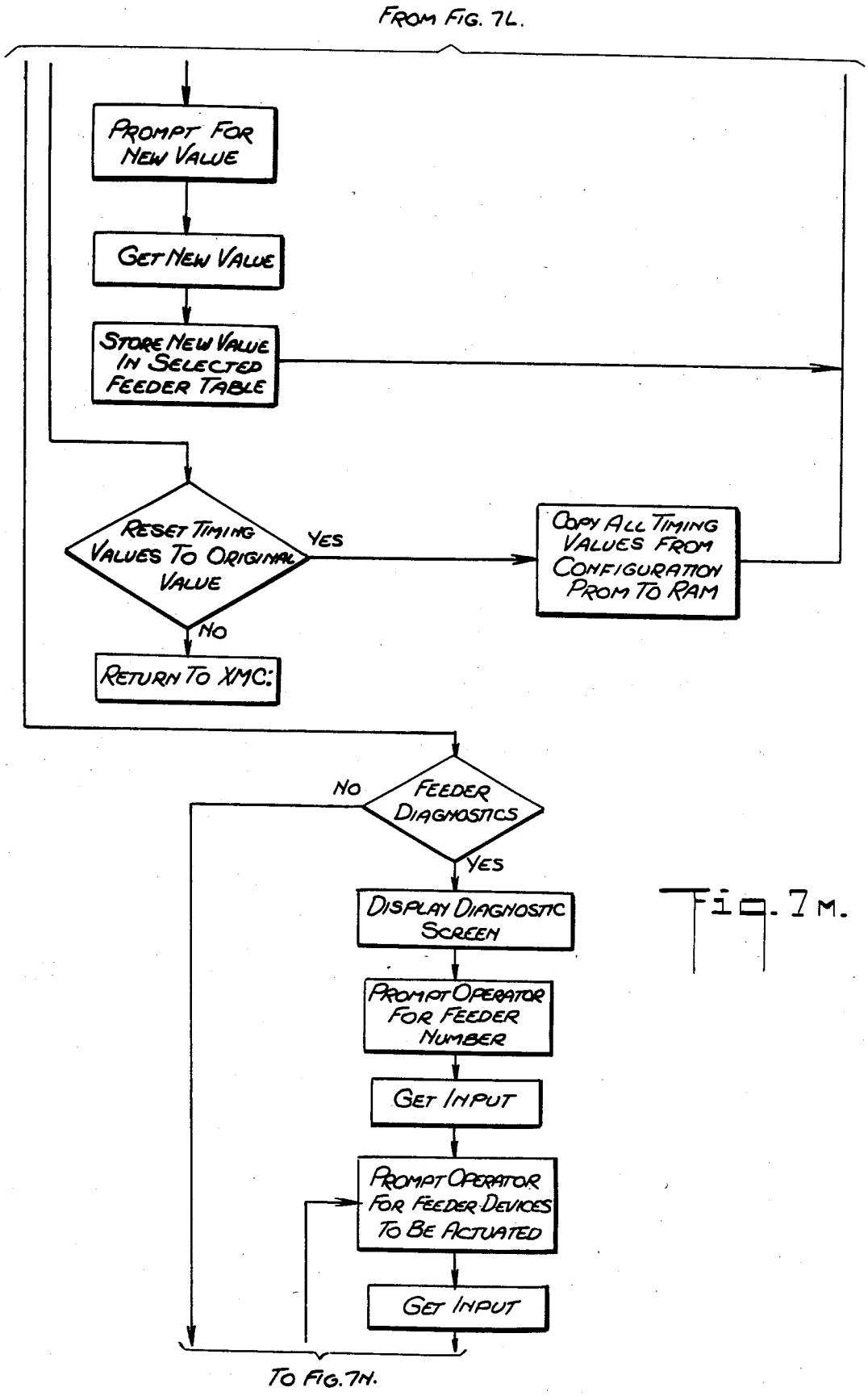
Figure 7N:
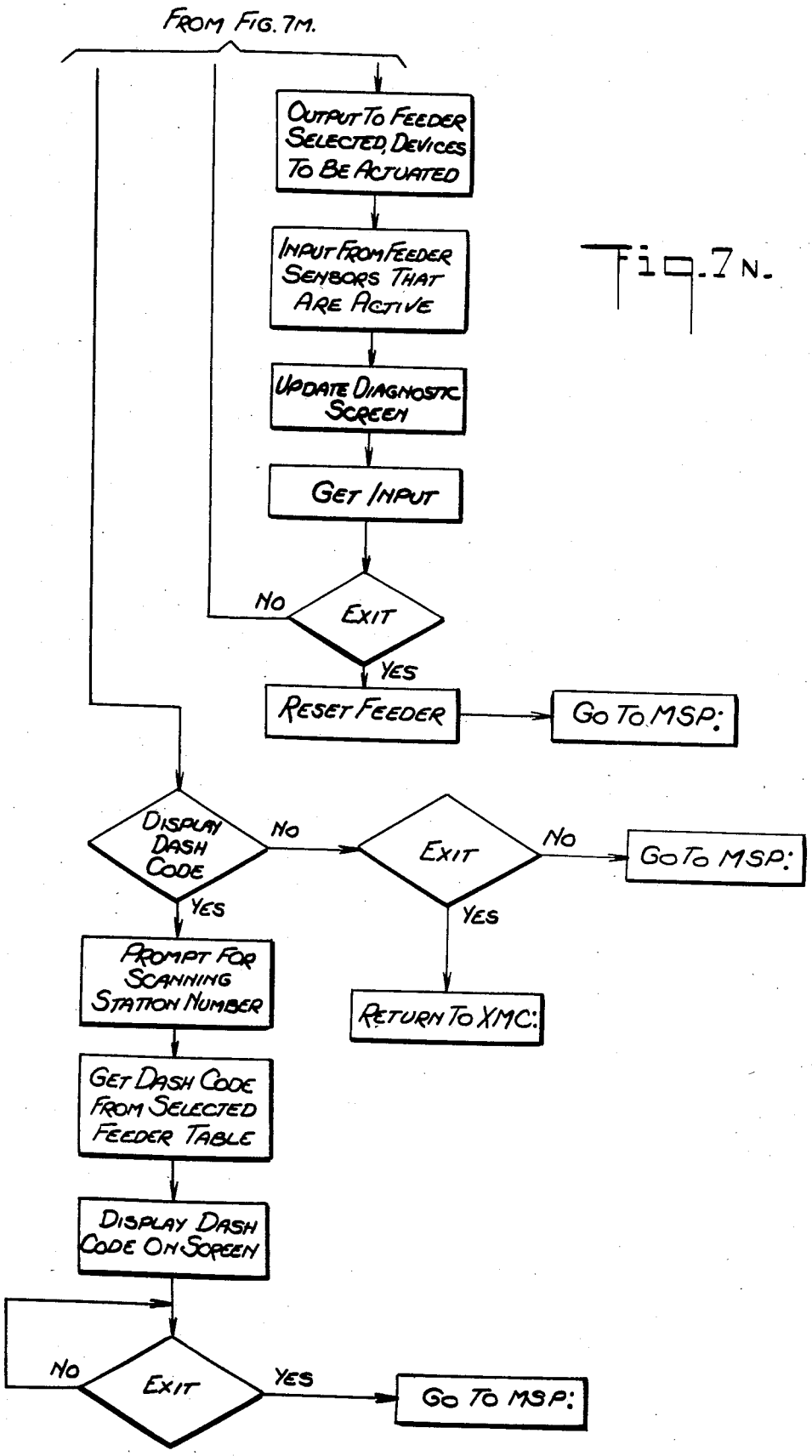
Figure 8A:
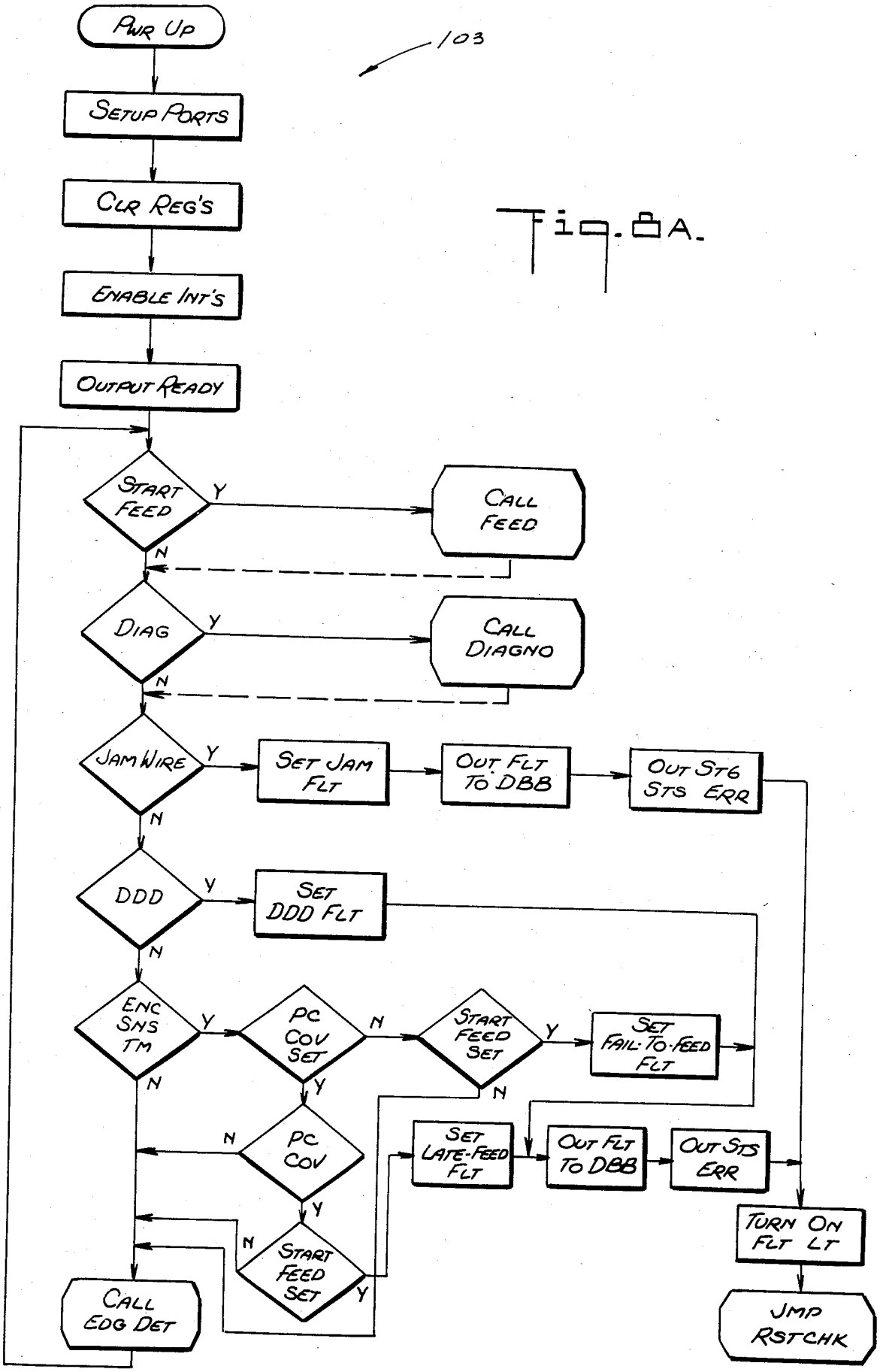
FIGS. 8*a*–8*e* are flow charts of the feeder program for use in a high ratio feeder.
Figure 8B:
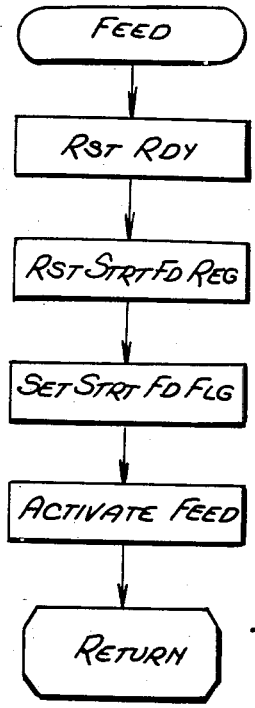
Figure 8C:
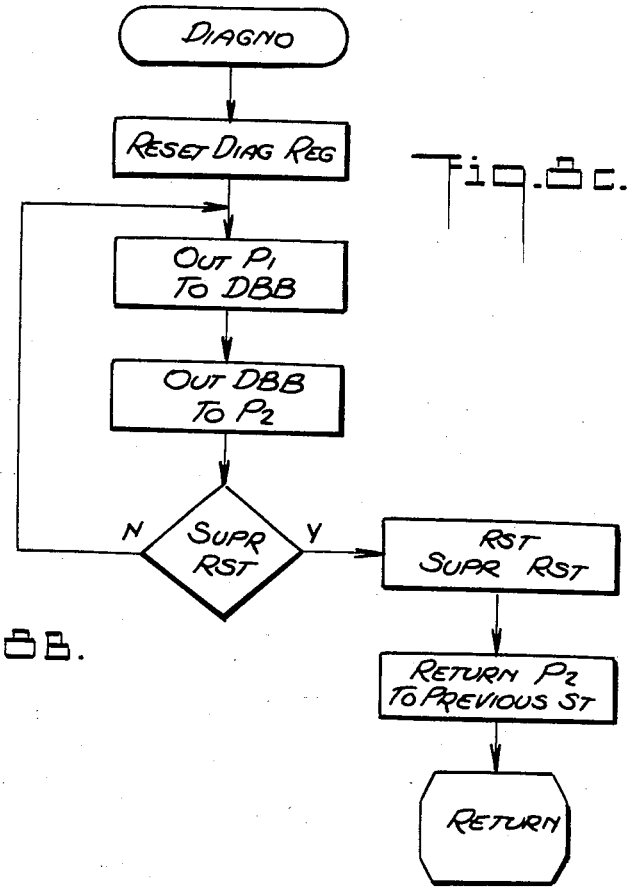
Figure 8D:
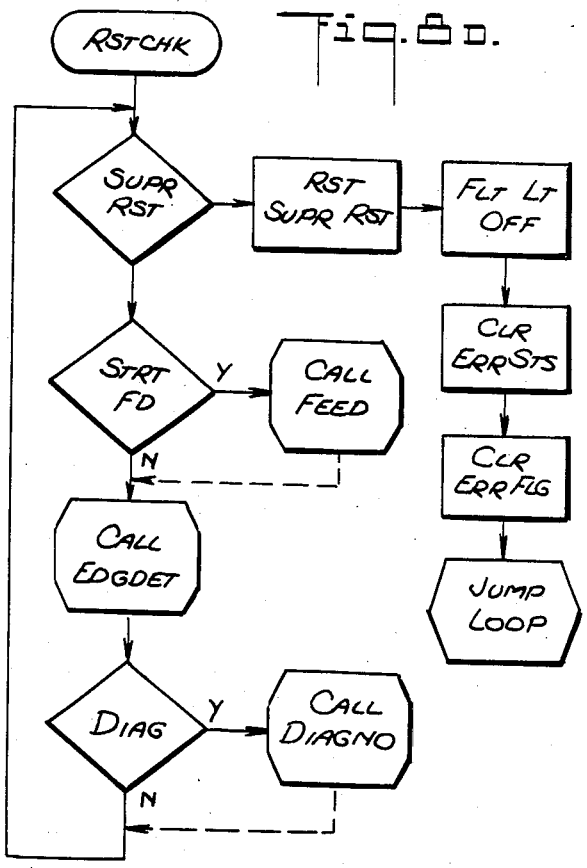
Figure 8E:
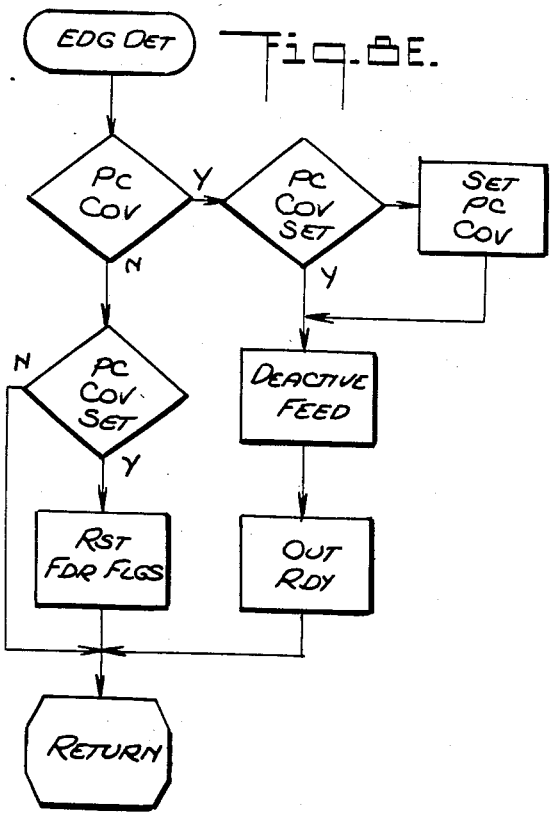
Figures 9A, 9B:
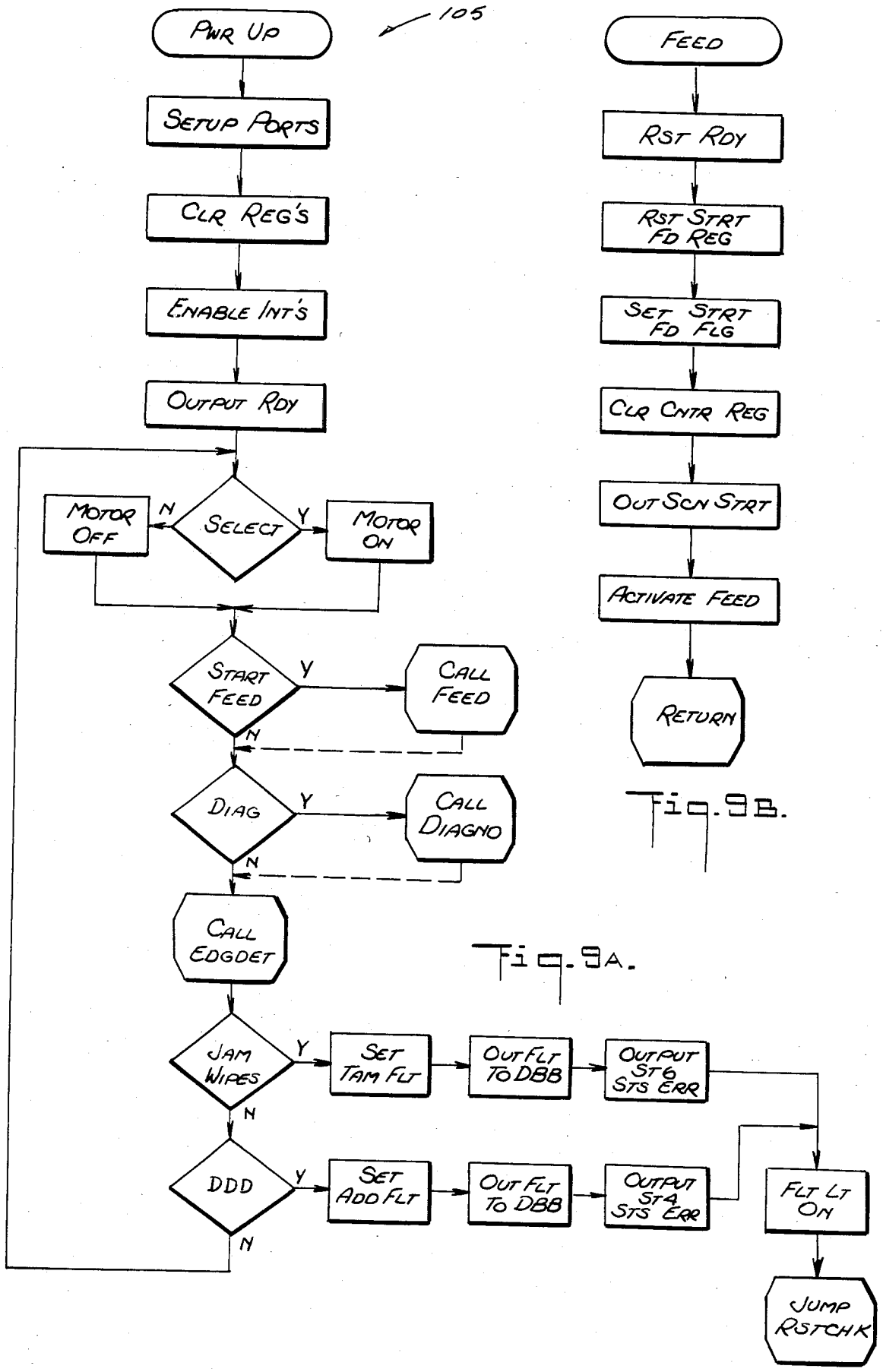
FIGS. 9*a*–9*e* are flow charts of the feeder program for use in a high speed feeder.
Figure 9E:
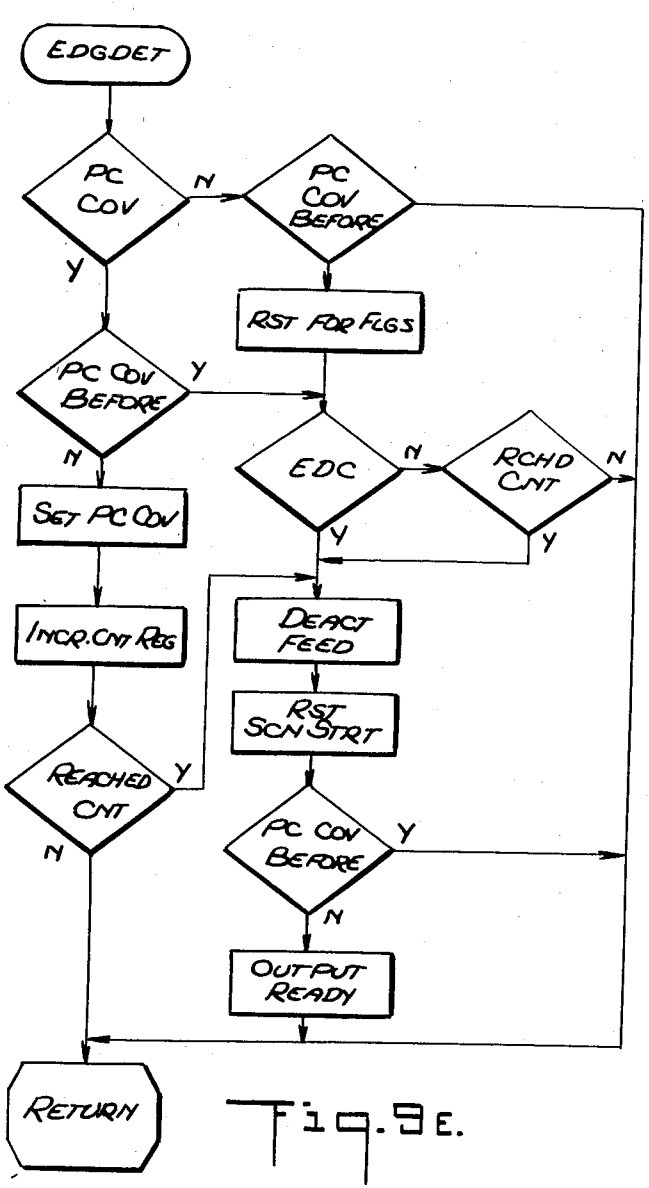
Figure 9D:
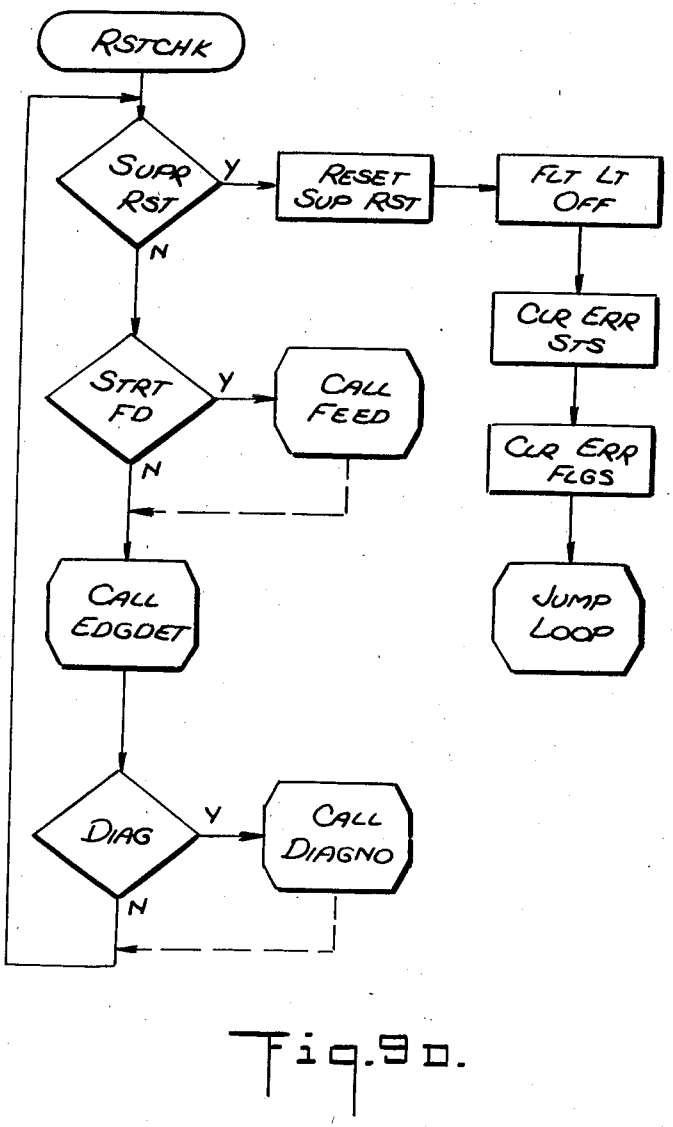
Figure 9C:
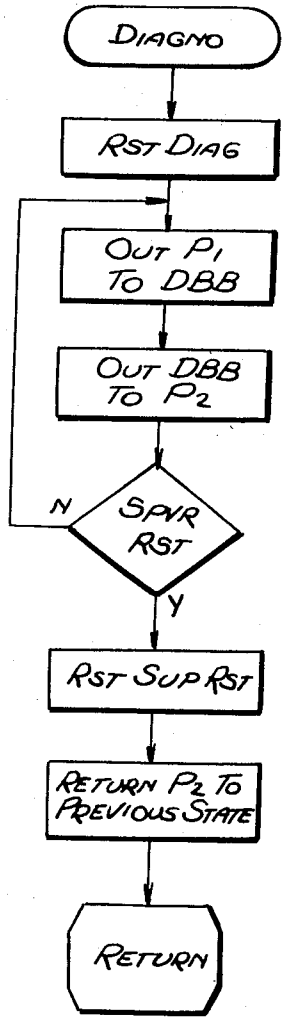
Figures 10A, 10B:
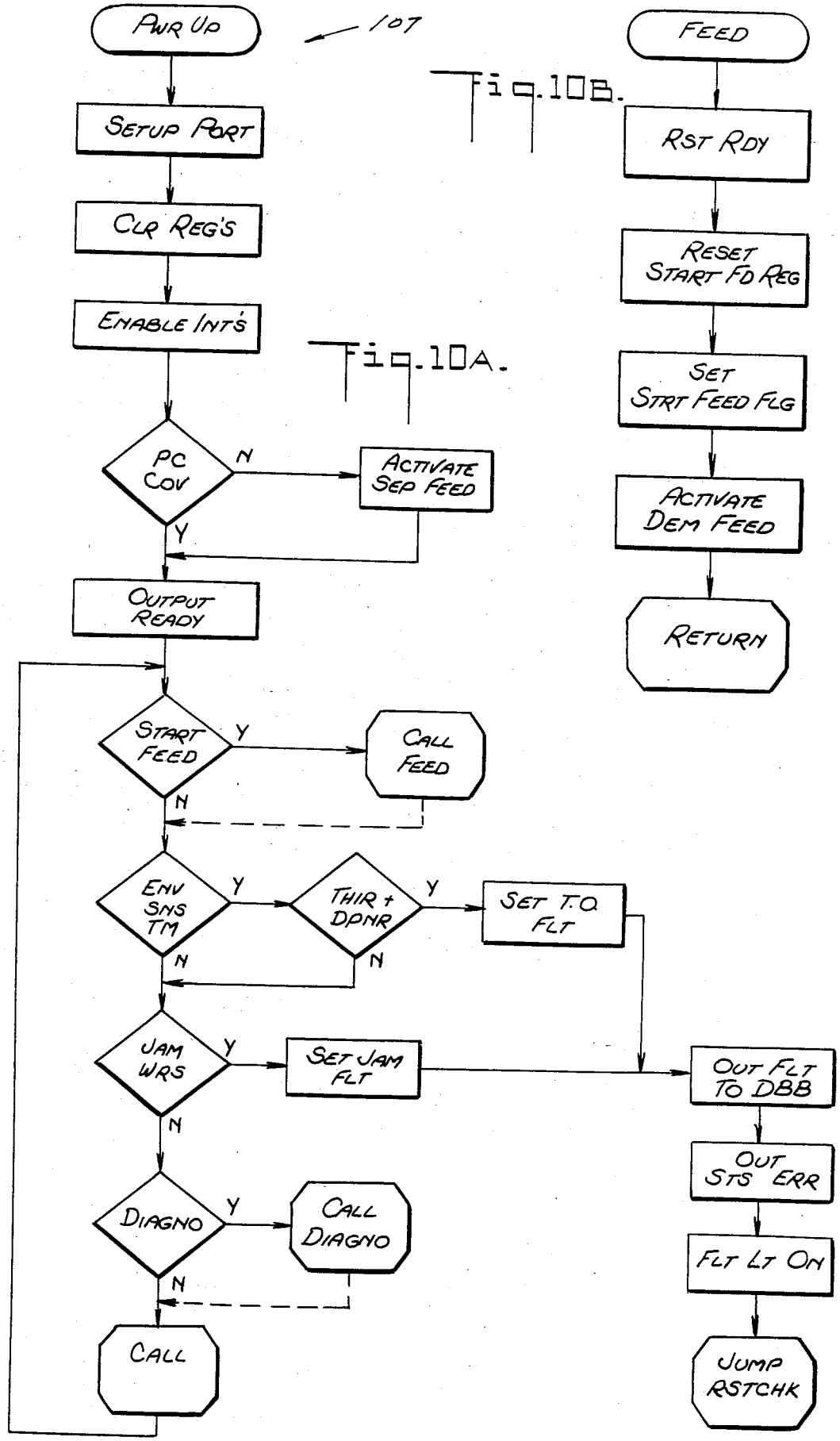
FIGS. 10*a*–10*e* are flow charts of the feeder program for use in an envelope feeder.
Figure 10C:
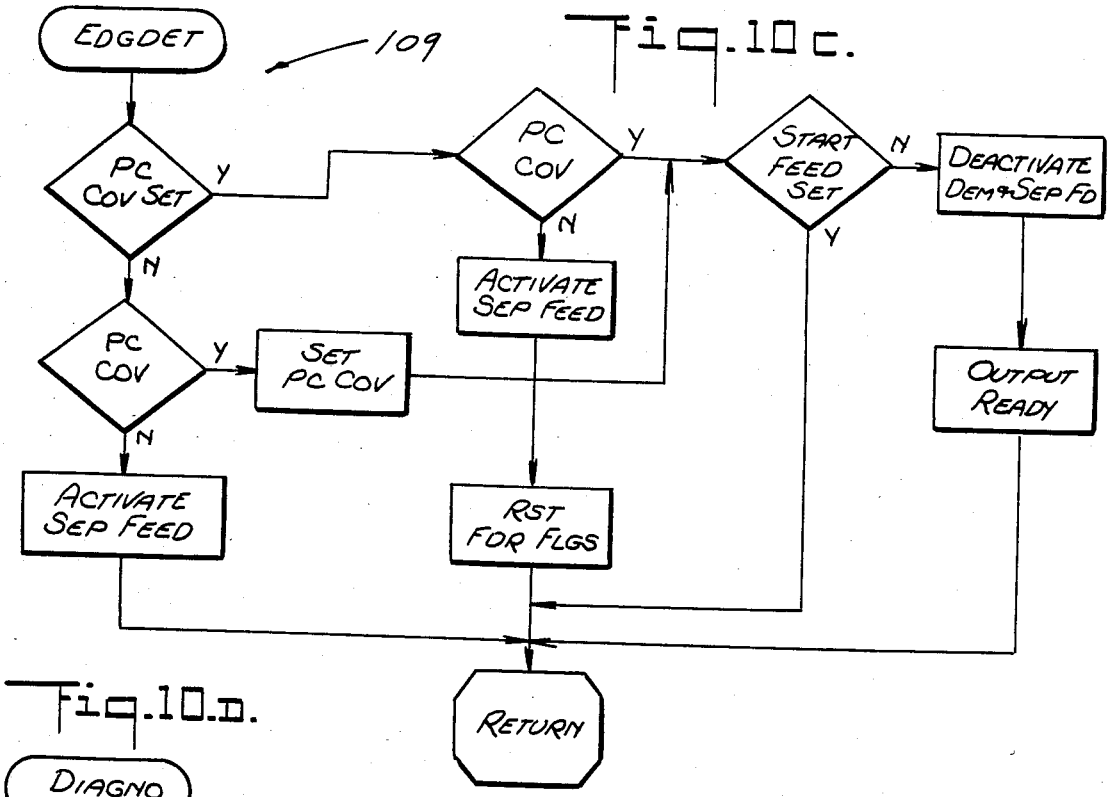
Figure 10D:
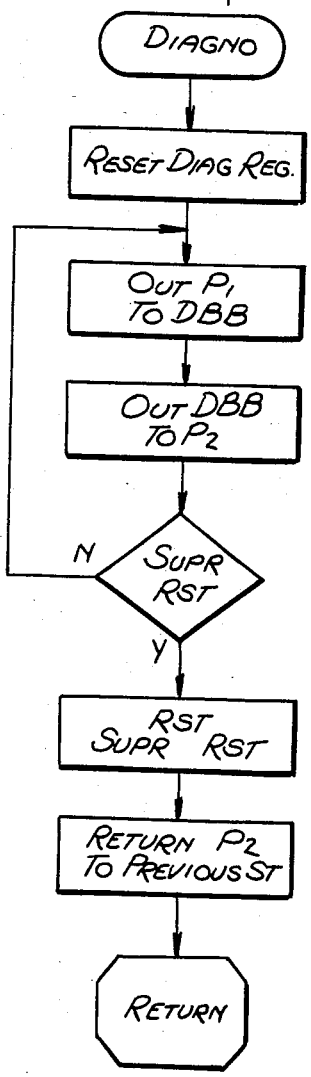
Figure 10E:
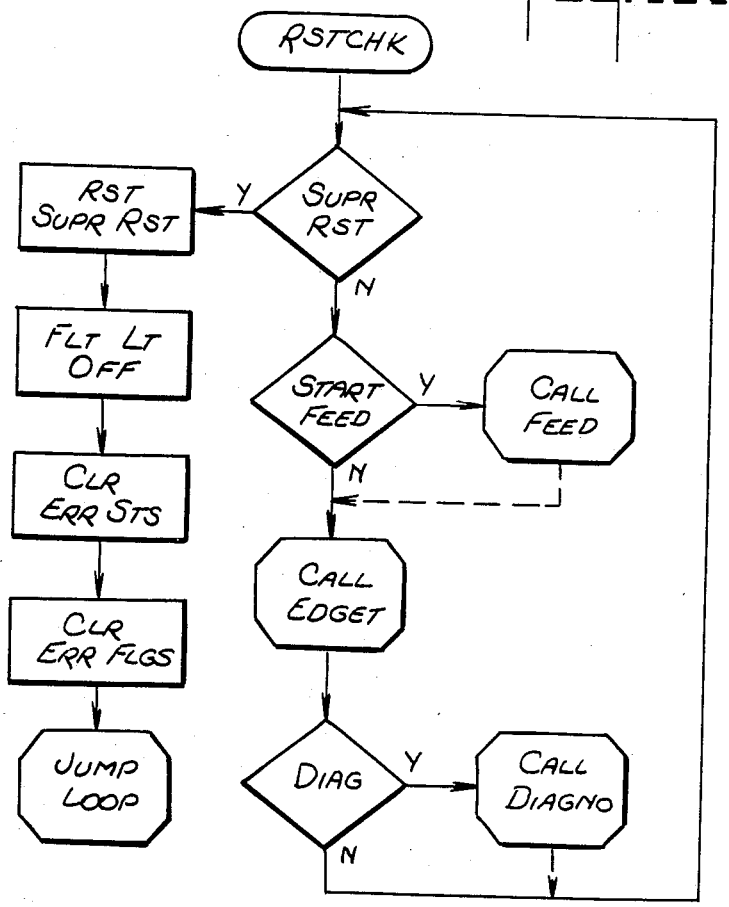

Referring to FIG. 6, the transport interface circuit 102 is illustrated in detail. The transport interface circuit 102 receives input signals from the central processor 100 over leads 204 and converts the signals to high level voltage signals to drive various inserter devices. The transport encoder is interfaced to central processor 100 through line receivers. The transport interface circuit 102 supplies a D.C. voltage to the battery 192, see FIG. 2, which is used to maintain data storage in the RAM of the central processor 100 for a predetermined period should there be a power failure. Encoder channel signals and encoder marker signals are received on leads 194 and 196, respectively, from the transport encoder 198, see FIG. 2. Power is provided to the transport interface circuit 102 from power supply 104.

The transport interface circuit 102 includes logic circuitry including LEDS 200 and gates 202. The gates 202 provide override signals to output leads 206 in conjunction with signals received on data leads 204 from the central processor 100. The output leads 206 provides signals to drive the various devices, such as the clutch, motor, and brake of the transport deck and set certain LEDS 200 which provide visual indicators that the appropriate signals have been output. Additional details regarding the transport interface circuit may be obtained from copending patent application Ser. No. 394,387 filed on July 1, 1982 in the names of Peter N. Piotroski and John M. Gomes, entitled, TRANSPORT INTERFACE CIRCUIT FOR UNIVERSAL MULTI-STATION DOCUMENT INSERTER.

Referring to FIG. 2, the accessory interface circuit 105 receives input signals from the signal bus 96 and power bus 98 and provides output signals to activate various accessories, such as postage meters 78 and 80, a rotatable envelope table, and power stackers 82 through 94.

To commence inserter operation, an on/off key switch is activated with the key being removable in the "off" position. The operator then starts the inserter 40 by first selecting a Continuous or One-Cycle switch and then activating a Sequence Start switch on the central control display 34. When its Sequence Start switch is activated, the central processor 100 sends a Command to activate the last feeder module 76. That is, the feeder module 76 most remote from the envelope feeder 48 is activated to feed the required number of documents. The next feeder module 74 in sequence is then activated on Command from the central processor 100 and the documents are fed from this feeder 74. Document feeding continues, sequentially in this fashion from one feeder module to the next to provide a complete collation of documents at the envelope feeder 48. It should be understood that the control document scanner of feeder module 76 is initialized during power up of the inserter as will be described in more detail below.

In contrast, when the inserter is to be shut down, the operator activates a Clear Deck switch on the central control display 34 and the same process which occurred with the Sequence Start sequence is repeated, with the exception that the feeder station 76 most remote from the envelope feeder 48 is deactivated after feeding the desired documents and then feeders 74–50 are deactivated sequentially to provide a complete collation of documents at the envelope feeder 48 for insertion therein to insure that a partial collation of documents is not left on the transport deck of the document inserter. Operation of the inserter 40 then ceases. Further details regarding the Sequence Start and Clear Deck (Sequence Stop) Modes can be obtained from copending application Ser. No. 394,389, filed on July 1, 1982, in the name of Peter N. Piotroski, entitled, MULTI-STATION DOCUMENT INSERTER WITH AUTOMATIC START UP AND SHUT DOWN DOCUMENT COLLATION SEQUENCES.

After the Sequence Start cycle is completed, the inserter 40 continues its operation. If the operator chooses, he/she can skip the Sequence Start cycle and activate a Start Transport switch which places the inserter 40 in a non-sequence run mode. With either approach, the scanner interface circuit 160 of the control document feeder 76, the last feeder in FIG. 2, reads the dash code marks on the document and transmits them to the central processor 100. During initialization of the scanner interface circuit 160 by the central processor 100, the scanner interface circuit 160 is programmed with the appropriate scanner timing for reading the codes in accordance therewith. The central processor 100 then transmits the address code and Feed Command to the associated feeder module 76. However, as apparent from the accompanying flow chart 101 in FIG. 7, it should be understood that the Feed Command may include signals other than simply feed, such as among others, feed more than one, the number of documents fed, Initialize, and Diagnostic Mode. The feeder module 76 then feeds the required documents in accordance with the feeder program stored therein for that particular type of feeder module. When the scanner interface circuit 160 determines that the last document for that particular collation package has been fed from feeder 76, the scanner interface circuit 160 transmits an End of Collation signal to the feeder interface circuit 110 which ceases document feeding at that station. The document (s) fed from feeder station 76 are then transported along the transport deck to the next feeder station 74. With this process being repeated from station to station so that a properly collated stack of documents arrives at the envelope feeder 48.

Advantageously, the transport deck may include an inclined ramp so that the coded control document (address) is fed up a ramp and placed on top of documents from the downstream stations. At each station the previously fed stack of documents is fed up a ramp and placed on top of the documents fed from the adjacent downstream station, so that all the documents arrive at the envelope feeder 48 with the coded control document on top to facilitate stuffing into an envelope with the address showing through the window of the envelope, such as used in the INSERTAMAX III Mail Inserter available from Pitney Bowes, Inc. of Stamford, Connecticut. However, it should be clearly understood that the transport deck may assume other forms such as a chain drive transport deck such as disclosed in INSERTAMAX II Mail Inserter available from Pitney Bowes, Inc. of Stamford, Connecticut. This transport deck does not include ramps, but simply transport the coded control document to the next feeder station. When the control document is registered therewith, the feeder module feeds the required documents on top of the coded control document. The partially complete stack of documents is moved to the next feeder station and the required documents are then fed therefrom. With such a transport deck the coded control document arrives at the envelope feeder module 48 at the bottom of the collated stack of documents.

The transport encoder 198 provides pulses representing an increment of document travel along the document transport deck or path. The transport encoder 198 communicates these pulses to the central processor 100 which keeps track of the pulse count. The central processor 100 keeps track of the encoder count and issues a Feed Command to the appropriate feeder module when the appropriate count is reached. This count may be the same for all feeder modules or it may vary, as desired.

Any error conditions in the document feed are transmitted from the feeder interface circuit 110 for the particular feeder station to the central processor 100 for display on the central control display 34, describing to the operator the fault location and a description thereof in human readable form.

After the document feeding at each feeder module is complete, the data representing the document is transmitted to the central processor 100 and stored in the RAM, updating the data table representing that document.

Further, as apparent from the supervisory program listing in the accompanying Microfiche Appendix, and the flow chart 101 in FIG. 7, the document inserter 40 includes a Diagnostic Mode for implementation by a service technician. Advantageously, a particular access code known only to the service technician is provided for the Diagnostic Mode. When this code is accessed through the central control display 34, various components of the feeder stations are exercised to determine their operating status. When appropriate, the service technician can modify the state of a particular feeder station to verify a function in order to help him/her determine if a particular malfunction is occurring. For example, during the Diagnostic Mode, the central control display 34 will indicate the state of all the input devices such as switches, photocells, and display switch means and activate the output devices such as motors, clutches, brakes and lights either individually or sequentially. Further, an indicator may be provided to verify that the central processor 100 is communicating properly with various feeder modules or stations. The scanner encoders at the individual feeder modules are also monitored. Advantageously, the central processor 100 and central control display 34 maintain the feeder functions and display the encoder count while a handcrank is actuated. Further, the ability to trace a signal generated by coded dash mark or hole to a designated output device when in the static or handcrank mode is provided. Finally, when in the Diagnostic Mode the central processor 100 and display 34 provide the ability to set or change the feed time of a particular feeder station. Additional details regarding the Diagnostic Mode can be obtained from copending patent application Ser. No. 394,384 filed on July 1, 1982 in the names of Peter N. Piotroski and John M. Gomes entitled DIAGNOSTIC MODE FOR A MULTI-STATION DOCUMENT INSERTER.

Further, the operator may change or reconfigure the supervisory control circuit 100 by activating certain switches of the central control display 34 so that mirror image of the data table in the configuration PROM which is present in the RAM is changed. D.C. battery back up is provided to retain the changed information in the RAM during power failure. The RAM of the central processor 100 also stores the information representing the original data table for recapture should the operator or service technician desire to reset the inserter to its original operating condition. Further, details of the central control display and the ability of the operator to reconfigure the inserter through such display is found in the aforementioned copending patent application Ser. No. 394,386, entitled USER FRIENDLY CENTRAL CONTROL DISPLAY FOR A MULTI-STATION DOCUMENT INSERTER.

It should be understood by those skilled in the art that various modifications may be made in the present invention without departing from the spirit and scope thereof, as described in the specification and defined in the appended claims.

What is claimed is:

1. A method for providing a universal multistation document inserter for inserting documents into an envelope, including the steps of:

providing a central processor;

providing a plurality of modular feeder stations for feeding documents in response to signals from the central processor;

providing each feeder station with a unique address;

storing predetermined feeder programs in distributed processors associated, respectively, with each of the modular feeder stations, each of the feeder programs providing instructions to the associated feeder station for feeding documents;

storing a supervisory program in the central processor operative for providing address and command signals to the distributed processors of the feeder stations;

interconnecting the central processor and the distributed processors for the communication of signals so that upon receipt of the proper address and command signals at a particular distributed processor, the associated feeder station will execute its document feeding functions under control of the central processor in accordance with instructions programmed in the distributed processor;

transporting a coded document from feeder station to feeder station; and scanning the coded document and inputting the coded information to the central processor for controlling the operation of each feeder station.

2. The method recited in claim 1, including the step of:

communicating end of collation signals to the feeder stations in response to the codes on the coded documents.

3. The method recited in claim 1, wherein the step of storing a supervisory program comprises:

storing the supervisory program in a plurality of PROMS, one PROM of which includes a data table that specifies a particular inserter configuration and the functions to be performed for that inserter configuration.

4. The method recited in claim 1, including the step of:

scanning for the presence of a coded document at each feeder station of said plurality of feeder stations to provide input data to the central processor regarding the status of the coded document.

5. The method recited in claim 1, including the step of:

converting output signals from the central processor to high level voltage signals for actuating a means for transporting documents from one feeder station of said plurality of feeder stations to the next feeder station.

6. The method recited in claim 1, including the step of:

sequentially actuating feeder stations and feeding documents from feeder station to feeder station beginning with the last feeder station during a Sequence Start Mode to ensure a complete initial collation of documents to be fed from the feeder stations.

7. The method recited in claim 1, including the step of:

sequentially deactivating the feeder stations one by one beginning with the last feeder station during a Sequence Stop Mode to ensure that a partial collation of documents is not left in a feeder station of the document inserter.

8. The method recited in claim 1, including the step of:

accessing the central processor to provide a Diagnostic Mode and a visual display associated with said Diagnostic Mode.

9. The method recited in claim 1, including the step of:

displaying fault signals indicating the location of the fault and providing a description thereof in human readable form.

10. The method recited in claim 1, including the step of:

changing the configuration of the document inserter by instructions submitted to the central processor by the inserter operator.

11. The method recited in claim 10, including the steps of:

retaining for reference the initial central processor configuration when changes are made; and displaying the initial central processor configuration when requested.

12. The method recited in claim 1, wherein:

the central processor is interconnected to the distributed processors through a signal bus and provides unique address codes for the distributed processors.

13. A method for providing a universal multistation document inserter, comprising the steps of:

providing a central processor;

providing a plurality of feeder stations for feeding documents in response to control signals from the central processor;

providing each feeder station with a unique address;

storing predetermined feeder programs in distributed processors associated, respectively, with each of the feeder stations, each of the feeder programs providing instructions to each associated feeder station for feeding documents in response to control signals from the central processor;

storing a supervisory program in the central processor which is operative for providing address and command signals to the distributed processors of the feeder stations;

interconnecting the central processor and the distributed processors for the communication of signals so that upon receipt of the proper address and command signals at a particular distributed processor, the associated feeder station will execute its document feeding functions under control of the central processor in accordance with the instructions programmed into the distributed processor;

scanning coded control documents to provide input signals to the central processor upon detection of predetermined document codes; and converting output signals from the central processor to high level voltage signals for actuating document transport devices associated with the document inserter.

14. The method recited in claim 13, including the steps of;

sequentially feeding coded documents from one feeder station to another;

feeding documents from a feeder station in response to command signals from the central processor.

15. The method recited in claim 13, including the step of:

accessing the supervisory program to provide a Diagnostic Mode for servicing the inserter.

16. The method recited in claim 13, including the steps of:

changing the configuration of the inserter by instructions submitted to the central processor by the inserter operator.

17. The method recited in claim 16, including the steps of:

retaining for reference the original inserter configuration in the central processor after the configuration has been changed by the operator; and displaying the initial programmed configuration when requested.

18. A method of providing a universal multistation document inserter, including the steps of:

providing a plurality of feeder stations for feeding documents in response to signals from a central processor;

storing a supervisory program including a data table in the central processor which includes information on the type of feeder stations and the function to be performed thereby;

scanning documents for a document code;

providing a signal indicative of the presence of a coded document to a central processor;

providing a unique address for each feeder station;

accessing the data table stored in the central processor to determine the type of feeder station present at each feeder station location and the function to be performed thereby;

transmitting to said plurality of feeder stations a command signal from the central processor including the unique address of a particular feeder station;

feeding a document from said particular feeder station in response to the command signal; and updating the data table in the central processor after the feeder station has fed the document to include data as to the status of a coded document.

19. The method recited in claim 18, wherein:

the steps of accessing, feeding, and updating are undertaken for each feeder station during each cycle of operation of the inserter.

20. A universal multi-station document inserter, comprising:

a plurality of feeder means arranged to feed documents;

address means associated with each of said feeder means to specify a unique address for each of said feeder means;

distributed processor means associated with each of said feeder means;

scanner means for detecting the presence of a predetermined code on a coded document; and central processor means interconnected to said scanner means and said distributed processor means for activating said distributed processor means in response to a signal from said scanner means, which signal indicates the presence of a coded document having the predetermined code.

21. The universal multi-station document inserter recited in claim 20, including:

means for receiving address data specifying a unique address for each of said feeder means;

comparator means for comparing the data received by said means for receiving data with the unique address specified by said address means to provide an acknowledge signal when there is a coincidence therebetween.

22. The universal multi-station document inserter recited in claim 20, including:

means for reading data from said central processor means in response to a transfer acknowledge signal;

said central processor means issuing a feed command to said feed means in accordance with data stored therein; and means for updating the data in said central processor means in response to the actions of said feeder means.

23. A universal multi-station document inserter, including:

a plurality of feeder stations for feeding documents;

distributed processor means associated with each of said feeder stations for feeding documents in accordance with feeder programs stored therein;

address means associated with each of said feeder stations for providing a unique address thereto;

central processor means electrically coupled to said distributed processor means for interaction therewith to initiate the feeding of documents by said feeder stations; and scanner means electrically coupled to said central processor and said feeder stations for providing signals in correspondence with the coded documents at said feeder stations.

24. The universal multi-station document inserter recited in claim 23, wherein:

said central processor means includes PROM means programmed to supervise the feeding of documents by said feeder stations.

25. The universal multi-station document inserter recited in claim 24, wherein:

said PROM means includes a configuration PROM means including data which configures the inserter operation in accordance with desired user functions.

26. The universal multi-station document inserter recited in claim 25, wherein:

said central processor means includes RAM means for storing the data present in said configuration PROM means;

switch means for enabling the operator to reconfigure said RAM means;

display means for displaying the original inserter configuration present in said configuration PROM means.

27. The universal multi-station document inserter recited in claim 23, wherein:

said scanner means provide end of collation signals to said feeder stations.

28. The multi-station document inserter recited in claim 23, wherein:

said feeder stations are constructed in modules for interconnection to provide the desired number of feeder stations.

29. The universal multi-station document inserter system recited in claim 23, wherein:

said feeder stations are connected in parallel between a signal bus and a power bus;

said central processor is electrically coupled to said signal bus;

said power bus is electrically coupled to a power supply.

30. The universal multi-station document inserter recited in claim 29, including:

transport means electrically coupled to a power supply and said central processor for converting low level voltage signals from said central processor to high level voltage signals for driving document transport devices of the document inserter.

31. The multi-station document inserter recited in claim 23, including:

display means for displaying the location and a description of any faults present in the inserter in human readable form.

32. A universal multi-station document inserter, including:

a plurality of feeder stations arranged to feed documents;

distributed processor means associated with each of said feeder stations;

supervisory control means electrically coupled to said distributed processor means;

scanner means electrically coupled to said supervisory control means;

said supervisory control means being programmed to interact with said feeder stations in accordance with certain predetermined operating conditions desired by a user; and said supervisory control means including first PROM means programmed with a maximum set of defined inserter configurations and functions and a second PROM means configured to interact with the program of said first PROM means to select a subset of the maximum set of defined inserter configurations and functions to operate the document inserter in accordance with desired customer requirements.

33. The multi-station document inserter recited in claim 32, wherein:

said feeder stations are connected in parallel between a signal bus and a power bus;

said supervisory control means is electrically coupled to said signal bus;

said power bus is electrically coupled to a power supply; and a transport interface means is electrically coupled to said power supply and said supervisory control means for converting low level voltage signals from said supervisory control means to high level voltage signals for driving document transport devices associated with the document inserter.

34. The multi-station document inserter recited in claim 33, including:

accessory interface means responsive to signals from said power bus and signal bus for activating accessories.

* * * * *